US009808085B1

(12) United States Patent
Jacobs et al.

(10) Patent No.: US 9,808,085 B1
(45) Date of Patent: Nov. 7, 2017

(54) BEAM MOUNTED CHAIR ASSEMBLIES, CHAIR ASSEMBLIES OF USE WITHIN THE BEAM MOUNTED CHAIR ASSEMBLIES, COMPONENTS FOR USE WITHIN THE CHAIR ASSEMBLIES AND PARTS FOR USE WITHIN THE COMPONENTS

(71) Applicants: Frederick D. Jacobs, Holland, MI (US); Matthew D. Jacobs, Holland, MI (US); Michiel VandeVen, West Olive, MI (US)

(72) Inventors: Frederick D. Jacobs, Holland, MI (US); Matthew D. Jacobs, Holland, MI (US); Michiel VandeVen, West Olive, MI (US)

( * ) Notice: Subject to any disclaimer, the term of this patent is extended or adjusted under 35 U.S.C. 154(b) by 0 days.

(21) Appl. No.: 15/640,938

(22) Filed: Jul. 3, 2017

Related U.S. Application Data

(63) Continuation of application No. 14/788,767, filed on Jun. 30, 2015, now Pat. No. 9,693,630.

(51) Int. Cl.

| | |
|---|---|
| ***E04H 3/10*** | (2006.01) |
| ***A47C 1/121*** | (2006.01) |
| ***A47C 7/24*** | (2006.01) |
| ***A47C 7/30*** | (2006.01) |
| ***A47C 7/54*** | (2006.01) |
| ***A47C 11/00*** | (2006.01) |
| *A47C 1/124* | (2006.01) |
| *A47C 7/56* | (2006.01) |
| *A47C 1/12* | (2006.01) |
| *A47C 7/58* | (2006.01) |
| *A47C 7/60* | (2006.01) |

(52) U.S. Cl.
CPC ..... *A47C 1/121* (2013.01); *A47C 7/24* (2013.01); *A47C 7/30* (2013.01); *A47C 7/543* (2013.01); *A47C 11/005* (2013.01); *A47C 1/12* (2013.01); *A47C 1/124* (2013.01); *A47C 7/56* (2013.01); *A47C 7/58* (2013.01); *A47C 7/60* (2013.01)

(58) Field of Classification Search
CPC .. A47C 1/121; A47C 7/56; A47C 1/12; A47C 7/58; A47C 7/60; A47C 1/124; A47C 7/24; A47C 7/30; A47C 7/543; A47C 11/005
USPC ..... 52/6, 8, 9; 297/236, 232, 248
See application file for complete search history.

(56) References Cited

U.S. PATENT DOCUMENTS

| | | | | |
|---|---|---|---|---|
| 9,693,630 | B2 * | 7/2017 | Jacobs | A47C 1/121 |
| 2005/0168032 | A1 * | 8/2005 | Olarte | A47C 1/121 297/331 |

* cited by examiner

*Primary Examiner* — Chi Q Nguyen
(74) *Attorney, Agent, or Firm* — James E. Shultz, Jr.

(57) ABSTRACT

Beam mounted chair assemblies may include at least two standards supported on a floor, a beam secured to, and supported by, the standards, and a plurality of chair assemblies secured to, and supported by, the beam. Chair assemblies may be secured to a beam via associated chair brackets. Chair brackets may include chair seat pivots that pivotally secure a chair seat in proximity to a chair back such that the chair seat may pivot between an up and a down position. Chair brackets and standards may be secured to a beam such that the chair brackets and standards may be linearly positioned along a full length of the beam without interfering with one another.

20 Claims, 51 Drawing Sheets

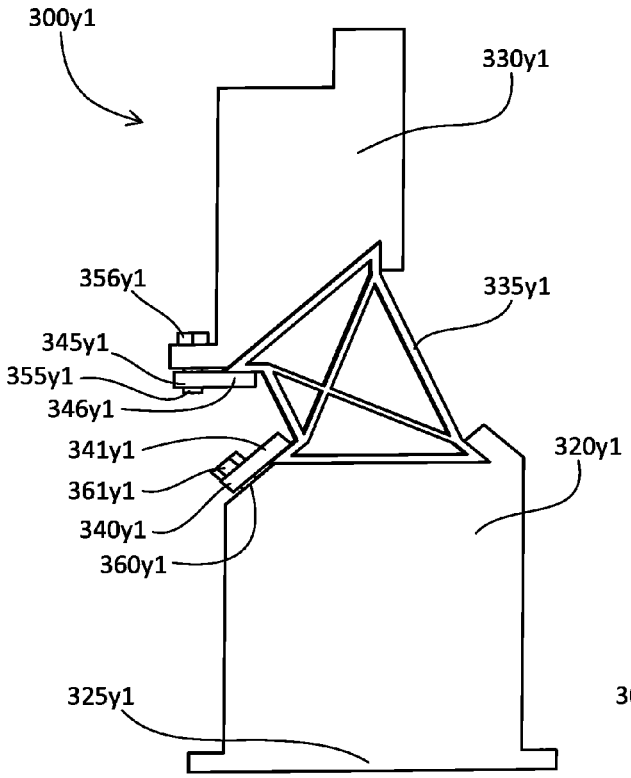
Fig. 3Y1
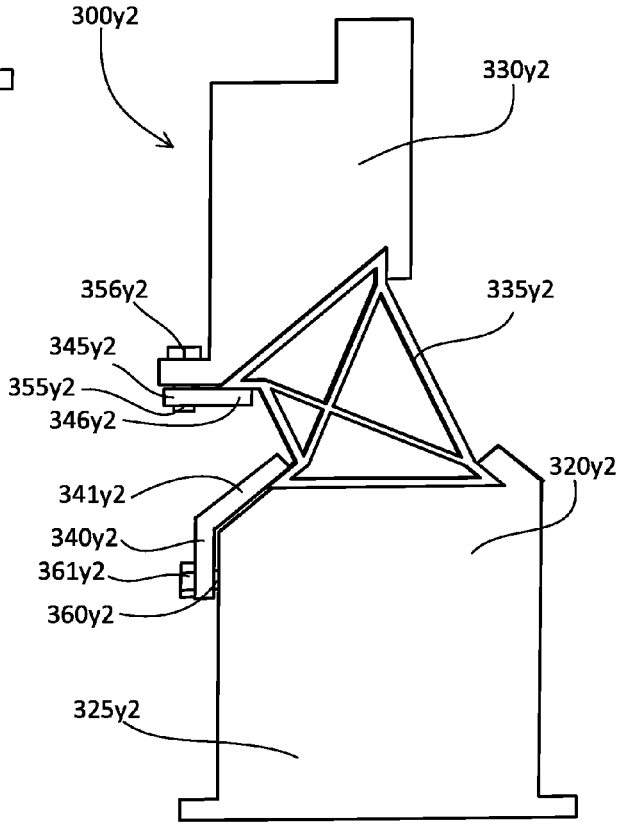
Fig. 3Y2

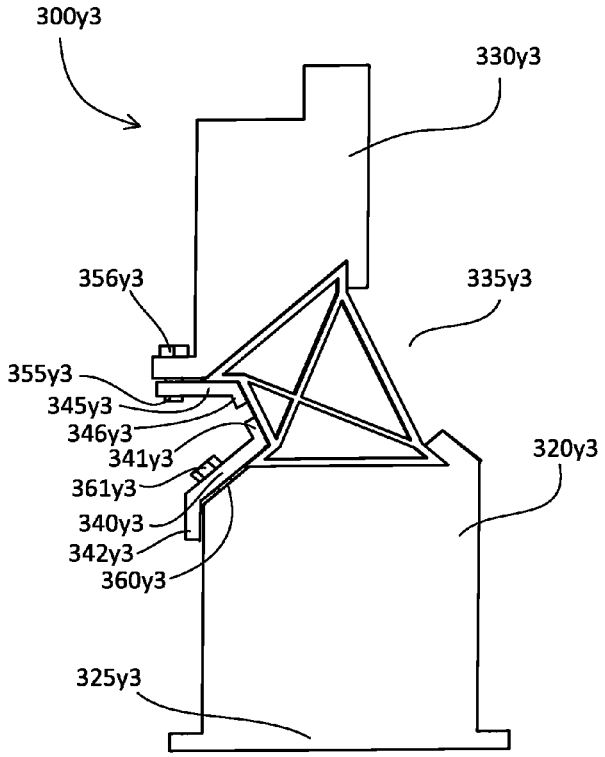
Fig. 3Y3
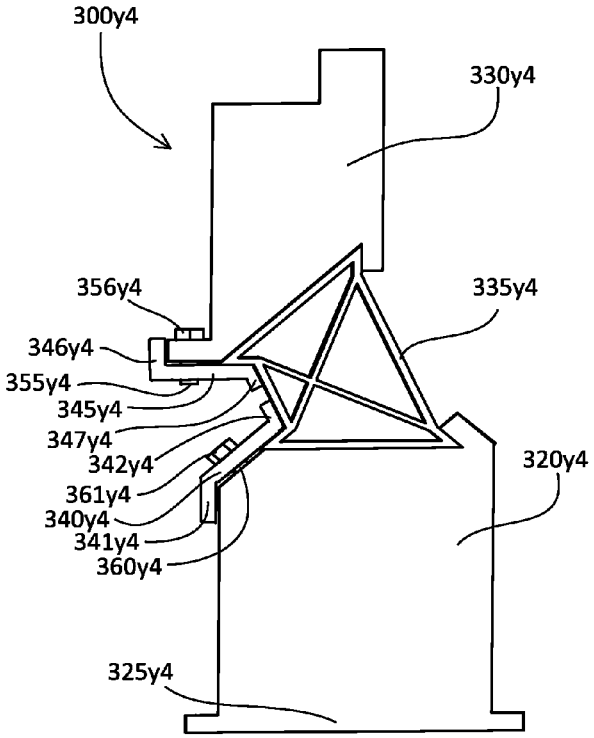
Fig. 3Y4

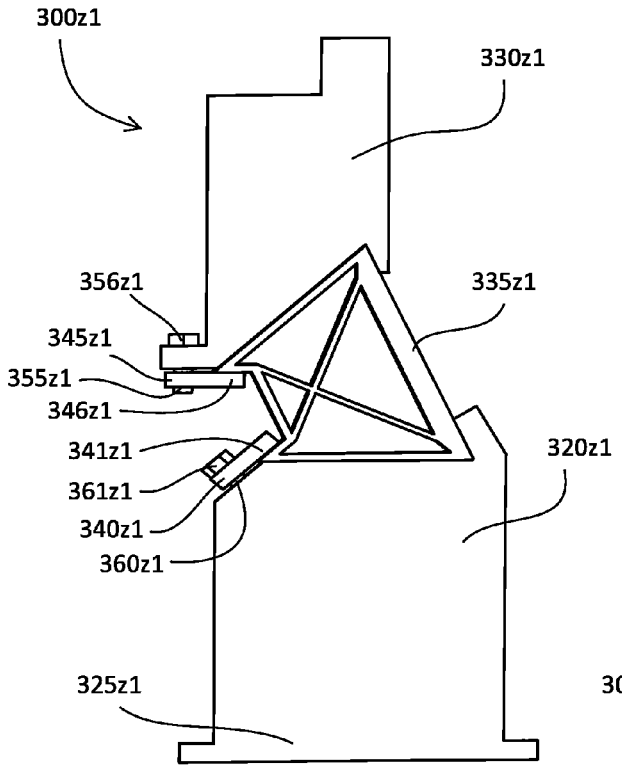
Fig. 3Z1
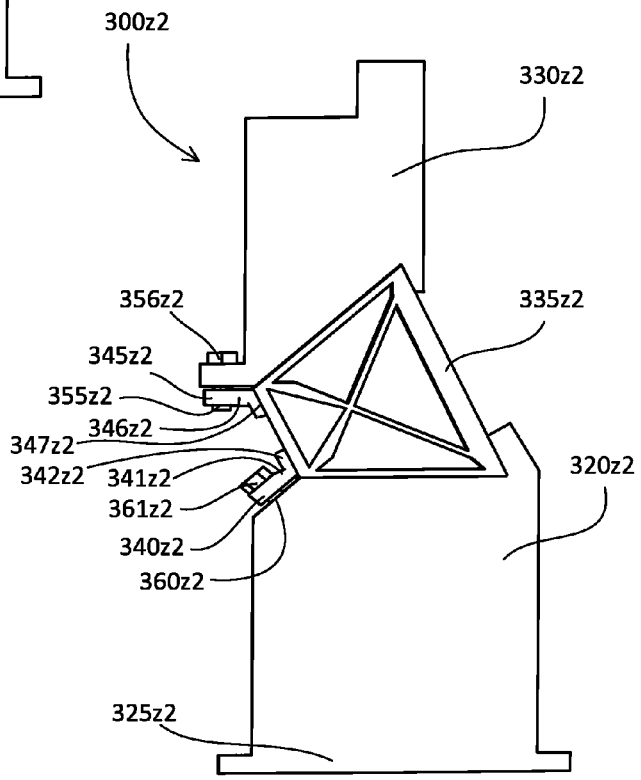
Fig. 3Z2

BEAM MOUNTED CHAIR ASSEMBLIES, CHAIR ASSEMBLIES OF USE WITHIN THE BEAM MOUNTED CHAIR ASSEMBLIES, COMPONENTS FOR USE WITHIN THE CHAIR ASSEMBLIES AND PARTS FOR USE WITHIN THE COMPONENTS

CROSS REFERENCE TO RELATED APPLICATIONS

The present application is a continuation of U.S. patent application Ser. No. 14/788,767, now U.S. Pat. No. 9,693,630, entitled BEAM MOUNTED CHAIR ASSEMBLIES, CHAIR ASSEMBLIES OF USE WITHIN THE BEAM MOUNTED CHAIR ASSEMBLIES, COMPONENTS FOR USE WITHIN THE CHAIR ASSEMBLIES AND PARTS FOR USE WITHIN THE COMPONENTS, filed Jun. 30, 2015, the disclosure of which is incorporated herein in its entirety by reference.

TECHNICAL FIELD

The present disclosure relates to beam mounted chair assemblies. More particularly, the present disclosure relates to beam mounted chair assemblies for auditoriums, cinemas, concert halls, arenas, gymnasiums, theaters and various other venues, and to chair assemblies for use within the beam mounted chair assemblies, components for use within the chair assemblies and parts for use within the components having associated chair brackets and standards secured to a beam such that the chair brackets and standards may be positioned at any location along a full length of the beam without interfering with one another.

BACKGROUND

In the past, buildings such as cinemas, theaters, concert halls, arenas and other areas of public entertainment have been provided with beam mounted chair assemblies. However, more recently there has been a tendency for such buildings to serve more than one purpose. For example, a building for public entertainment may be required on one occasion to serve as a sports hall, and on another occasion to serve as a concert hall or theatre. Similarly, seating arrangements in concert halls, theatres or arenas may need to be reconfigurable to suit the requirements of a particular production being staged.

Tiered seating systems have been devised which, when not in use, can be folded or otherwise collapsed against a wall of the building in which they are situated (e.g. telescopic seating systems such as those disclosed in commonly assigned patent application Ser. No. 61/856,013, entitled Telescopic Seating Systems, and Foldable Chairs and Related Components for use within Telescopic Seating Systems, filed Jul. 18, 2013 and Ser. No. 61/868,547, entitled Telescopic Seating Systems, and Foldable Chairs and Related Components for use within Telescopic Seating Systems, filed Aug. 21, 2013), thus freeing the floor area for other purposes. However, there has, so far, been no satisfactory solution to the problem of installing reconfigurable seating on a sloped floor.

Seating for an audience in a public building or arena must comply with statutory regulations. These regulations are principally intended to ensure that the building or arena can be evacuated rapidly in the event of an emergency. Thus, there is a minimum spacing which must be observed between adjacent rows of seats, and provision must be made for preventing the rows of seats from moving relatively to one another in a way which would reduce the spacing below this minimum during installation.

One way of meeting the statutory requirements is to secure a beam to standards and secure chairs to the beam while each is installed, but this is unsatisfactory. Furthermore, installation and removal of the seats are very time consuming and require skilled labor when the beam is secured to the beam and the individual chairs are secured to the beam while individually being installed.

SUMMARY

Beam mounted chair assemblies may include at least one standard supported on a floor, a curved beam supported by the standard, and a plurality of chair assemblies supported by the beam. A beam may be stably supported on the standard and chair assemblies may be stably supported on the beam such that the beam and the chair assemblies may be set in position during installation without securing the beam to the standard or securing the chair assemblies to the beam.

Beam mounted chair assemblies may include at least two standards supported on a floor, a beam supported by the standards, and a plurality of chair assemblies supported by the beam. A beam may be stably supported on standards and chair assemblies may be stably supported on the beam such that the beam and the chair assemblies may be set in position during installation without securing the beam to the standards or securing the chair assemblies to the beam.

Beam mounted chair assemblies may include at least two standards supported on a floor, a beam secured to, and supported by, the standards, and a plurality of chair assemblies secured to, and supported by, the beam. Chair brackets and standards may be secured to a beam such that the chair brackets and standards may be linearly positioned along a full length of the beam without interfering with one another.

Chair assemblies may be secured to a beam via associated chair brackets. Chair brackets and standards may be secured to a beam such that the chair brackets and standards may be linearly positioned along a full length of the beam without interfering with one another.

Chair brackets may include chair seat pivots that pivotally secure a chair seat in proximity to a chair back such that the chair seat may pivot between an up and a down position. Chair brackets and standards may be secured to a beam such that the chair brackets and standards may be linearly positioned along a full length of the beam without interfering with one another.

Standards may extend horizontally from an associated structure, vertically from an associated structure (e.g., a floor) or a combination thereof. Chair brackets and standards may be secured to a beam such that the chair brackets and standards may be linearly positioned along a full length of the beam without interfering with one another.

BRIEF DESCRIPTION OF THE FIGURES

The figures described below depict various aspects of the systems and methods disclosed herein. It should be understood that each figure depicts an embodiment of a particular aspect of the disclosed systems and methods, and that each of the figures is intended to accord with a possible embodiment thereof. Further, wherever possible, the following description refers to the reference numerals included in the following figures, in which features depicted in multiple figures are designated with consistent reference numerals.

FIGS. 1A-1D depict various views of example beam mounted chair assembly installations;

FIGS. 3A-3H, 3J-3N, 3P-3X, 3Y1-3Y4, 3Z1 and 3Z2 depict various views of standards, beams and chair brackets for use within the beam mounted chair assemblies of FIGS. 2A-2C;

DETAIL DESCRIPTION

Figure 1A:
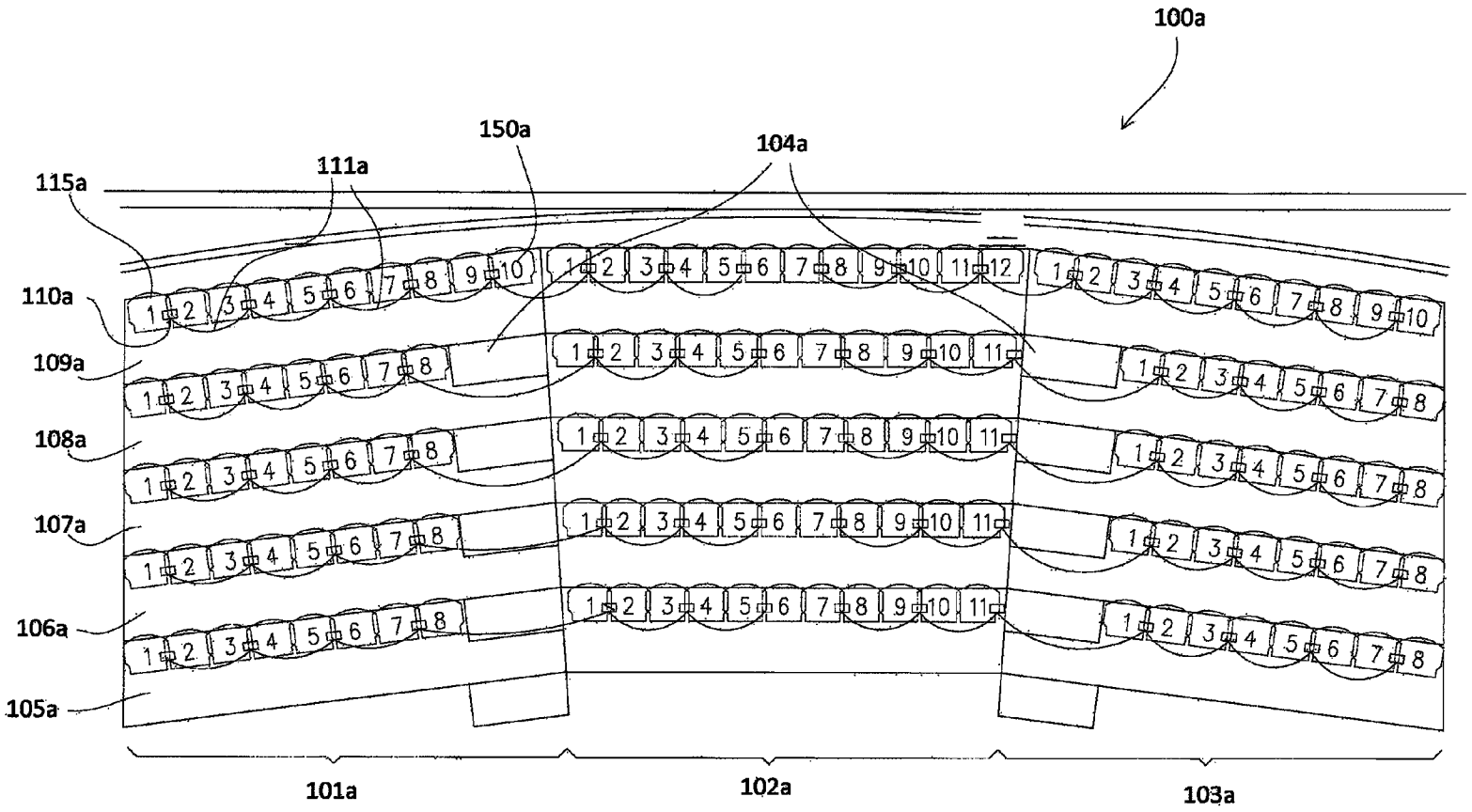

A beam mounted chair assembly is provided where associated chairs may be stably held in place prior to tightening any fasteners thru standard, beam and chair features cooperating with a mechanical moment provided by each chair's center of mass or chair mass properties (e.g., include magnetic beams). Individual chairs may be slid along a full length of a beam without interfering with any standards. While no interference between a standard and a chair bracket is preferred, it should be understood that there may be interference between a standard and a chair bracket in certain circumstances. A clamp system may be provided between a standard and a riser/floor. A lower clamp system may be provided between standards and a beam that stiffens the beam to reduce deflection include torsional deflection such that fewer attachment points (standards) are required. A beam mounted chair assembly may be provided that works for some or all chair installation types (e.g., telescopic chair installations, movable chair installations, fixed position chair installation, etc.). A beam mounted chair standard may be floor mounted. Alternatively, beam mounted chair assemblies of the present disclosure may be incorporated in any installation type (e.g., riser mount, telescopic, movable, linked, etc.).

A beam may be manufactured from a solid material. Alternatively, a beam may be optimized for strength and cost by reducing beam material, for example, by using a box beam or an extruded beam with internal, laterally extending, void areas (e.g., as depicted in FIGS. 3J and K). Interface surfaces between a standard and a beam and/or between a beam and a chair bracket may be substantially flat. Alternatively, interface surfaces between a standard and a beam and/or between a beam and a chair bracket may have non-flat geometry as illustrated, for example, in FIGS. 3G, 3J and 3K. Non-flat interface surfaces between a standard and a beam and/or between a beam and a chair bracket may induce a retention feature under load, for example, when a corresponding clamp is tightened.

Additional member(s) may be added between the standard and the beam to strength the system while minimizing cost. These members will cooperate with the standard and the beam to enhance the system performance. Cooperation between members may be enhanced by features such as pockets or protrusions in any or all adjacent members which engage adjacent members. Adjacent members may be fastened to enhance system performance. Fastening may take the form clamps, welds, bolts, adhesives or other means of linking adjacent members to enhance system performance. Fastening does not require properties to be isotropic and one skilled in the art can envision antistrophic methods which will enhance performance while lowering system cost. A reinforcement beam may extend parallel to a main beam to strengthen an associated beam mounted chair assembly. An added pocket may be provided within associated standard/mounting feet or within the beam to hold a support beam that may be added to spread the mounts. A reinforcement beam and/or a support beam may be an I-beam. Alternatively, a reinforcement beam and/or a support beam may be any shape. A beam may be clamped to a support beam to handle torsion loads. Corners of associated parts of a beam mounted chair assembly may be sharp. Alternatively, corners of associated parts of a beam mounted chair assembly may have radii added for manufacturing, stress reduction, safety, etc. A beam mounted chair assembly may include chairs that are held in place prior to tightening fasteners by using beam and/or chair features that may cooperate with a moment provided by an associated chair's center of mass. Chairs of a beam mounted chair assembly may slide along a full length of a beam to adjust for chair sizes. A beam mounted chair assembly may incorporate associated clamp systems between standards and risers/floors that may be position at any point along a length of a beam. A beam mounted chair assembly design may not require a standard and an associated mounting foot to be offset from one another. A beam design may be symmetrical to reduce installation labor.

Beams may be joined by internal coupling components to allow unrestricted beam length. Coupling components of a standard, a beam and/or a chair bracket may include external features which control insertion depth to aid beam mounted chair assembly installation. Coupling components of a standard, a beam and/or a chair bracket may include features such as slots cut in a round tube to facilitate alignment and to aid assembly. Features described above may vary in geometry (depth, width, quantity, etc.) to aid insertion depth control. For example, a lower clamp system may include features that stiffen an associated beam and/or reduce beam deflection and/or required attachment points. A beam stiffening member and a beam may extend into one another to facilitate installation. Mating surfaces between a beam stiffening member and a beam may extend above or below a top of an associated pocket. Pockets may be attached to a beam allowing for stiffening member/beams of multiple materials and/or component construction.

A beam mounted chair assembly may incorporate fasteners accessible from a top side, a front, a bottom side and/or a back side of an assembly. Beam geometry may be designed to avoid accumulation of water, dirt, debris, etc. A beam mounted chair assembly may incorporate blow molded chair seats and/or chair backs. Blow molded chairs traditionally locate associated chair seat pivot mechanisms below a chair mounting surface. A beam mounted chair assembly may have a chair seat pivot mechanism above an associated chair mounting surface.

Turning to FIG. 1A, beam mounted chair assemblies 115*a*, 150*a* are depicted within an installation 100*a*. The installation 100*a* may be within an auditorium, a cinema, a concert hall, an arena, a gymnasium, a theater, a stadium, or any various other venues. The installation 100*a* may include a series of rows of beam mounted chair assemblies 105*a*-

109*a* arranged in columns 101*a*-103*a* having isle ways 104*a* between the columns 101*a*-103*a*. the installation 100*a* may include power/data outlets 110*a* and related interconnections 111*a*. Any given beam may include an arched geometry to accommodate chairs in center column 102*a* being farther from an associated stage, for example, when compared to chairs in columns 101*a*, 103*a*.

Figure 1B:
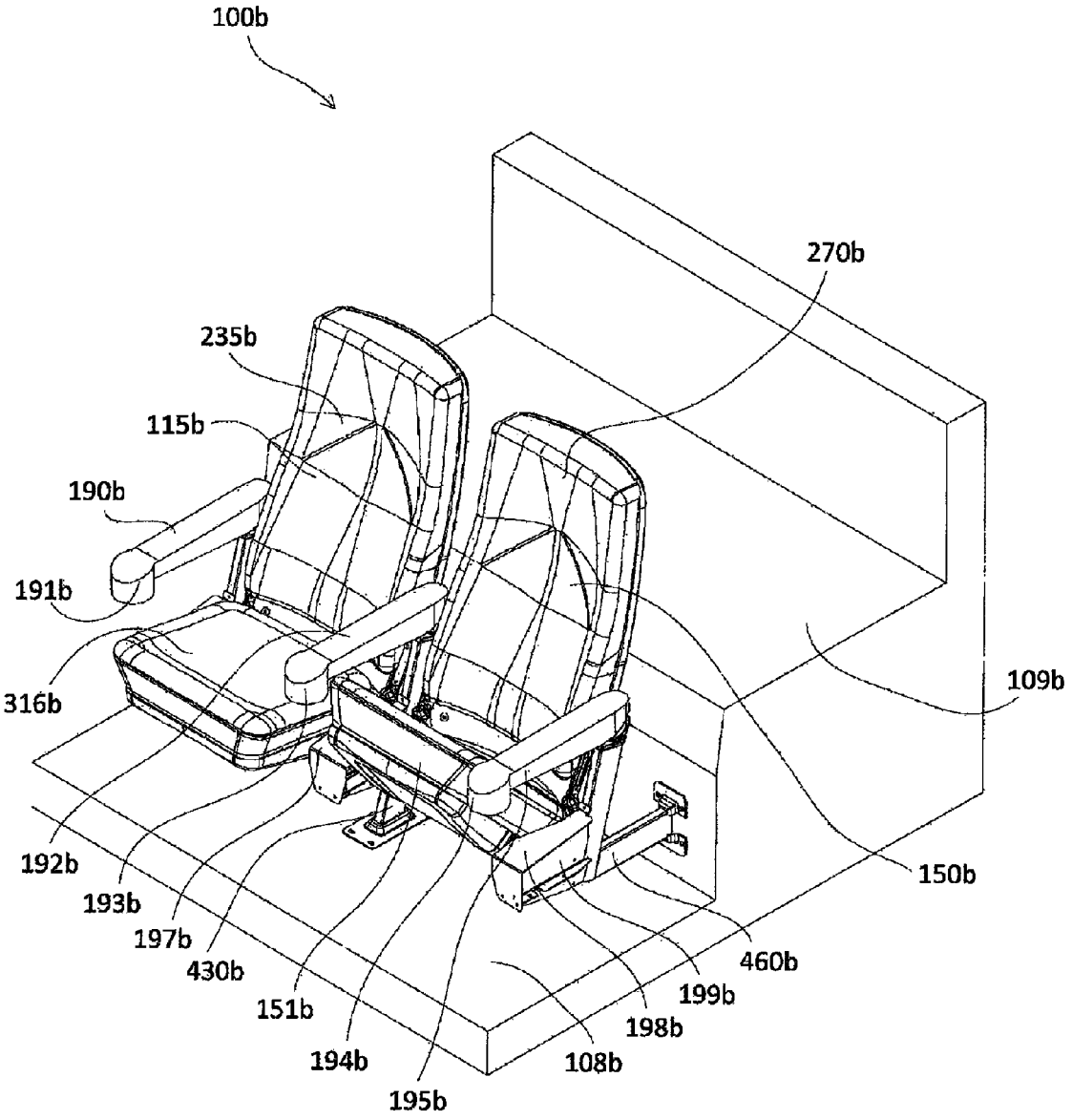

With reference to FIG. 1B, an installation 100*b* may include a plurality of beam mounted chair assemblies 235*b*, 270*b* arranged on a multi-level structure 108*b*, 109*b*. Each set of chairs 235*b*, 270*b* may include a chair seat 316*b*, 151*b*; a chair back 115*b*, 150*b*; a right-hand arm rest 190*b*; a center arm rest 192*b* and a left-hand arm rest 195*b*; a center debris cover 197*b*; a left-hand debris cover 198*b*; and a left-hand panel 199*b*. A beam may be supported by at least one horizontally extending standard 460*b* and/or at least one vertically extending standard 430*b*. Each arm rest 190*b*, 192*b*, 195*b* may include a cup holder 191*b*, 193*b*, 194*b*. Alternatively, or additionally, any given chair assembly 235*b*, 270*b* may include a pivotal work tray or desk, a side separator, end panels, folding tablet arms, drink tables, etc. An armrest 190*b*, 192*b*, 195*b*, a cup holder 191*b*, 193*b*, 194*b*, a pivotal work tray or desk, a side separator, folding tablet arms, drink tables and/or an end panels may be supported by a chair bracket, a beam or a standard via a bracket integral to a chair bracket, a bracket integral to a beam, a bracket integral to a standard or may be supported by an independent bracket and secured to a standard, a beam or a chair bracket.

Figure 1C:
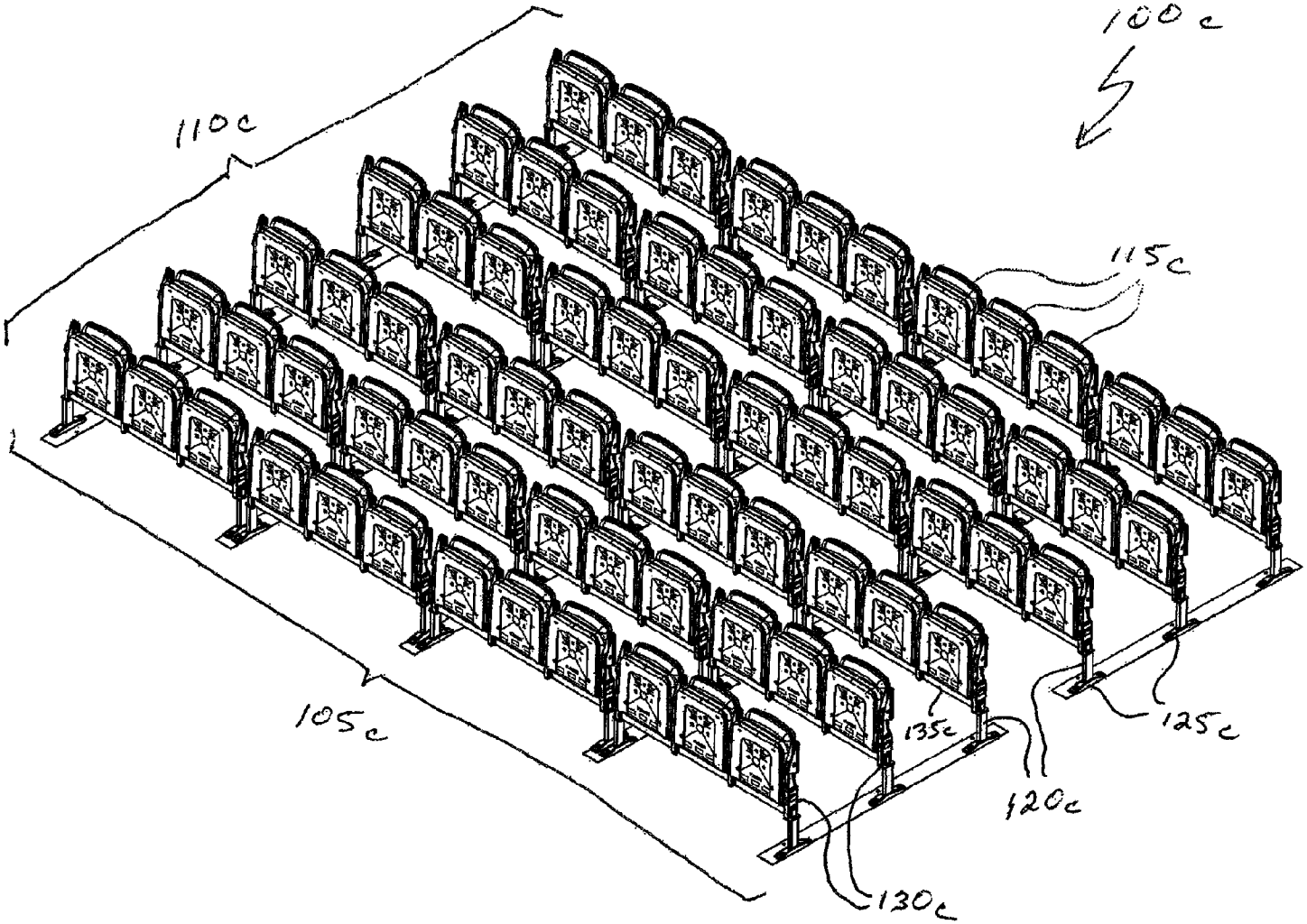
Figure 1A:
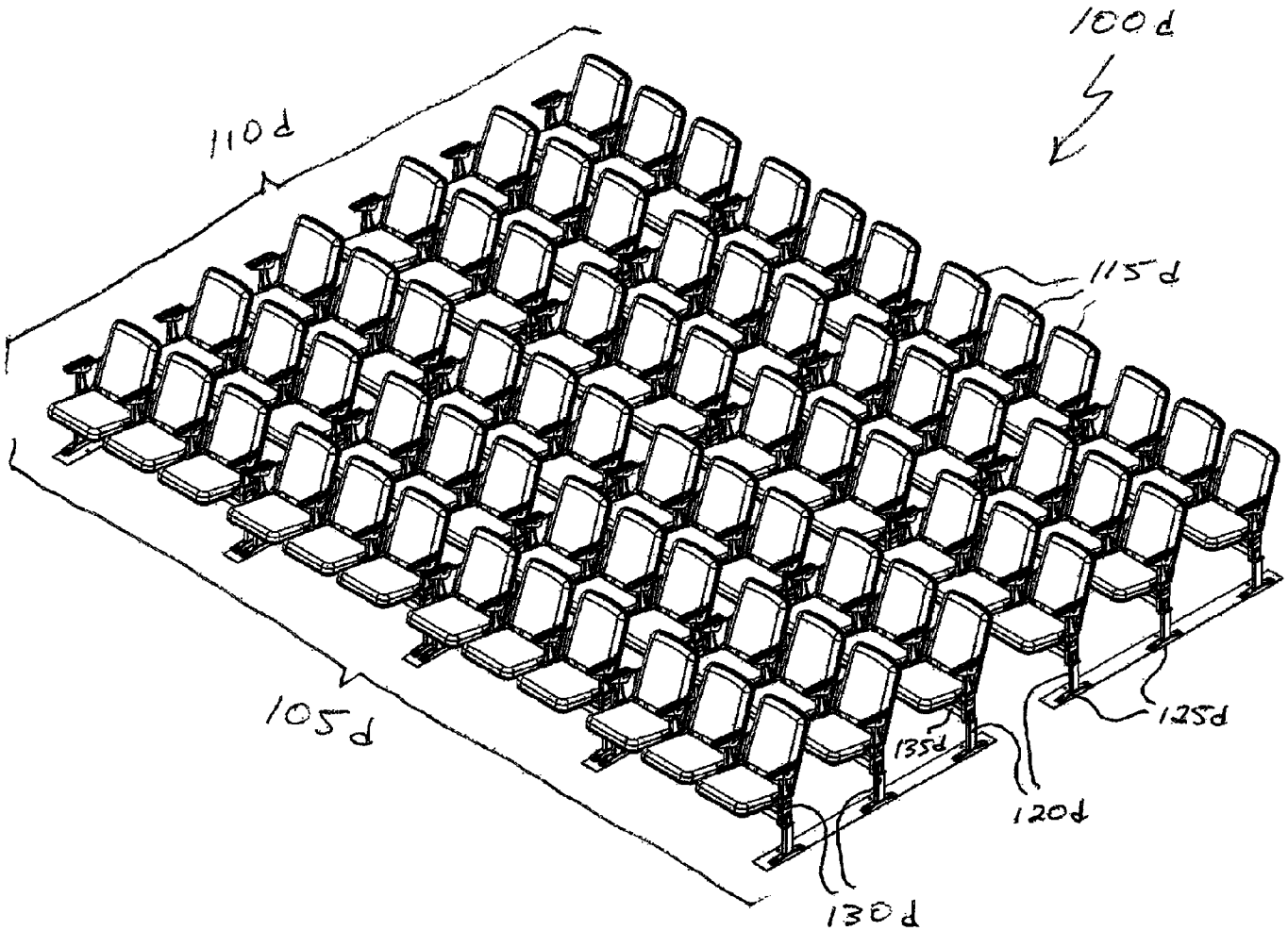

Turning to FIG. 1C, an installation 100*c* is depicted including a plurality of beam mounted chair assemblies 115*c* arranged in a plurality of rows 110*c* and columns 105*c*. Each of the beam mounted chair assemblies 115*c* may include at least one chair bracket 130*c* supported on a beam 135*c*. A beam 135*c* may be supported by at least one standard 120*c*. A standard 120*c* may be supported on a mounting foot 125*c*. With additional reference to FIG. 1D, chairs 115*d* are depicted with chair seats folded down, where the chairs 115*c* have chair seats folded up.

Figure 3A:
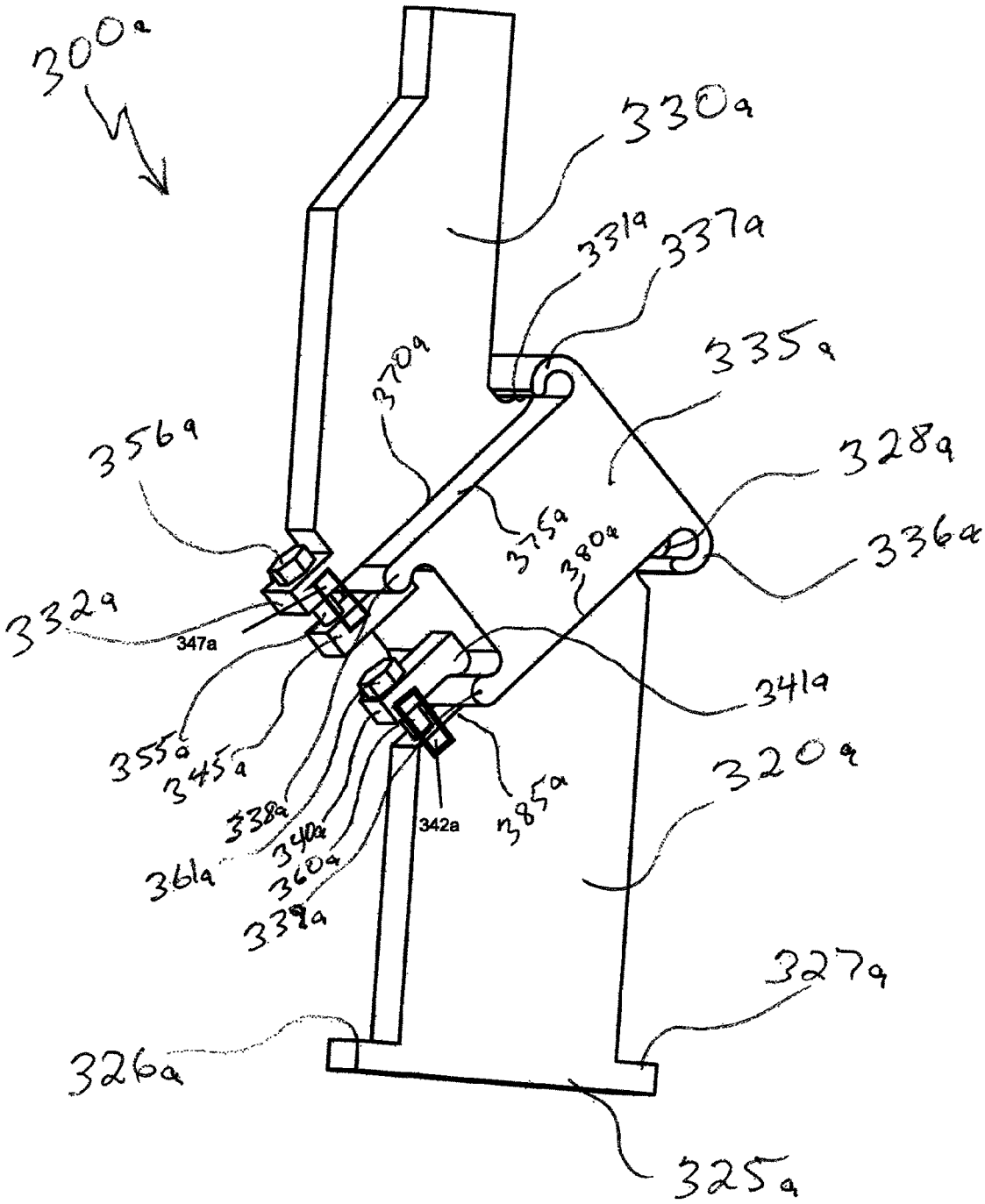
Figure 3B:
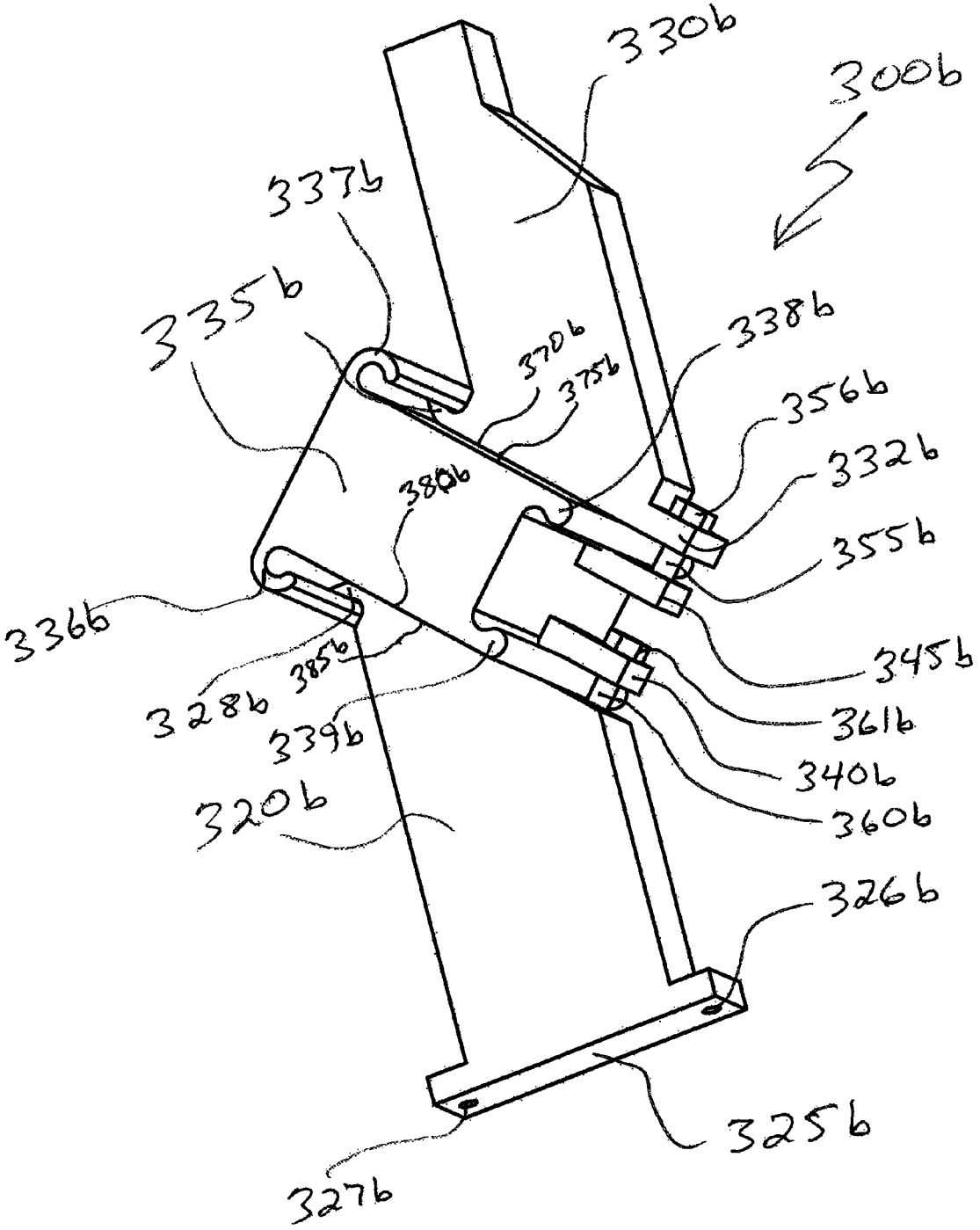
Figure 3C:
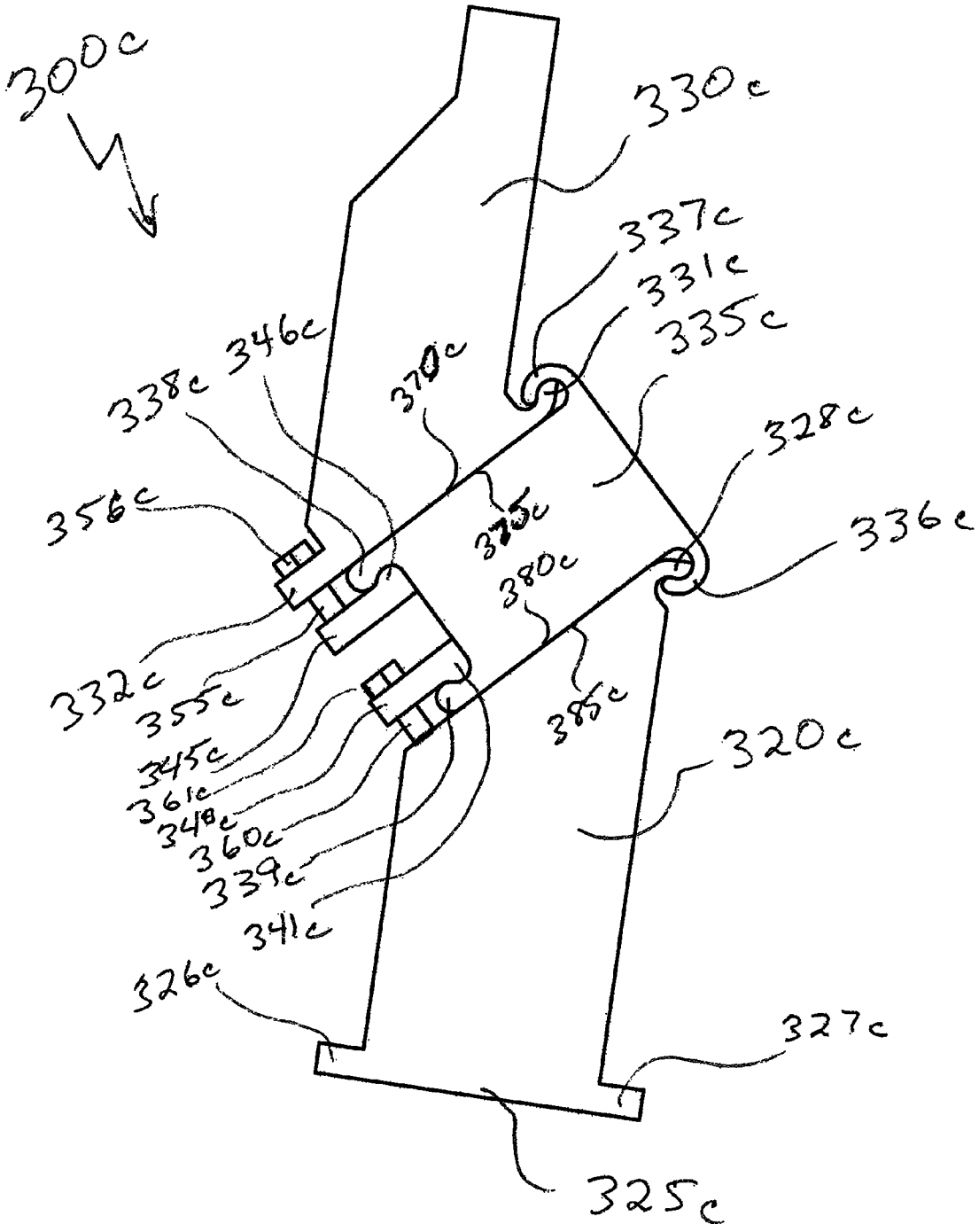
Figure 3D:
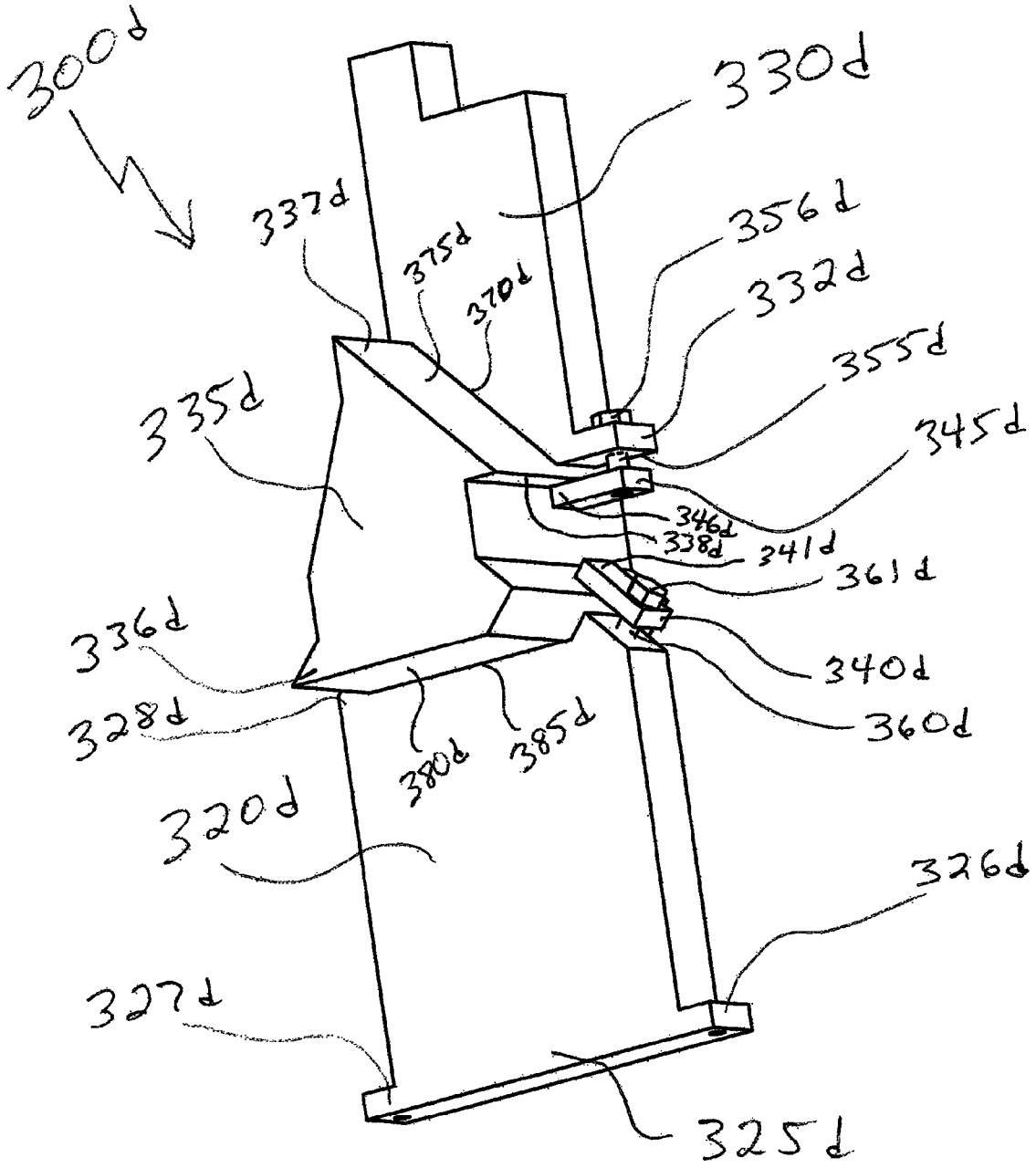
Figure 3E:
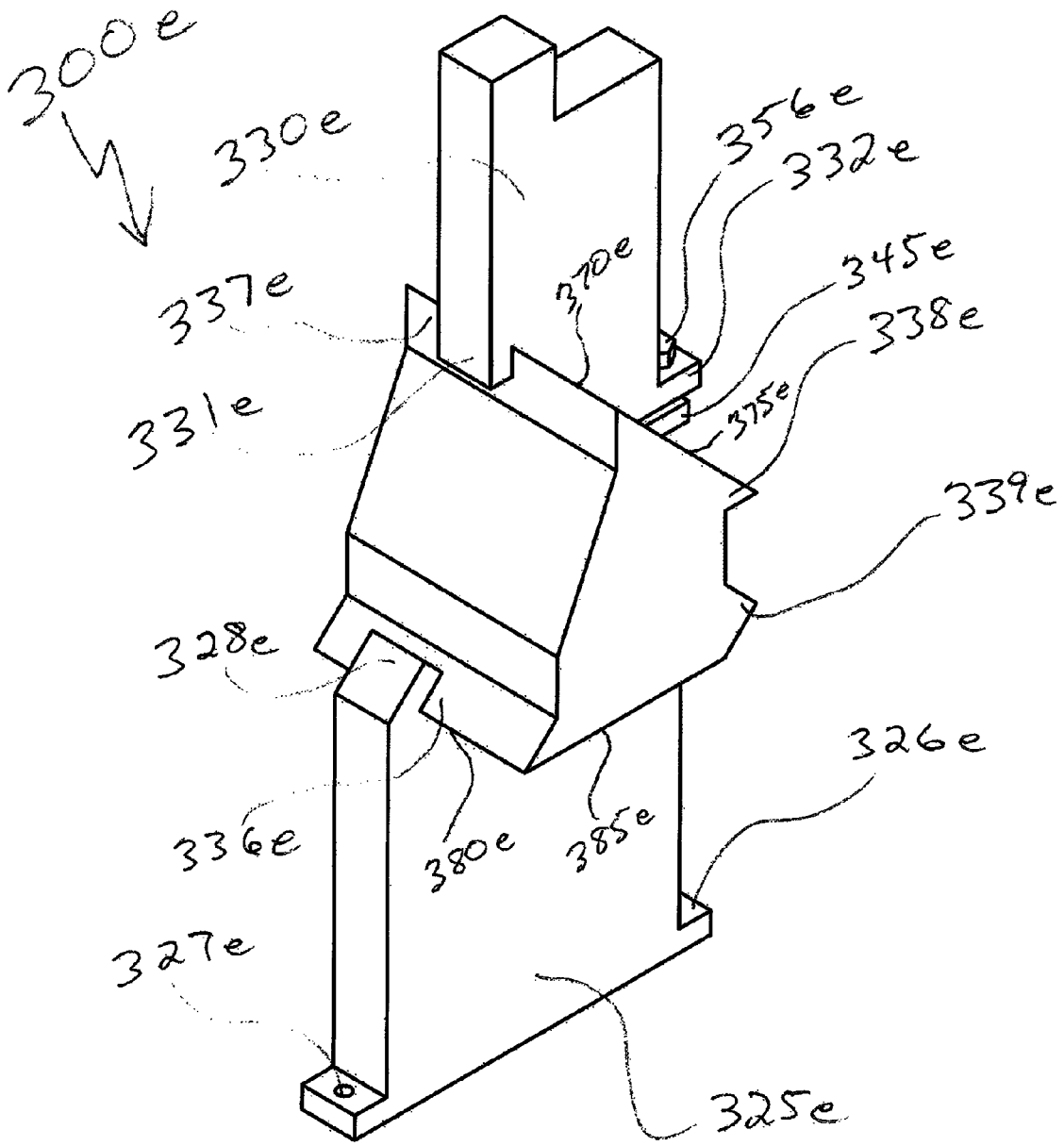
Figure 3F:
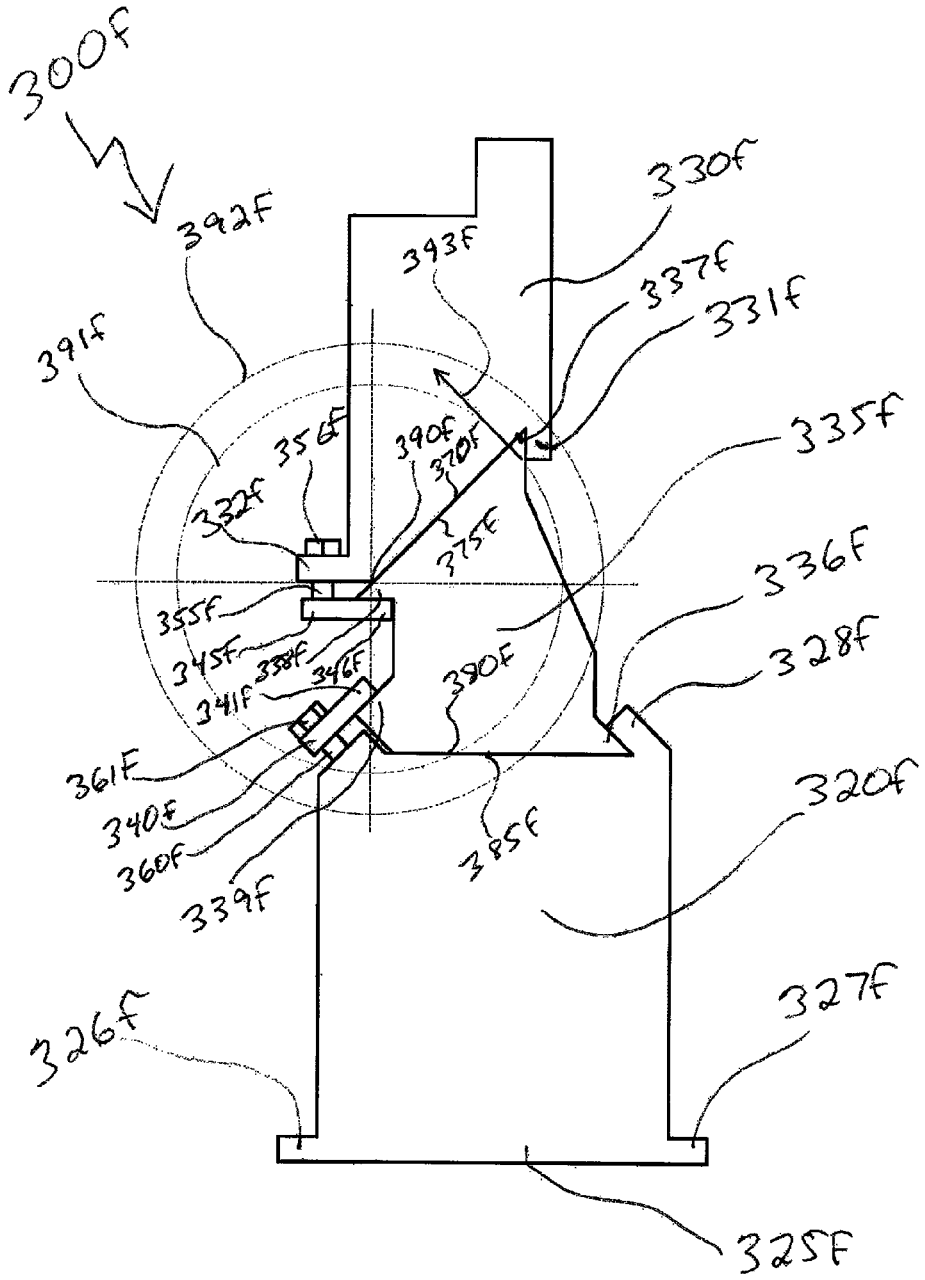
Figure 3G:
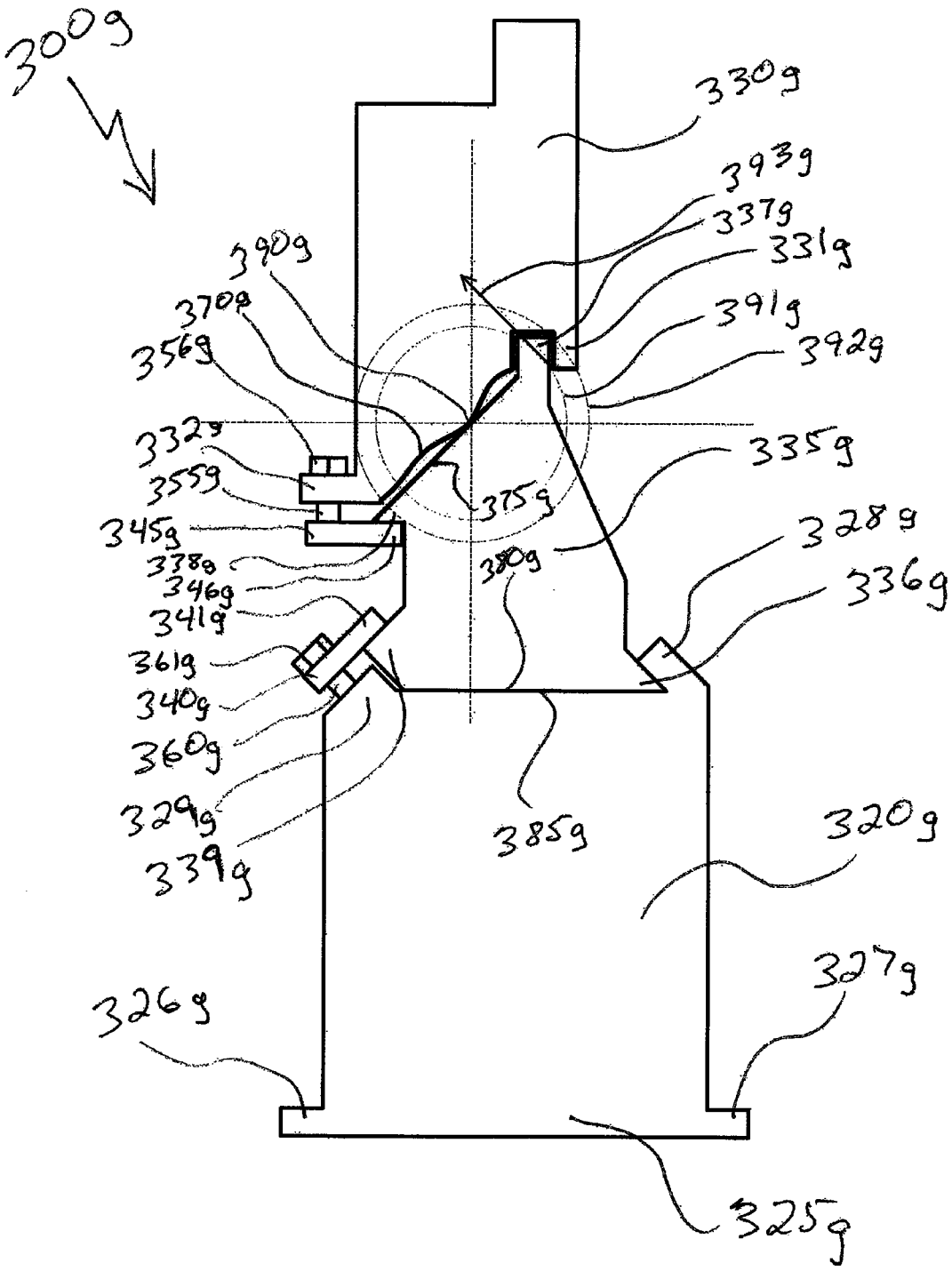
Figure 3H:
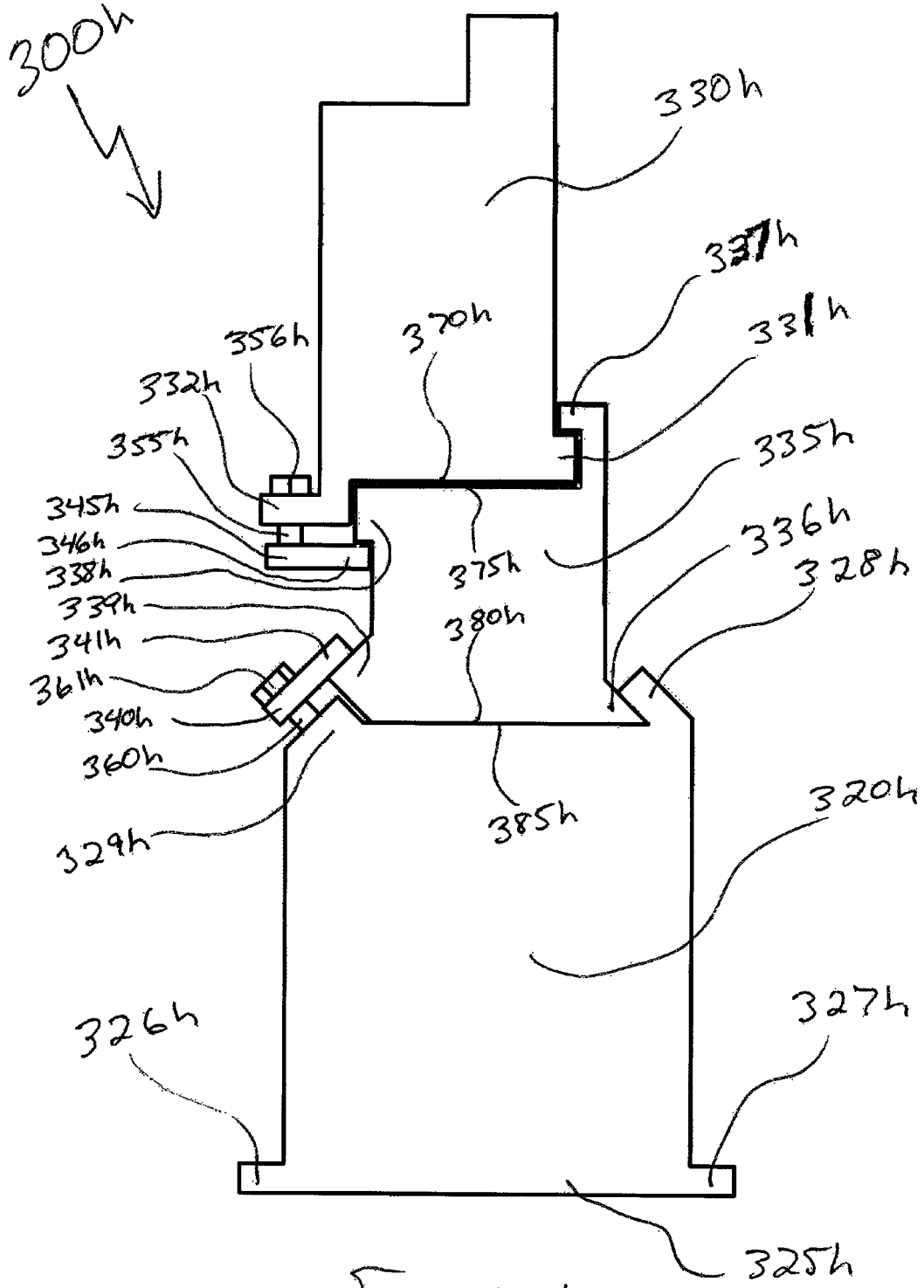
Figure 3J:
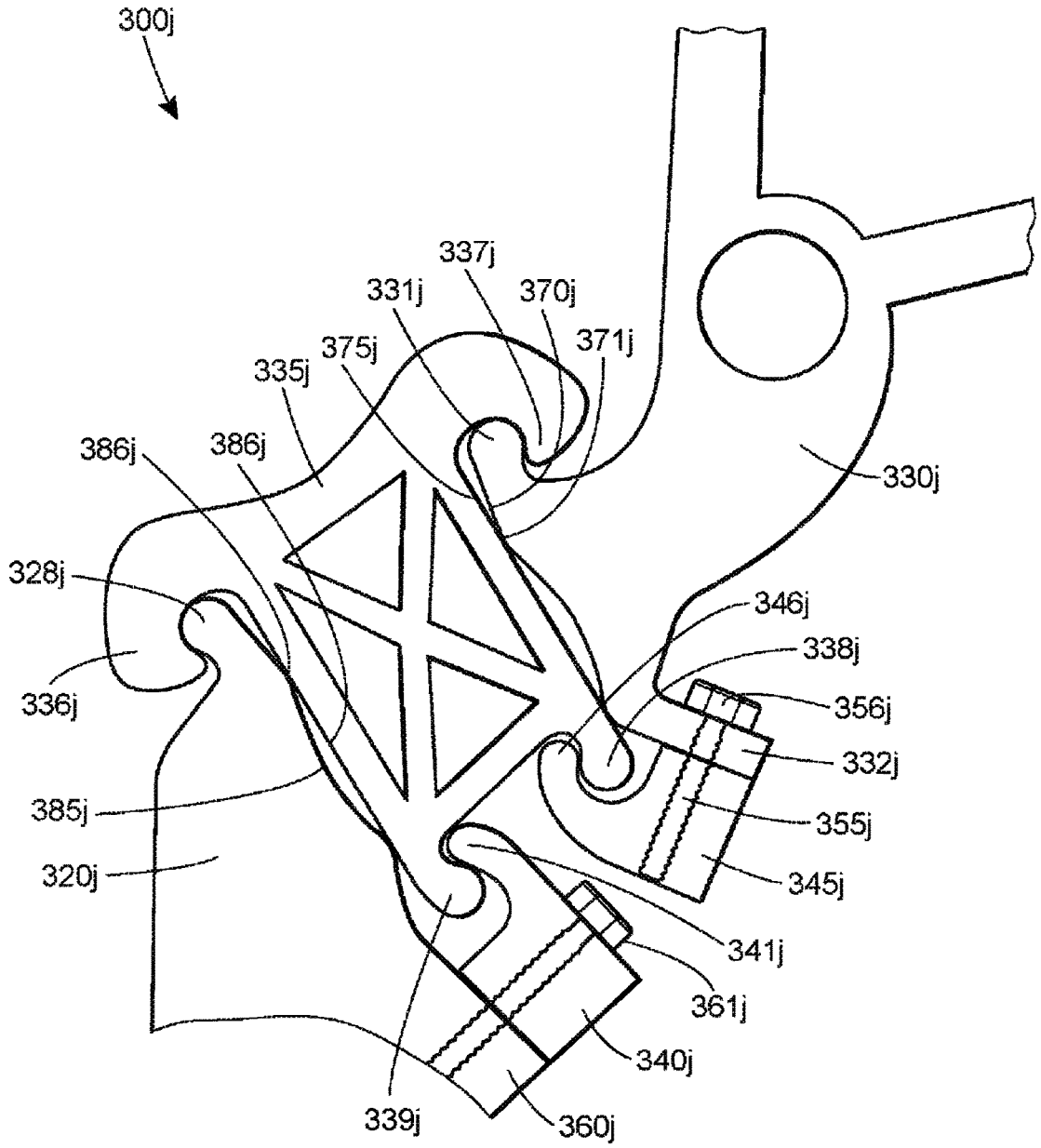
Figure 3K:
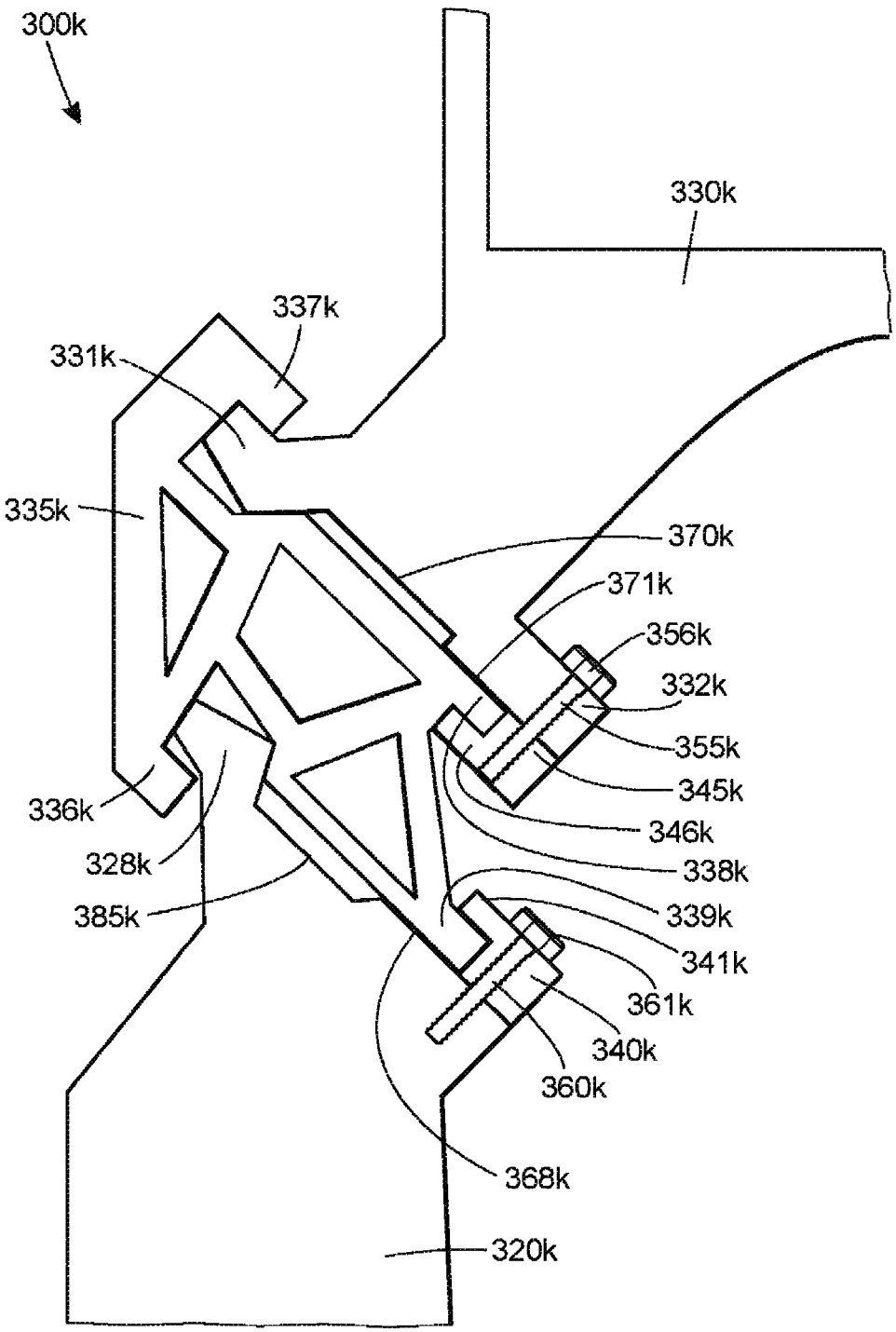
Figure 3L:
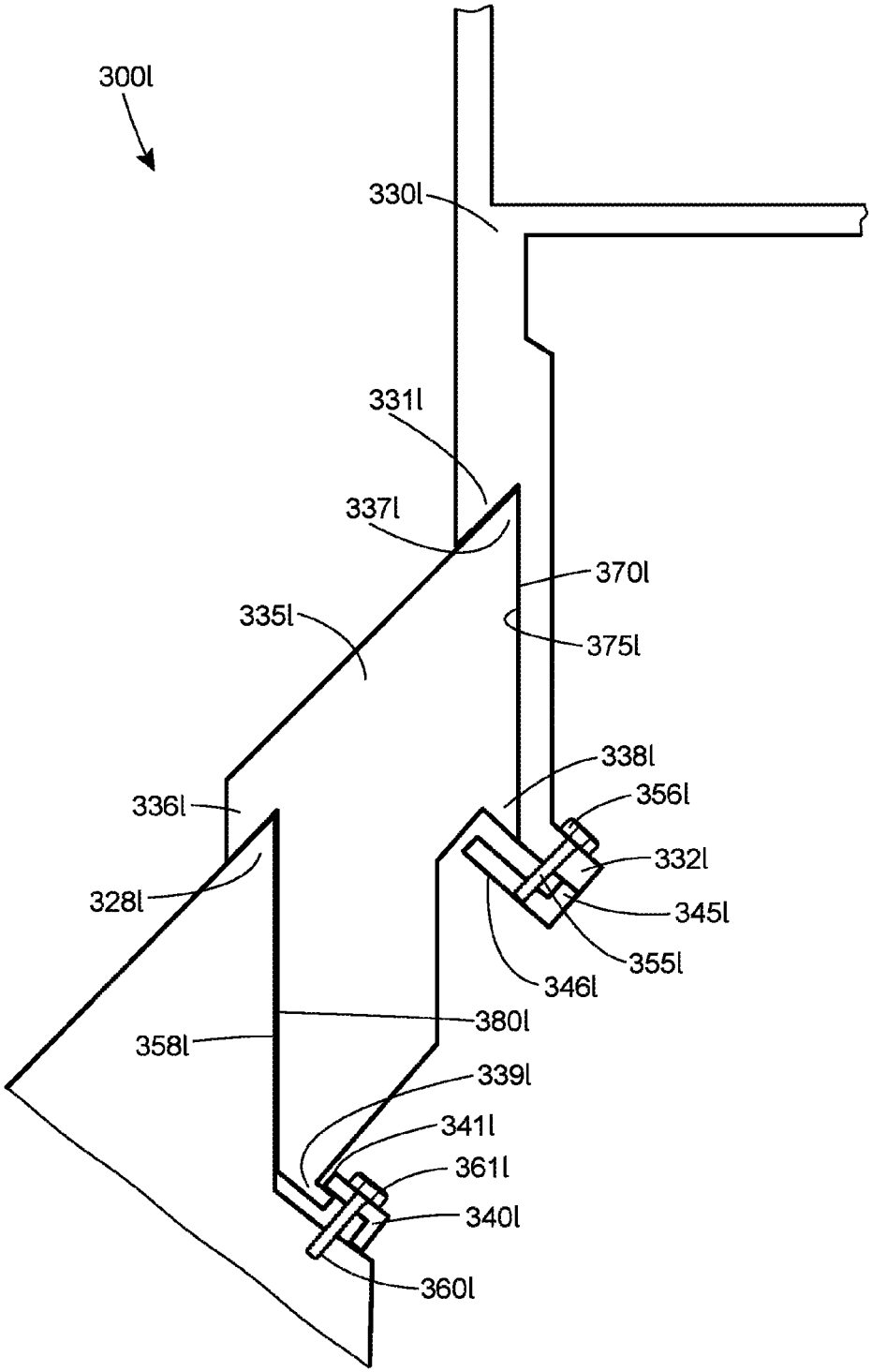
Figure 3M:
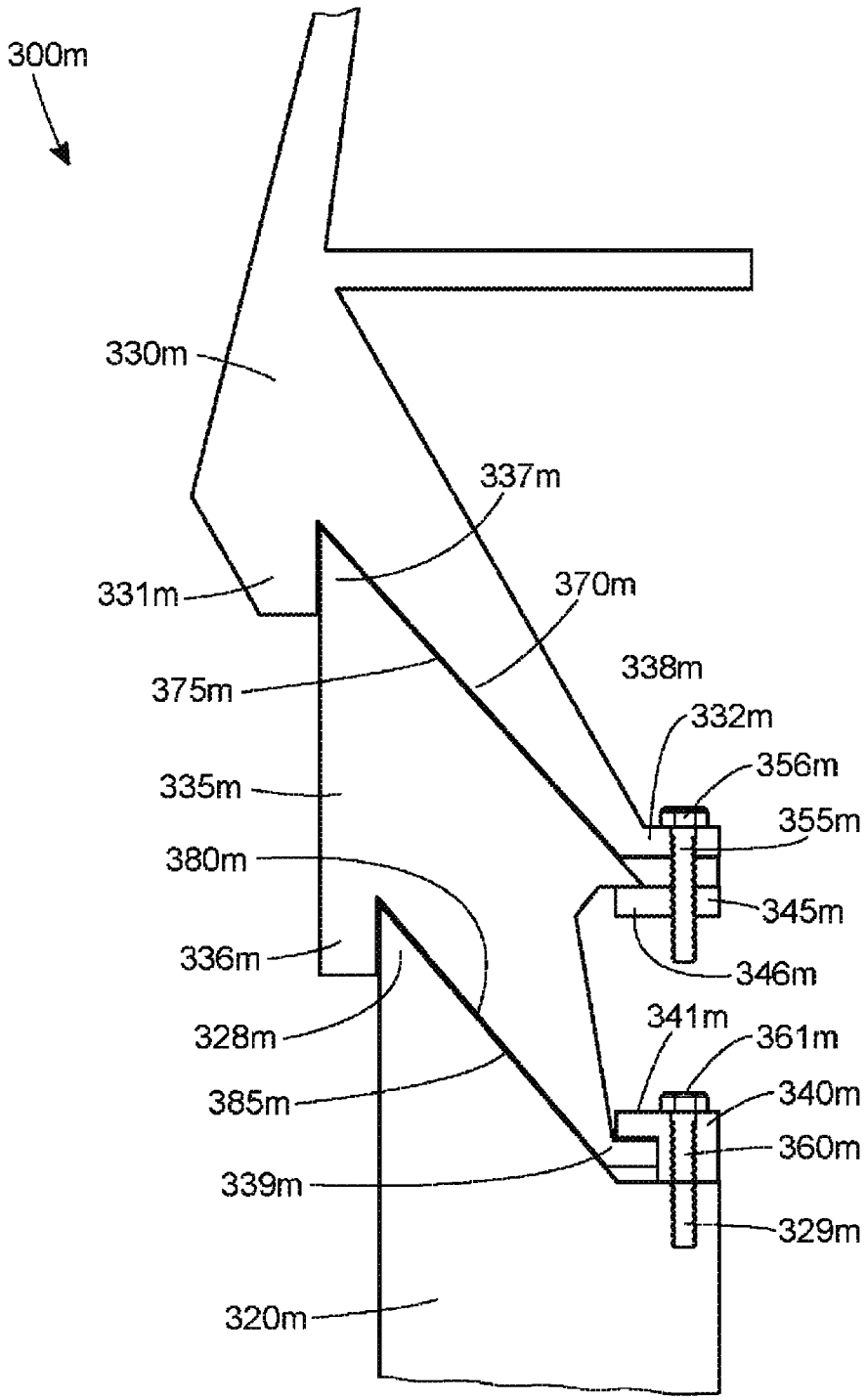
Figure 3N:
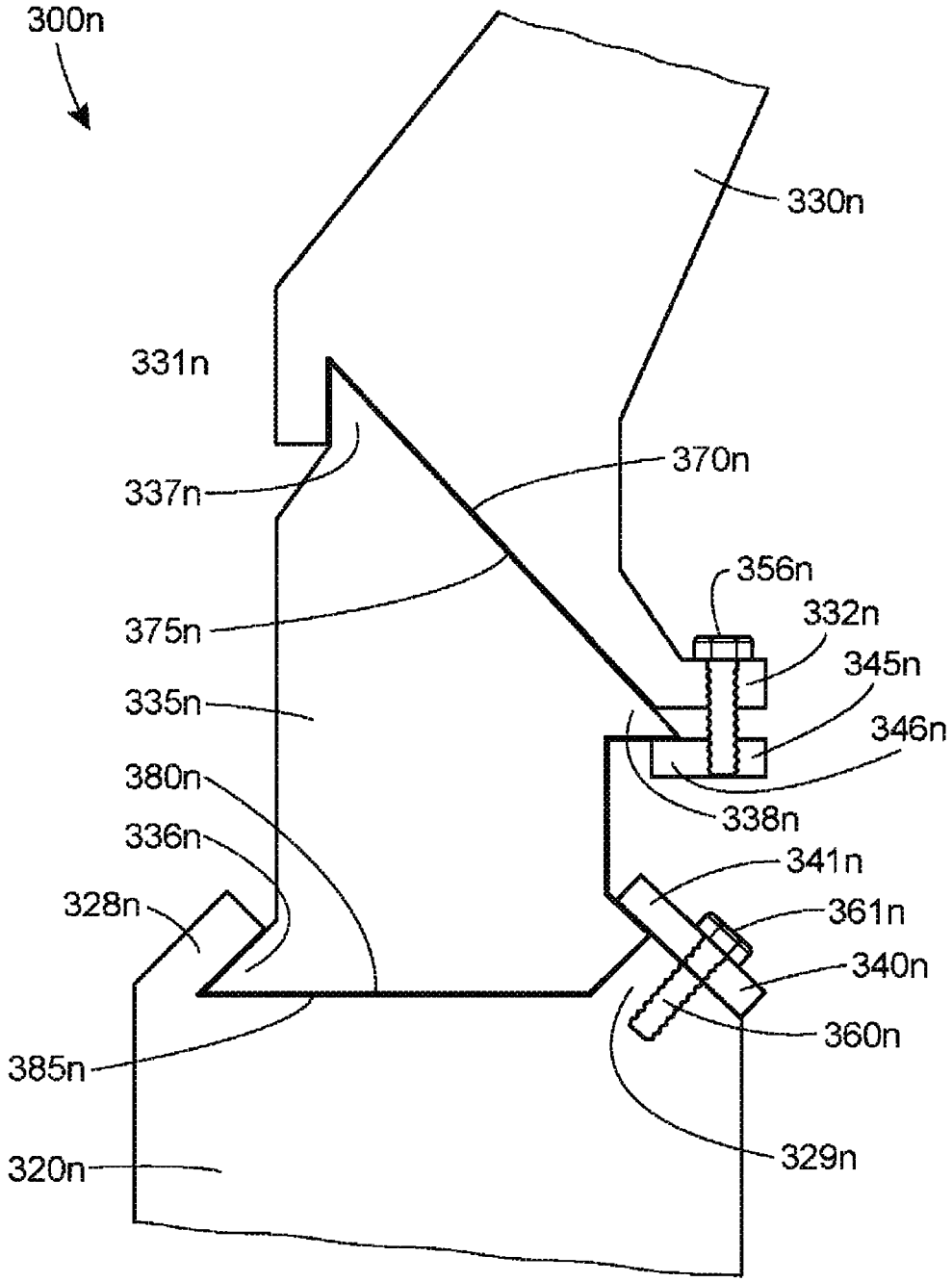
Figure 3P:
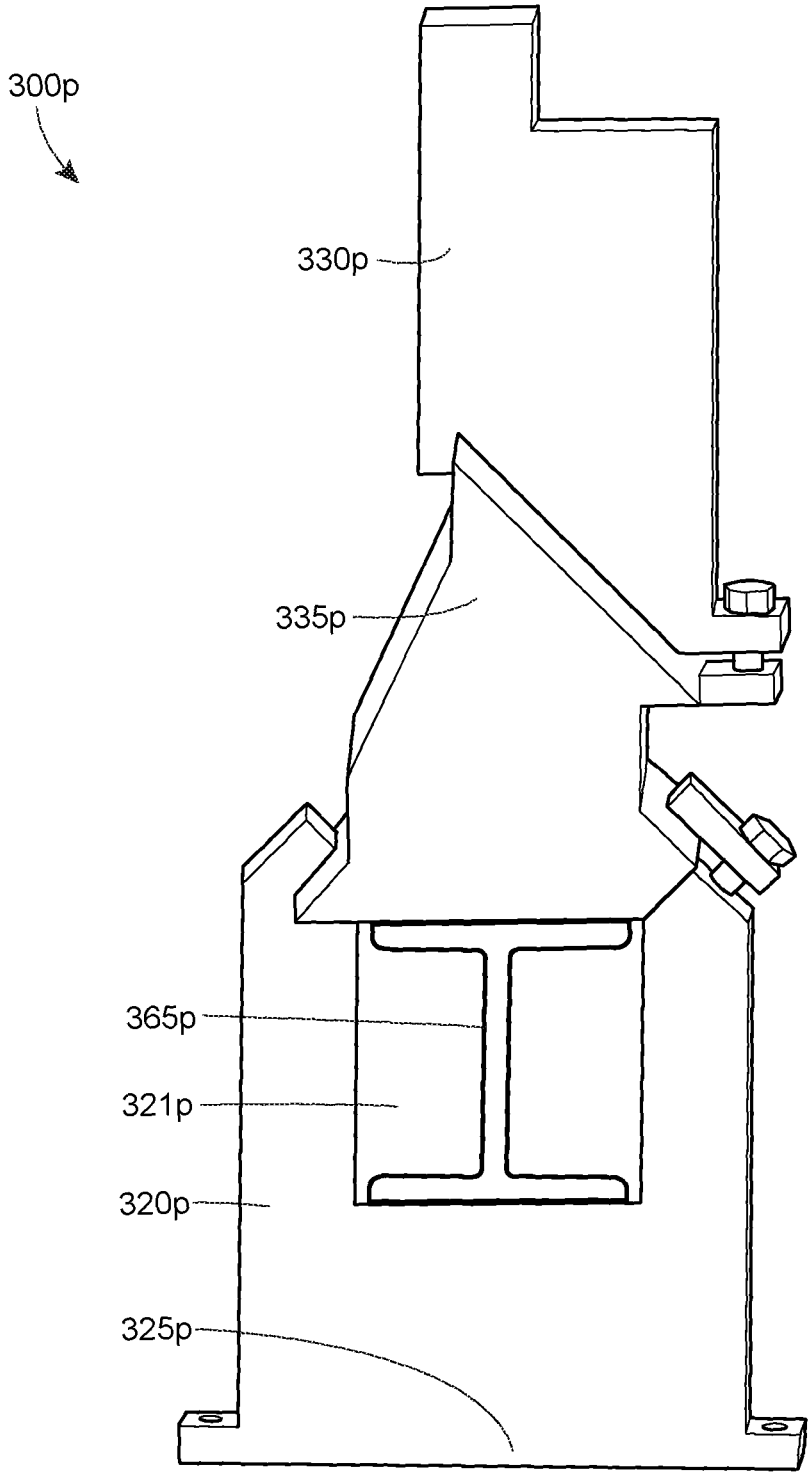
Figure 3Q:
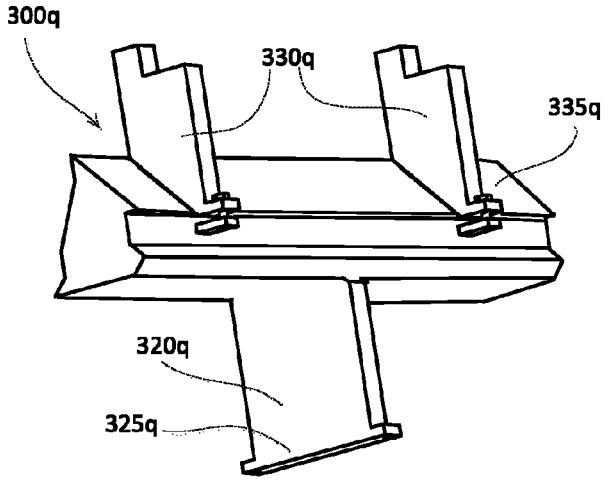

While FIGS. 1A-1C show a beam mounted to a flat floor, the chair assemblies of the present disclosure applies to all applications of beam mounted chairs including: riser mount chair assemblies, telescopic mounted chair assemblies, movable base mounted chair assemblies, pedestal base chair assemblies, as well as, pseudo-beam mounted where the beam is part of the adjacent structure (e.g., the assembly depicted in FIG. 3Q). The geometrical sizes and relationships of components are for illustration and are not intended to be restrictive in any way. For example, a width of mounting features may be increased to accommodate system loads and/or to prevent damage. Optionally, the geometry may be adjusted to allow and/or prevent elastic deformation of members, to enhance patron comfort, and/or to extend system life. This may include added features such as crush ribs, or contact features with properties that limits movement and/or accommodate system expansion due to environmental factors. This may also include features which allow a beam mounted chair to accommodate beam geometry such as beams of differing installation radii, beams of less than perfect co-linearity, etc. Such features may be between a beam and a standard and/or the beam and a chair assembly.

Figure 2A:
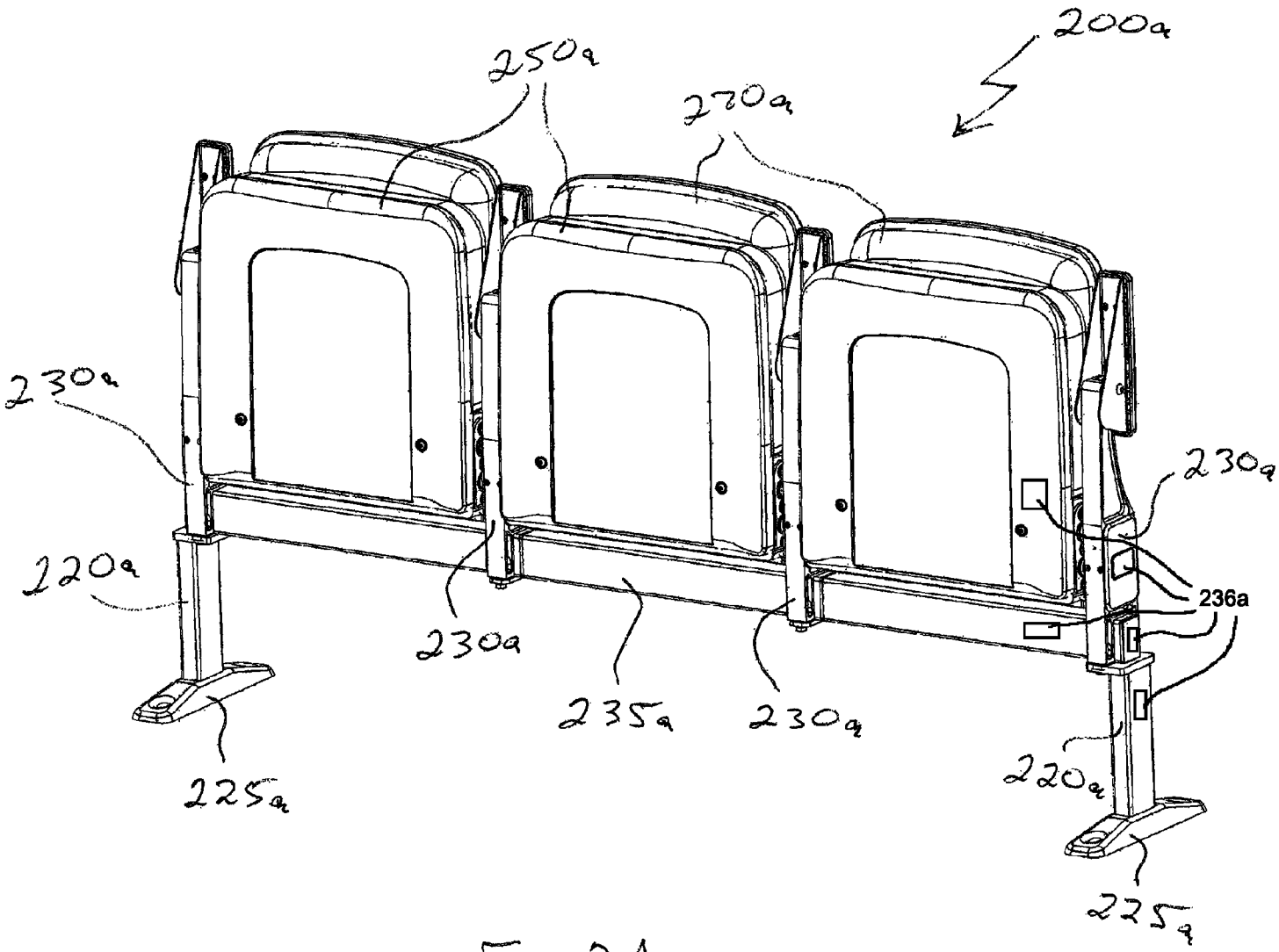
FIGS. 2A-2C depict various views of example beam mounted chair assemblies for use within the installations of FIGS. 1A-1D.

With reference to FIG. 2A, a beam mounted chair assembly 200*a* is depicted including chair seats 250*a* pivotally mounted to chair brackets 230*a* proximate corresponding chair backs 270*a*. The chair seats 250*a* and chair backs may be as described, for example, in commonly assigned patent application Ser. No. 61/856,013, entitled Telescopic Seating Systems, and Foldable Chairs and Related Components for use within Telescopic Seating Systems, filed Jul. 18, 2013; and Ser. No. 61/868,547, entitled Telescopic Seating Systems, and Foldable Chairs and Related Components for use within Telescopic Seating Systems, filed Aug. 21, 2013, the disclosures of which are all incorporated herein in their entireties by reference. The chair brackets 230*a* may be secured to a beam 235*a*. A beam 235*a* may be supported by a plurality of standards 220*a*. A standard 220*a* may be supported on a mounting foot 225*a*. The chair brackets 230*a*, standards 220*a* and mounting feet 225*a* may be as described, for example, in commonly assigned patent application Ser. No. 61/856,013, entitled Telescopic Seating Systems, and Foldable Chairs and Related Components for use within Telescopic Seating Systems, filed Jul. 18, 2013; Ser. No. 61/868,547, entitled Telescopic Seating Systems, and Foldable Chairs and Related Components for use within Telescopic Seating Systems, filed Aug. 21, 2013; Ser. No. 61/946,824, entitled Rocker Style Chairs, Modular Components for use within Rocker Style Chairs and Parts for use within the Modular Components, filed Mar. 2, 2014; and Ser. No. 62/006,363, entitled Reconfigurable Seating Systems, Seat Assemblies for use within the Reconfigurable Seating Systems, Components for use within the Seat Assemblies and Parts for use within the Components, filed Jun. 2, 2014, the disclosures of which are all incorporated herein in their entireties by reference.

As illustrated in FIG. 2A, a beam mounted chair assembly 200*a* may include at least one chair location label 236*a*. A chair location label 236*a* may include alpha-numeric indicia that identifies, for example, a row 105*a*-109*a*, a section 101*a*-103*a*, and/or a particular chair 150*a* location. The chair location label 236*a* may be located on a standard 220*a*, a mounting foot 225*a*, a chair bracket 230*a*, a beam 235*a*, and/or a chair seat 250*a*. While not shown in FIG. 2A, a chair location label 236*a* may be located on a chair arm 190*b*, a chair cup holder 191*b*, a chair back 270*a*, or any other location that is visible to an occupant upon approaching an associated chair. A chair location label 236*a* may be, for example, removably fixed in a desired position. Thereby, chairs may be renumbered when chairs are movable, for example, in reconfigurable chair systems as described in U.S. patent application Ser. No. 14/728,401. Alternatively, or additionally, fixed positions chairs may have a chair location label 236*a* glued or riveted in a particular, fixed, position. Folding chairs may have a chair location label 236*a*, for example, written in chalk on a chair seat 250*a*. Alternatively, a removable chair location label 236*a* (e.g., vinyl cling or vinyl decal) may be placed on a bottom of a chair seat 250*a*, and may an alpha-numeric chair location may be written on the chair location label 236*a*.

Static clings are made from a thin plastic film (e.g., vinyl) that may "cling" to different surfaces with, for example, static electricity. Static cling may cling to smooth surfaces, such as plastic and metal. A static cling may be printed with vibrant full-color, solid design and/or may have a glossy finish. Static clings may be free of adhesive, and can easily be removed, repositioned, and reused. A static cling chair location label 236*a* may be printed in any size, and any shape, for example, by die-cutting.

Vinyl decals chair location labels 236*a* may be heavy-duty stickers. The material may be a thin plastic film that sticks to a variety of surfaces, including glass, metal, wood and plastic. A vinyl film may be weatherproof and may include a gloss finish. Vinyl decal chair location labels 236*a* may be printed with an opaque, full-color design on one side and adhesive on the other.

In circumstances where a chair location label 236*a* is to be placed on a magnetic metal chair component (e.g., a mounting foot, a chair support, a beam, a chair bracket, a chair arm, a cup holder, a chair seat, a chair back, etc.), the chair location label 236*a* may be a magnet. Alternatively, in circumstances where a chair location label 236*a* is to be place on a non-magnetic chair component (e.g., an aluminum mounting foot, an aluminum chair support, an aluminum beam, an aluminum chair bracket, a plastic chair arm, a plastic cup holder, a wooden or plastic chair seat, a plastic or wooden chair back, etc.), a magnetic metal plate may be fixed to the chair component and a magnet chair location label 236*a* may be removably position on the magnetic metal plate. Alternatively, or additionally, either a chair location label 236*a* and/or an associated magnetic metal plate may be removably attached with a snap on holder.

Alternatively, or additionally, a chair location label 236*a* may be a reconfigurable display (e.g., a LCD display, a LED display, an eInk display, a plasma display, a CRT display, etc.). When the chair location label 236*a* is configured as a display, the chair location label 236*a* may be connected to power/data outlets 110*a* and related interconnections 111*a*, and may display additional information, such as advertisements, point of sale items (e.g., concessions, tickets, clothing, etc.). Optionally, a chair location label 236*a* may be displayed on a mobile telephone display, and the mobile telephone may be configured as described, for example, in U.S. Patent Application Ser. No. 62/175,210, which is incorporated in its entirety herein by reference.

Figure 2B:
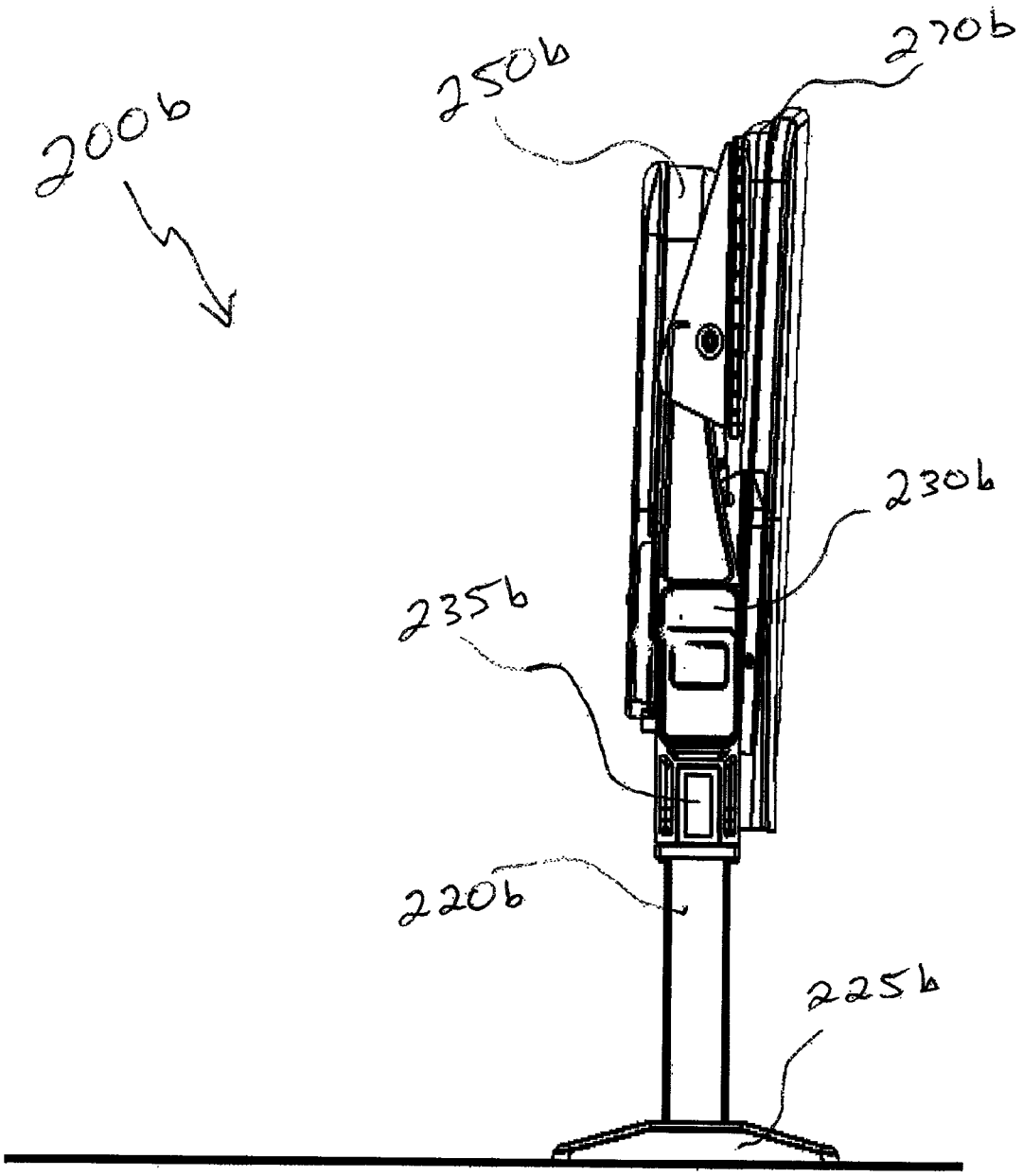

With reference to FIG. 2B, a beam mounted chair assembly 200*b* is depicted. The beam mounted chair assembly 200*b* may be similar to beam mounted chair assembly 200*a* of FIG. 1A. The beam mounted chair assembly 200*b* may include a chair seat 250*b* pivotally attached to a chair bracket 230*b* proximate a chair back 270*b*. The chair seat 250*b* is depicted in a folded up position. The chair bracket 230*b* may be supported by a beam 235*b*. The beam 235*b* may be supported by a standard 220*b*. The standard 220*b* may be supported by a mounting foot 225*b*.

Figure 2C:
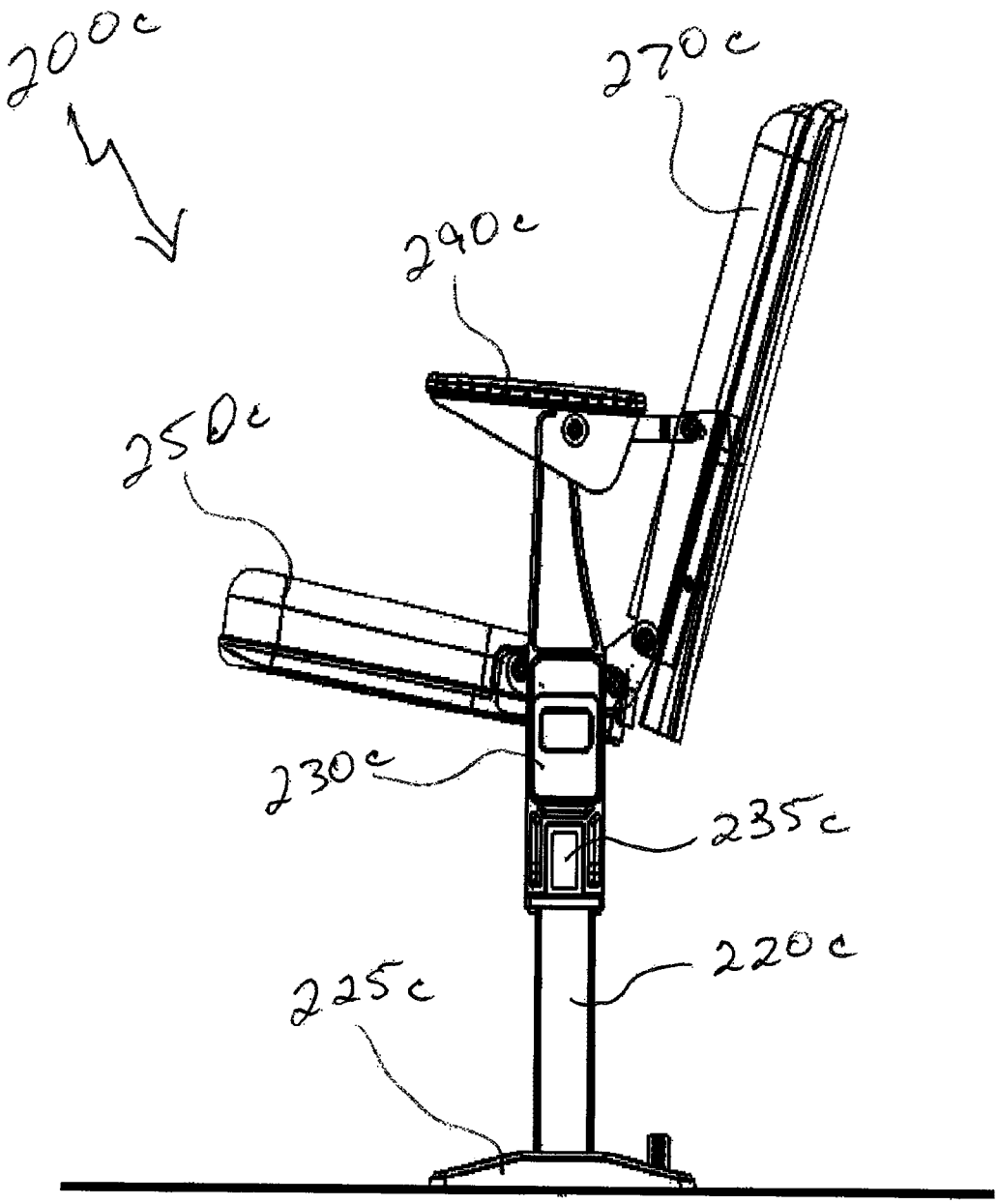

Turning to FIG. 2C, a beam mounted chair assembly 200*c* is depicted. The beam mounted chair assembly 200*c* may be similar to beam mounted chair assembly 200*a* of FIG. 1A. The beam mounted chair assembly 200*c* may include a chair seat 250*c* pivotally attached to a chair bracket 230*c* proximate a chair back 270*c*. The chair seat 250*c* is depicted in a folded down position. The chair bracket 230*c* may be supported by a beam 235*c*. The beam 235*c* may be supported by a standard 220*c*. The standard 220*c* may be supported by a mounting foot 225*c*.

With reference to FIG. 3A, a top, front, perspective view of a beam mounted chair assembly 300*a* is depicted including a chair bracket 330*a* supported on a beam 335*a*. The beam mounted chair assembly 300*a* may be incorporated with any of the installations 100*a*-100*d* of FIGS. 1A-1D. The beam 335*a* is supported on a standard 320*a*. The chair bracket 330*a* may include a front tab 332*a*, a rear tab 331*a* and a bottom interface surface 370*a*. The beam 335*a* may include a front top tab 338*a*, a front bottom tab 339*a*, a rear top hook 337*a*, a rear bottom hook 336*a*, a top interface surface 375*a* and a bottom interface surface 380*a*. The standard 320*a* may include a mounting foot 325*a* having a front foot 326*a* and a rear foot 327*a*, a rear tab 328*a* and a top interface surface 385*a*. The beam 335*a* may be secured to the standard 320*a* with the rear tab 328*a* received within the bottom rear hook 336*a* and the bottom front tab 339*a* between a tab 341*a* of a clamp 340*a* and the top interface surface 385*a* via a bolt 360*a* having a bolt head 361*a*. The chair bracket 330*a* may be secured to the beam 335*a* with the rear tab 331*a* received within the top rear hook 337*a* and the top front tab 338*a* between a tab 346*a* of a clamp 345*a* and the top interface surface 375*a* via a bolt 355*a* having a bolt head 356*a*. While the interfacing surfaces 370*a*, 375*a*, 380*a*, 385*a* are illustrated within FIG. 3A as being substantially flat, any one of the interfacing surfaces 370*a*, 375*a*, 380*a*, 385*a* may be non-flat as depicted in FIGS. 3G, 3J and 3K.

As reflected in FIG. 3A, features 342*a*, 347*a* may be included to align the clamps to facilitate installation with minimal effort. Similar features may be added to a standard and/or a beam and the beam to the chair. Respective alignment features 342*a*, 347*a* may be part of a clamp, a standard, a beam and/or a chair.

Turning to FIG. 3B, a bottom, front, perspective view of a beam mounted chair assembly 300*b* is depicted including a chair bracket 330*b* supported on a beam 335*b*. The beam mounted chair assembly 300*b* may be similar to the beam mounted chair assembly 300*a* The beam 335*b* is supported on a standard 320*a*. The chair bracket 330*b* may include a front tab 332*b*, a rear tab 331*b* and a bottom interface surface 370*b*. The beam 335*b* may include a front top tab 338*b*, a front bottom tab 339*b*, a rear top hook 337*b*, a rear bottom hook 336*b*, a top interface surface 375*b* and a bottom interface surface 380*b*. The standard 320*b* may include a mounting foot 325*b* having a front foot 326*b* and a rear foot 327*b*, a rear tab 328*b* and a top interface surface 385*b*. The beam 335*b* may be secured to the standard 320*b* with the rear tab 328*b* received within the bottom rear hook 336*b* and the bottom front tab 339*b* between a tab 341*b* of a clamp 340*b* and the top interface surface 385*b* via a bolt 360*b* having a bolt head 361*b*. The chair bracket 330*b* may be secured to the beam 335*b* with the rear tab 331*b* received within the top rear hook 337*b* and the top front tab 338*b* between a tab 346*b* of a clamp 345*b* and the top interface surface 375*b* via a bolt 355*b* having a bolt head 356*b*. While the interfacing surfaces 370*b*, 375*b*, 380*b*, 385*b* are illustrated within FIG. 3B as being substantially flat, any one of the interfacing surfaces 370*b*, 375*b*, 380*b*, 385*b* may be non-flat as depicted in FIGS. 3G, 3J and 3K.

With reference to FIG. 3C, a left-side profile view of a beam mounted chair assembly 300*c* is depicted including a chair bracket 330*c* supported on a beam 335*c*. The beam mounted chair assembly 300*c* may be similar to the beam mounted chair assembly 300*a*. The beam 335*c* is supported on a standard 320*c*. The chair bracket 330*c* may include a front tab 332*c*, a rear tab 331*c* and a bottom interface surface 370*c*. The beam 335*c* may include a front top tab 338*c*, a front bottom tab 339*c*, a rear top hook 337*c*, a rear bottom hook 336*c*, a top interface surface 375*c* and a bottom interface surface 380*c*. The standard 320*c* may include a mounting foot 325*c* having a front foot 326*c* and a rear foot 327*c*, a rear tab 328*c* and a top interface surface 385*c*. The beam 335*c* may be secured to the standard 320*c* with the rear tab 328*c* received within the bottom rear hook 336*c* and the bottom front tab 339*c* between a tab 341*c* of a clamp 340*c* and the top interface surface 385*c* via a bolt 360*c* having a bolt head 361*c*. The chair bracket 330*c* may be secured to the beam 335*c* with the rear tab 331*c* received within the top rear hook 337*c* and the top front tab 338*c* between a tab 346*c* of a clamp 345*c* and the top interface surface 375*c* via a bolt 355*c* having a bolt head 356*c*. While the interfacing surfaces 370*c*, 375*c*, 380*c*, 385*c* are illustrated within FIG. 3C as being substantially flat, any one of the interfacing surfaces 370*c*, 375*c*, 380*c*, 385*c* may be non-flat as depicted in FIGS. 3G, 3J and 3K.

Turning to FIG. 3D, a front, bottom, perspective view of a beam mounted chair assembly 300*d* is depicted including a chair bracket 330*d* supported on a beam 335*d*. The beam mounted chair assembly 300*d* may be incorporated within any of the installations 100*a*-100*d* of FIGS. 1A-1D. The beam 335*d* may be supported on a standard 320*d*. The chair bracket 330*d* may include a front tab 332*d*, a rear hook 331*d* and a bottom interface surface 370*d*. The beam 335*d* may include a front top tab 338*d*, a front bottom tab 339*d*, a rear top tab 337*d*, a rear bottom tab 336*d*, a top interface surface 375*d* and a bottom interface surface 380*d*. The standard 320*d* may include a mounting foot 325*d* having a front foot 326*d* and a rear foot 327*d*, a rear hook 328*d* and a top interface surface 385*d*. The beam 335*d* may be secured to the standard 320*d* with the rear hook 328*d* receiving the bottom rear tab 336*d* and the bottom front tab 339*d* between a tab 341*d* of a clamp 340*d* and the top interface surface 385*d* via a bolt 360*d* having a bolt head 361*d*. The chair bracket 330*d* may be secured to the beam 335*d* with the rear hook 331*d* receiving the top rear tab 337*d* and the top front tab 338*d* between a tab 346*d* of a clamp 345*d* and the top interface surface 375*d* via a bolt 355*d* having a bolt head 356*d*. While the interfacing surfaces 370*d*, 375*d*, 380*d*, 385*d* are illustrated within FIG. 3D as being substantially flat, any one of the interfacing surfaces 370*d*, 375*d*, 380*d*, 385*d* may be non-flat as depicted in FIGS. 3G, 3J and 3K.

With reference to FIG. 3E, a back, top, perspective view of a beam mounted chair assembly 300*e* is depicted including a chair bracket 330*e* supported on a beam 335*e*. The beam mounted chair assembly 300*e* may be similar to the beam mounted chair assembly 300*d*. The beam 335*e* may be supported on a standard 320*e*. The chair bracket 330*e* may include a front tab 332*e*, a rear hook 331*e* and a bottom interface surface 370*e*. The beam 335*e* may include a front top tab 338*e*, a front bottom tab 339*e*, a rear top tab 337*e*, a rear bottom tab 336*e*, a top interface surface 375*e* and a bottom interface surface 380*e*. The standard 320*e* may include a mounting foot 325*e* having a front foot 326*e* and a rear foot 327*e*, a rear hook 328*e* and a top interface surface 385*e*. The beam 335*e* may be secured to the standard 320*e* with the rear hook 328*e* receiving the bottom rear tab 336*e* and the bottom front tab 339*e* between a tab 341*e* of a clamp 340*e* and the top interface surface 385*e* via a bolt 360*e* having a bolt head 361*e*. The chair bracket 330*e* may be secured to the beam 335*e* with the rear hook 331*e* receiving the top rear tab 337*e* and the top front tab 338*e* between a tab 346*e* of a clamp 345*e* and the top interface surface 375*d* via a bolt 355*e* having a bolt head 356*e*. While the interfacing surfaces 370*e*, 375*e*, 380*e*, 385*e* are illustrated within FIG. 3E as being substantially flat, any one of the interfacing surfaces 370*e*, 375*e*, 380*e*, 385*e* may be non-flat as depicted in FIGS. 3G, 3J and 3K.

Turning to FIG. 3F, a left-side profile view of a beam mounted chair assembly 300*f* is depicted including a chair bracket 330*f* supported on a beam 335*f*. The beam mounted chair assembly 300*f* may be similar to the beam mounted chair assembly 300*d*. The beam 335*f* may be supported on a standard 320*f*. The chair bracket 330*f* may include a front tab 332*f*, a rear hook 331*f* and a bottom interface surface 370*f*. The beam 335*f* may include a front top tab 338*f*, a front bottom tab 339*f*, a rear top tab 337*f*, a rear bottom tab 336*f*, a top interface surface 375*f* and a bottom interface surface 380*f*. The standard 320*f* may include a mounting foot 325*f* having a front foot 326*f* and a rear foot 327*f*, a rear hook 328*f* and a top interface surface 385*f*. The beam 335*f* may be secured to the standard 320*f* with the rear hook 328*f* receiving the bottom rear tab 336*f* and the bottom front tab 339*f* between a tab 341*f* of a clamp 340*f* and the top interface surface 385*f* via a bolt 360*f* having a bolt head 361*f*. The chair bracket 330*f* may be secured to the beam 335*f* with the rear hook 331*f* receiving the top rear tab 337*f* and the top front tab 338*f* between a tab 346*f* of a clamp 345*f* and the top interface surface 375*f* via a bolt 355*f* having a bolt head 356*f*. While the interfacing surfaces 370*f*, 375*f*, 380*f*, 385*f* are illustrated within FIG. 3F as being substantially flat, any one of the interfacing surfaces 370*f*, 375*f*, 380*f*, 385*f* may be non-flat as depicted in FIGS. 3G, 3J and 3K. Because the interfacing surfaces 370*f*, 375*f* are substantially flat, a pivot point 390*f* is defined wherein a point 393*f* would rotate about a circle 391*f* if not for the restraint of the rear hook 331*f* by the top rear tab 337*f*. The circle 392*f* may define a top rear hook shear surface.

With reference to FIG. 3G, a left-side profile view of a beam mounted chair assembly 300*g* is depicted including a chair bracket 330*g* supported on a beam 335*g*. The beam mounted chair assembly 300*g* may be similar to the beam mounted chair assembly 300*d*. The beam 335*g* may be supported on a standard 320*g*. The chair bracket 330*g* may include a front tab 332*g*, a rear hook 331*g* and a bottom interface surface 370*g*. The beam 335*g* may include a front top tab 338*g*, a front bottom tab 339*g*, a rear top tab 337*g*, a rear bottom tab 336*g*, a top interface surface 375*g* and a bottom interface surface 380*g*. The standard 320*g* may include a mounting foot 325*g* having a front foot 326*g* and a rear foot 327*g*, a rear hook 328*g* and a top interface surface 385*g*. The beam 335*g* may be secured to the standard 320*g* with the rear hook 328*g* receiving the bottom rear tab 336*g* and the bottom front tab 339*g* between a tab 341*g* of a clamp 340*g* and the top interface surface 385*g* via a bolt 360*g* having a bolt head 361*g*. The chair bracket 330*g* may be secured to the beam 335*g* with the rear hook 331*g* receiving the top rear tab 337*g* and the top front tab 338*g* between a tab 346*g* of a clamp 345*g* and the top interface surface 375*g* via a bolt 355*g* having a bolt head 356*g*. While the interfacing surfaces 375*g*, 380*g*, 385*g* are illustrated within FIG. 3G as being substantially flat, any one of the interfacing surfaces 375*g*, 380*g*, 385*g* may be non-flat as depicted in FIGS. 3J and 3K. Because the interfacing surface 370*f* includes the protrusion at point 390*g* and because the interface surface 375*g* is substantially flat, a pivot point 390*g* is defined wherein a point 393*g* would rotate about a circle 391*g* if not for the restraint of the rear hook 331*g* by the top rear tab 337*g*. The circle 392*g* may define a top rear hook shear surface.

Turning to FIG. 3H, a left-side profile view of a beam mounted chair assembly 300*h* is depicted including a chair bracket 330*h* supported on a beam 335*h*. The beam mounted chair assembly 300*h* may be incorporated within any of the installations 100*a*-100*d* of FIGS. 1A-1D. The beam 335*h* may be supported on a standard 320*h*. The chair bracket 330*h* may include a front tab 332*h*, a rear tab 331*h* and a bottom interface surface 370*h*. The beam 335*h* may include a front top tab 338*h*, a front bottom tab 339*h*, a rear top hook 337*h*, a rear bottom tab 336*h*, a top interface surface 375*h* and a bottom interface surface 380*h*. The standard 320*h* may include a mounting foot 325*h* having a front foot 326*h* and a rear foot 327*h*, a rear hook 328*h* and a top interface surface 385*h*. The beam 335*h* may be secured to the standard 320*h* with the rear hook 328*h* receiving the bottom rear tab 336*h* and the bottom front tab 339*h* between a tab 341*h* of a clamp 340*h* and the top interface surface 385*h* via a bolt 360*h* having a bolt head 361*h*. The chair bracket 330*h* may be secured to the beam 335*h* with the rear tab 331*h* received within the top rear hook 337*h* and the top front tab 338*h* between a tab 346*h* of a clamp 345*h* and the top interface surface 375*h* via a bolt 355*h* having a bolt head 356*h*. While the interfacing surfaces 370*h*, 375*h*, 380*h*, 385*h* are illustrated within FIG. 3H as being substantially flat, any one of the interfacing surfaces 370*h*, 375*h*, 380*h*, 385*h* may be non-flat as depicted in FIGS. 3G, 3J and 3K.

With reference to FIG. 3J, a right-side profile view of a beam mounted chair assembly 300*j* is depicted including a chair bracket 330*j* supported on a beam 335*j*. The beam mounted chair assembly 300*j* may be incorporated within any of the installations 100*a*-100*d* of FIGS. 1A-1D. The beam 335*j* is supported on a standard 320*j*. The chair bracket 330*j* may include a front tab 332*j*, a rear tab 331*j* and a bottom interface surface 370*j*. The beam 335*j* may include a front top tab 338*j*, a front bottom tab 339*j*, a rear top hook 337*j*, a rear bottom hook 336*j*, a top interface surface 375*j* and a bottom interface surface 380*j*. The standard 320*j* may include a rear tab 328*j* and a top interface surface 385*j*. The beam 335*j* may be secured to the standard 320*j* with the rear tab 328*j* received within the bottom rear hook 336*j* and the bottom front tab 339*j* between a tab 341*j* of a clamp 340*j* and the top interface surface 385*j* via a bolt 360*j* having a bolt head 361*j*. The chair bracket 330*j* may be secured to the beam 335*j* with the rear tab 331*j* received within the top rear hook 337*j* and the top front tab 338*j* between a tab 346*j* of a clamp 345*j* and the top interface surface 375*j* via a bolt 355*j* having a bolt head 356*j*. The slightly curved interface surface 370*j* with protrusion 371*j* and 385*j* with protrusion 386*j* may induce a stable interface between the chair bracket 330*j* and the beam 335*j*, and between the beam 335*j* and the standard 320*j*, respectively, when the associated clamps 345*j* and 340*j* are tightened.

Turning to FIG. 3K, a right-side profile view of a beam mounted chair assembly 300*k* is depicted including a chair bracket 330*k* supported on a beam 335*k*. The beam mounted chair assembly 300*k* may be incorporated within any of the installations 100*a*-100*d* of FIGS. 1A-1D. The beam 335*k* is supported on a standard 320*k*. The chair bracket 330*k* may include a front tab 332*k*, a rear tab 331*k* and a bottom interface surface 370*k*. The beam 335*k* may include a front top tab 338*k*, a front bottom tab 339*k*, a rear top hook 337*k*, a rear bottom hook 336*k*, a top interface surface 375*k* and a bottom interface surface 380*k*. The standard 320*k* may include a rear tab 328*k* and a top interface surface 385*k*. The beam 335*k* may be secured to the standard 320*k* with the rear tab 328*k* received within the bottom rear hook 336*k* and the bottom front tab 339*k* between a tab 341*k* of a clamp 340*k* and the top interface surface 385*k* via a bolt 360*k* having a bolt head 361*k*. The chair bracket 330*k* may be secured to the beam 335*k* with the rear tab 331*k* received within the top rear hook 337*k* and the top front tab 338*k* between a tab 346*k* of a clamp 345*k* and the top interface surface 375*k* via a bolt 355*k* having a bolt head 356*k*. The slightly curved interface surface 370*k* with protrusion 371*k* and 385*k* with protrusion 386*k* may induce a stable interface between the chair bracket 330*k* and the beam 335*k*, and between the beam 335*k* and the standard 320*k*, respectively, when the associated clamps 345*k* and 340*k* are tightened.

With reference to FIG. 3L, a right-side profile view of a beam mounted chair assembly 300*l* is depicted including a chair bracket 330*l* supported on a beam 335*l*. The beam mounted chair assembly 300*l* may be incorporated within any of the installations 100*a*-100*d* of FIGS. 1A-1D. The beam 335*l* may be supported on a standard 320*l*. The chair bracket 330*l* may include a front tab 332*l*, a rear tab 331*l* and a bottom interface surface 370*l*. The beam 335*l* may include a front top tab 338*l*, a front bottom tab 339*l*, a rear top hook 337*l*, a rear bottom tab 336*l*, a top interface surface 375*l* and a bottom interface surface 380*l*. The standard 320*l* may include a rear hook 328*l* and a top interface surface 385*l*. The beam 335*l* may be secured to the standard 320*l* with the rear hook 328*l* receiving the bottom rear tab 336*l* and the bottom front tab 339*l* between a tab 341*l* of a clamp 340*l* and the top interface surface 385*l* via a bolt 360*l* having a bolt head 361*l*. The chair bracket 330*l* may be secured to the beam 335*l* with the rear tab 331*l* received within the top rear hook 337*l* and the top front tab 338*l* between a tab 346*l* of a clamp 345*l* and the top interface surface 375*l* via a bolt 355*l* having a bolt head 356*l*.

Turning to FIG. 3M, a right-side profile view of a beam mounted chair assembly 300*m* is depicted including a chair bracket 330*m* supported on a beam 335*m*. The beam mounted chair assembly 300*m* may be incorporated within any of the installations 100*a*-100*d* of FIGS. 1A-1D. The beam 335*m* may be supported on a standard 320*m*. The chair bracket 330*m* may include a front tab 332*m*, a rear tab 331*m* and a bottom interface surface 370*m*. The beam 335*m* may include a front top tab 338*m*, a front bottom tab 339*m*, a rear top hook 337*m*, a rear bottom tab 336*m*, a top interface surface 375*m* and a bottom interface surface 380*m*. The standard 320*m* may include a rear hook 328*m* and a top interface surface 385*m*. The beam 335*m* may be secured to the standard 320*m* with the rear hook 328*m* receiving the bottom rear tab 336*m* and the bottom front tab 339*m* between a tab 341*m* of a clamp 340*m* and the top interface surface 385*m* via a bolt 360*m* having a bolt head 361*m*. The chair bracket 330*m* may be secured to the beam 335*m* with the rear tab 331*m* received within the top rear hook 337*m* and the top front tab 338*m* between a tab 346*m* of a clamp 345*m* and the top interface surface 375*m* via a bolt 355*m* having a bolt head 356*m*.

With reference to FIG. 3N, a right-side profile view of a beam 335*n* is in compression instead of employing a hook (e.g., hooks 336*j*, 337*j*, 336*k*, 337*k*) of an extruded beam (e.g., extruded beam 335*j*, 335*k*). The beam mounted chair assembly 300*n* is depicted including a chair bracket 330*n* supported on a beam 335*n*. The beam mounted chair assembly 300*n* may be incorporated within any of the installations 100*a*-100*d* of FIGS. 1A-1D. The beam 335*n* may be supported on a standard 320*n*. The chair bracket 330*n* may include a front tab 332*n*, a rear tab 331*n* and a bottom interface surface 370*n*. The beam 335*n* may include a front top tab 338*n*, a front bottom tab 339*n*, a rear top hook 337*n*, a rear bottom tab 336*n*, a top interface surface 375*n* and a bottom interface surface 380*n*. The standard 320*n* may include a rear hook 328*n* and a top interface surface 385*n*. The beam 335*n* may be secured to the standard 320*n* with the rear hook 328*n* receiving the bottom rear tab 336*n* and the bottom front tab 339*n* between a tab 341*n* of a clamp 340*n* and the top interface surface 385*n* via a bolt 360*n* having a bolt head 361*n*. The chair bracket 330*n* may be secured to the beam 335*n* with the rear tab 331*n* received within the top rear hook 337*n* and the top front tab 338*n* between a tab 346*n* of a clamp 345*n* and the top interface surface 375*n* via a bolt 355*n* having a bolt head 356*n*.

Turning to FIG. 3P, a right-hand profile view of a beam mounted chair assembly 300*p* is depicted including a reinforcement beam 365*p*. A reinforcement beam 365*p* may be integrated within a beam 335*p* to form a composite beam structure. A reinforcement beam 365*p* may extend parallel to a main beam 335*p* to strengthen an associated beam mounted chair assembly 300*p*. An added pocket 321*p* may be provided within an associated standard 320*p* and/or mounting feet to hold a reinforcement beam 365*p*. Aside from the reinforcement beam 365*p* and the added pocket 321*p*, the beam mounted chair assembly 300*p* may be similar to any of the beam mounted chair assemblies 300*a*-300*h* and 300*j*-300*n*. A reinforcement beam 365*p* may be added to stabilize the standards 320*p*. A reinforcement beam 365*p* and/or a support beam may be an I-beam as depicted in FIG. 3P. Alternatively, a reinforcement beam 365*p* and/or a support beam by be any shape. A beam 335*p* may be clamped to a support beam 365*p* to handle torsion loads. Corners of associated parts of a beam mounted chair assembly 300*p* may be sharp. Alternatively, corners of associated parts of a beam mounted chair assembly 300*p* may have radii added for manufacturing, stress reduction, safety, etc. A beam mounted chair assembly 300*p* may include chairs brackets 330*p* that are held in place prior to tightening fasteners of associated clamps by using beam and/or chair features (e.g., hooks and tabs as described with regard to FIGS. 3A-3H and 3J-3N) that may cooperate with a moment provided by an associated chair's center of mass. Additional member(s) may be added between the standard and the beam to strength the system while minimizing cost. These members will cooperate with the standard and the beam to enhance the system performance. Said cooperation may be enhanced by features such as pockets or protrusions in any or all adjacent members which engage adjacent members. Adjacent members may be fastened to enhance system performance. Fastening may take the form clamps, welds, bolts, adhesives or other means of linking adjacent members to enhance system performance. Fastening does not require properties to be isotropic and one skilled in the art can envision antistrophic methods which will enhance performance while lowering system cost.

With reference to FIG. 3Q, a bottom, right, perspective view of an example beam mounted chair assembly 300*q* is depicted. A single standard 320*q* with an integral beam 335*q* having a single mounting foot 325*q* may be used to support chair brackets 330*q*. Alternatively, a profile of a beam 335*q* may be attached to or be made part of a standard 320*q* face thus eliminating the "apparent beam." A single standard assembly such as depicted in FIG. 3Q may be referred to as a pedestal base chair assembly and or pseudo-beam mounted where the beam is part of an adjacent structure.

Figure 3R:
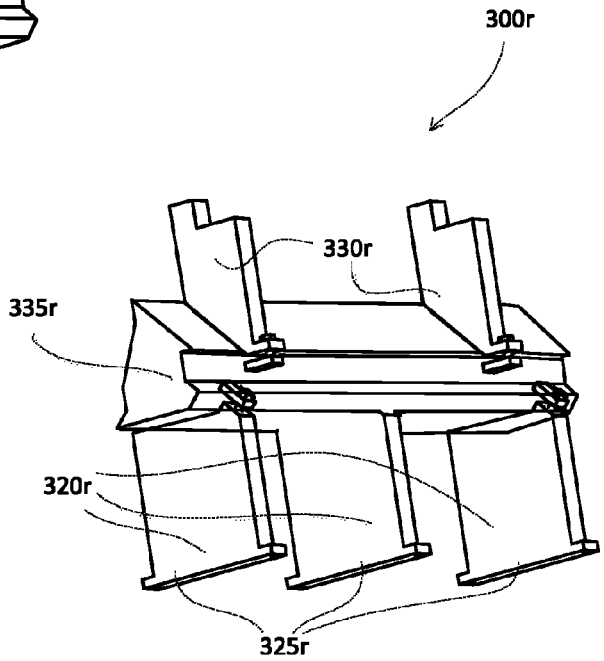

Turning to FIG. 3R, a bottom, front, perspective view of an example beam mounted chair assembly 300*r* is depicted. Similar to the assembly 300*q*, the assembly 300*r* may include a standard 320*r* integral with a beam 335*r*. The assembly 300*r* may further include additional standards 320*r*. Each standard 320*r* may include an associated mounting foot 325*r*. The assembly 300*r* may also include chair brackets 330*r*.

Figure 3S:
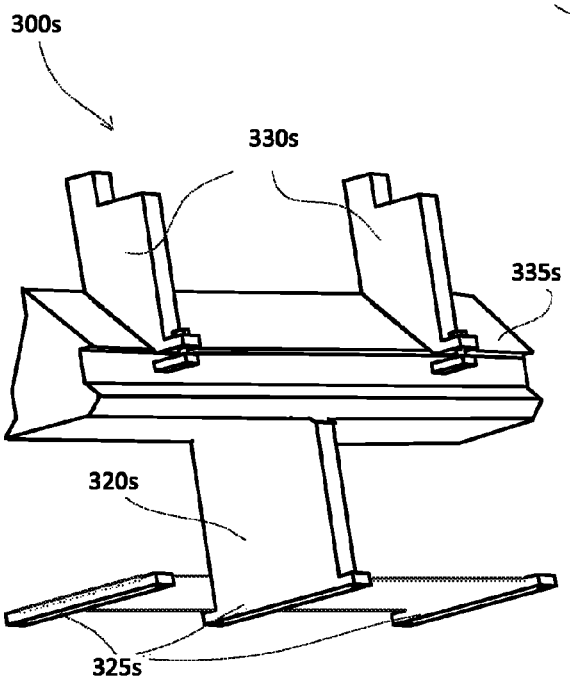

With reference to FIG. 3S, a bottom, front, perspective view of an example beam mounted chair assembly 300*s* is depicted. Similar to the assembly 300*q*, the assembly 300*s* may include a standard 320*s* integral with a beam 335*s*. The standard 320*s* may include a plurality of mounting feet 325*s*. The assembly 300*s* may also include chair brackets 325*s*.

Figure 3T:
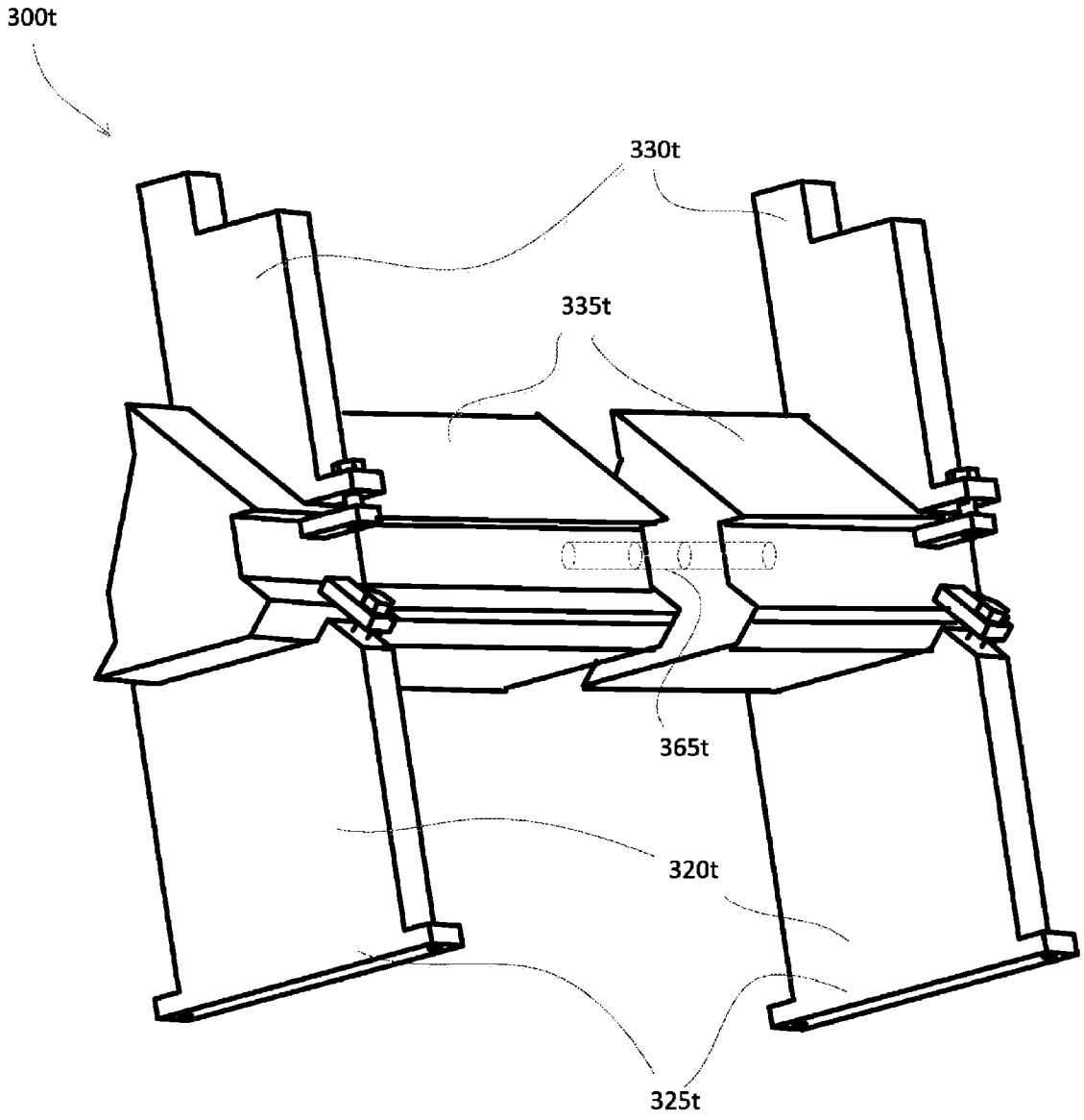

Turning to FIG. 3T, a bottom, front, perspective view of an example beam mounted chair assembly 300*t* is depicted. The assembly 300*t* may include a plurality of beams 335*t* joined together via a beam coupler 365*t*. The assembly 300*t* may further include standards 320*t* having a respective mounting foot 325*t* and chair brackets 320*t*. A beam coupler 365*t* may be used to join separate beams 335*t* into one continuous length. A beam coupler 365*t* may be a piece (e.g., a pipe, an I-beam, a box beam, a plate, etc.) that fits inside of each beam.

Figure 3U:
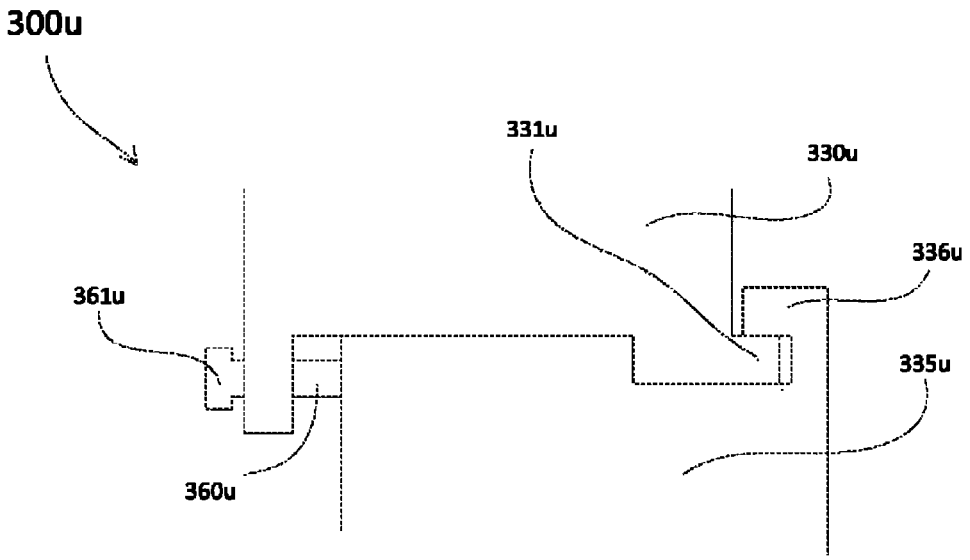

With reference to FIG. 3U, a profile view of a beam mounted chair assembly 300*u* is depicted including a chair bracket 330*u* secured to a beam 335*u* having a hook shaped piece 331*u* of the chair bracket received within a beam receptacle 336*u* and fixed in place via a bolt 360*u* having a head 361*u*.

Figure 3V:
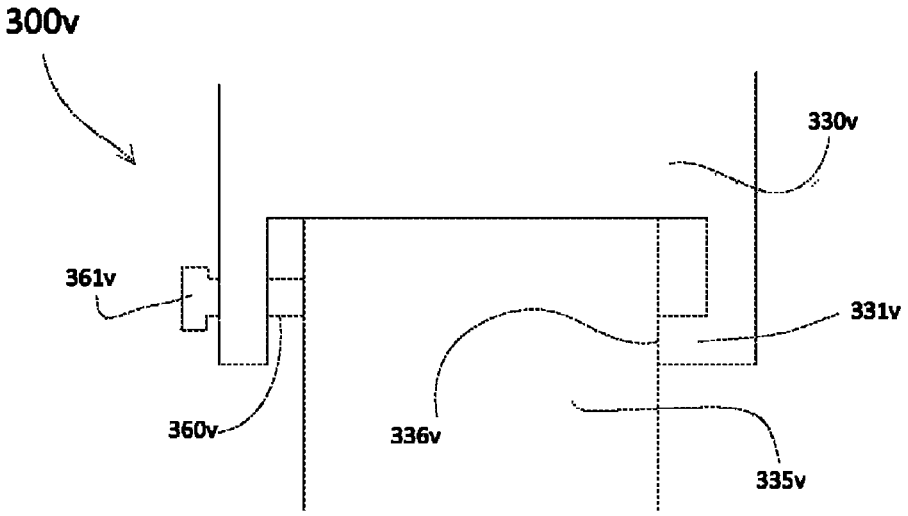

Turning to FIG. 3V, a profile view of a beam mounted chair assembly 300*v* is depicted including a chair bracket 330*v* secured to a beam 335*v* having a hook shaped piece 331*v* of the chair bracket on one side 336*v* of the beam 335*v* and fixed in place via a bolt 360*v* having a head 361*v* on another side of the beam 335*v*. The hook shaped piece 331*v* may include a pointed protrusion to secure to the beam surface 336*v* or may include a roughened surface, or the like, to increase friction between the hook shaped piece 331*v* and the beam side 336*v*.

Figure 3W:
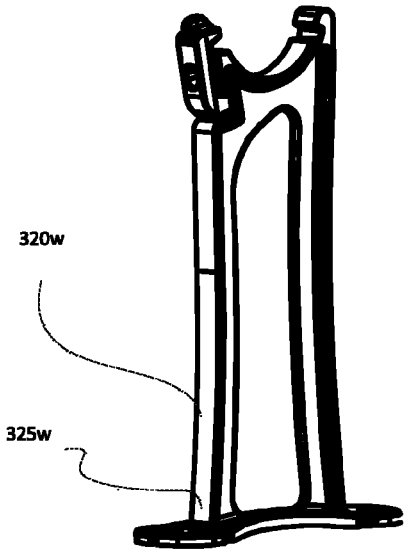

With reference to FIG. 3W, a standard 320*w* is depicted having a mounting foot 325*w*. As shown in FIG. 3W, the standard 320*w* may have a "web" configuration. The web configuration minimizes material while maximizing strength.

Figure 3X:
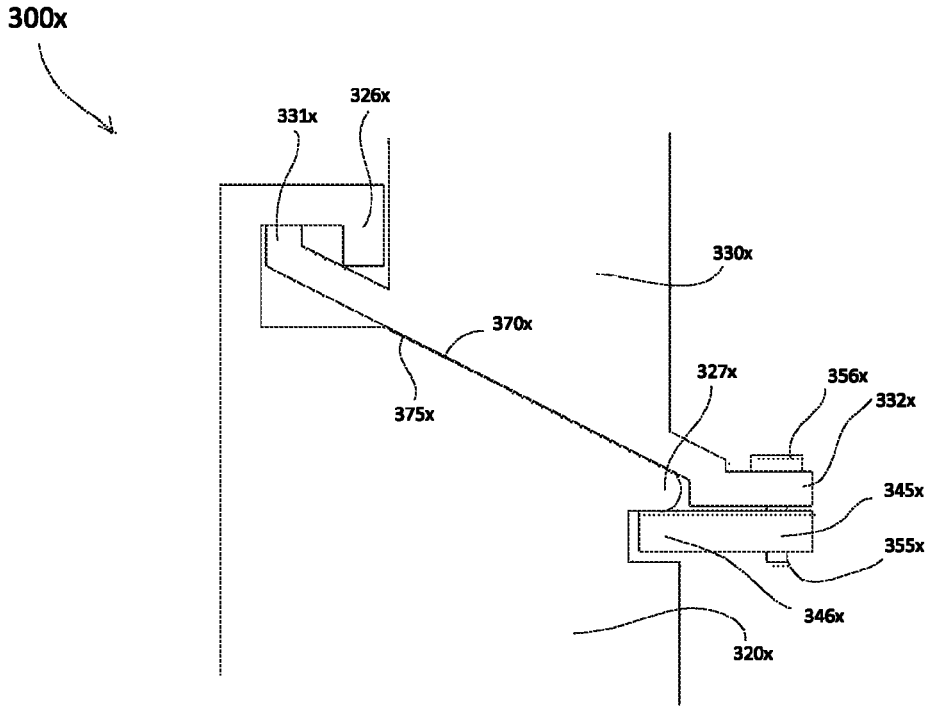

Turning to FIG. 3X, a right-side profile view of a beam mounted chair assembly 300*x* is depicted including a chair bracket 330*x* supported on a beam 335*x*. The beam mounted chair assembly 300*x* may be incorporated within any of the installations 100*a*-100*d* of FIGS. 1A-1D. The beam 335*x* may be supported on a standard (not shown in FIG. 3X). The chair bracket 330*x* may include a front tab 332*x*, a rear tab 331*x* and a bottom interface surface 370*x*. The beam 335*x* may include a rear top hook 336*x*, a front top tab 337*x* and a top interface surface 375*x*. The chair bracket 330*x* may be secured to the beam 335*x* with the rear tab 331*x* received within the top rear hook 336*x* and the top front tab 337*x* between a tab 346*x* of a clamp 345*x* and the top interface surface 375*x* via a bolt 360*x* having a bolt head 361*x*. A difference in angle between the rear tab 331*x* and the interfacing surface 375*x* may induce a stable interface between the chair bracket 330*x* and the beam 335*x* when the associated clamps 345*x* is tightened due to the face that the rear tab 331*x* is cantilevered with respect to the rear top hook 336*x*.

Turning to FIGS. 3Y1-3Z2, a left-side profile view of a beam mounted chair assembly 300*y*1-300*z*2 is depicted including a chair bracket 330*y*1-330*z*2 supported on a beam 335*y*1-335*z*2. The beam mounted chair assembly 300*y*1-300*z*2 may be similar to the beam mounted chair assembly 300*d*. The beam 335*y*1-335*z*2 may be supported on a standard 320*y*1-320*z*2. The chair bracket 330*y*1-330*z*2 may include a front tab, a rear hook and a bottom interface surface similar to, for example, any one of the chair brackets 330*a*-330*h*, 330*j*-330*n* or 330*p*-330*x*. The beam 335*y*1-335*z*2 may include a front top tab, a front bottom tab, a rear top tab, a rear bottom tab, a top interface surface and a bottom interface surface similar to, for example, any one of the beams 335*a*-335*h*, 335*j*-335*n* or 335*p*-335*x*. The standard 320*y*1-320*z*2 may include a mounting foot 325*y*1-325*z*2 having a front foot and a rear foot, a rear hook and a top interface surface similar to, for example, any one of the standards 320*a*-320*h*, 320*j*-320*n* or 320*p*-320*x*. The beam 335*y*1-335*z*2 may be secured to the standard 320*y*1-320*z*2 similar to, for example, any one of the chair assemblies 300*a*-300*h*, 300*j*-300*n* or 300*p*-300*x* via a bolt 360*y*1-360*z*2 having a bolt head 361*y*1-361*z*2. The chair bracket 330*y*1-330*z*2 may be secured to the beam 335*y*1-335*z*2 similar to, for example, any one of the chair assemblies 300*a*-300*h*, 300*j*-300*n* or 300*p*-300*x* via a bolt 355*y*1-355*z*2 having a bolt head 356*y*1-35*z*2. While the interfacing surfaces are illustrated within FIGS. 3Y1-3Z2 as being substantially flat, any one of the interfacing surfaces may be non-flat as depicted in FIGS. 3G, 3J and 3K. As depicted in FIGS. 3Y1-3Z2, any one of the assemblies 300*y*1-300*z*2 may include additional features, such as for example, tab portions 341*y*2, 341*y*3, 342*y*3, 346*y*3, 341*y*4, 342*y*4, 346*y*4, 347*y*4, 342*z*2, 347*z*2 configured to encourage the respective standard to fully engage the respective beam when the respective bolts are tightened or encourage the respective chair bracket to fully engage the respective beam when the respective bolts are tightened.

Figure 4A:
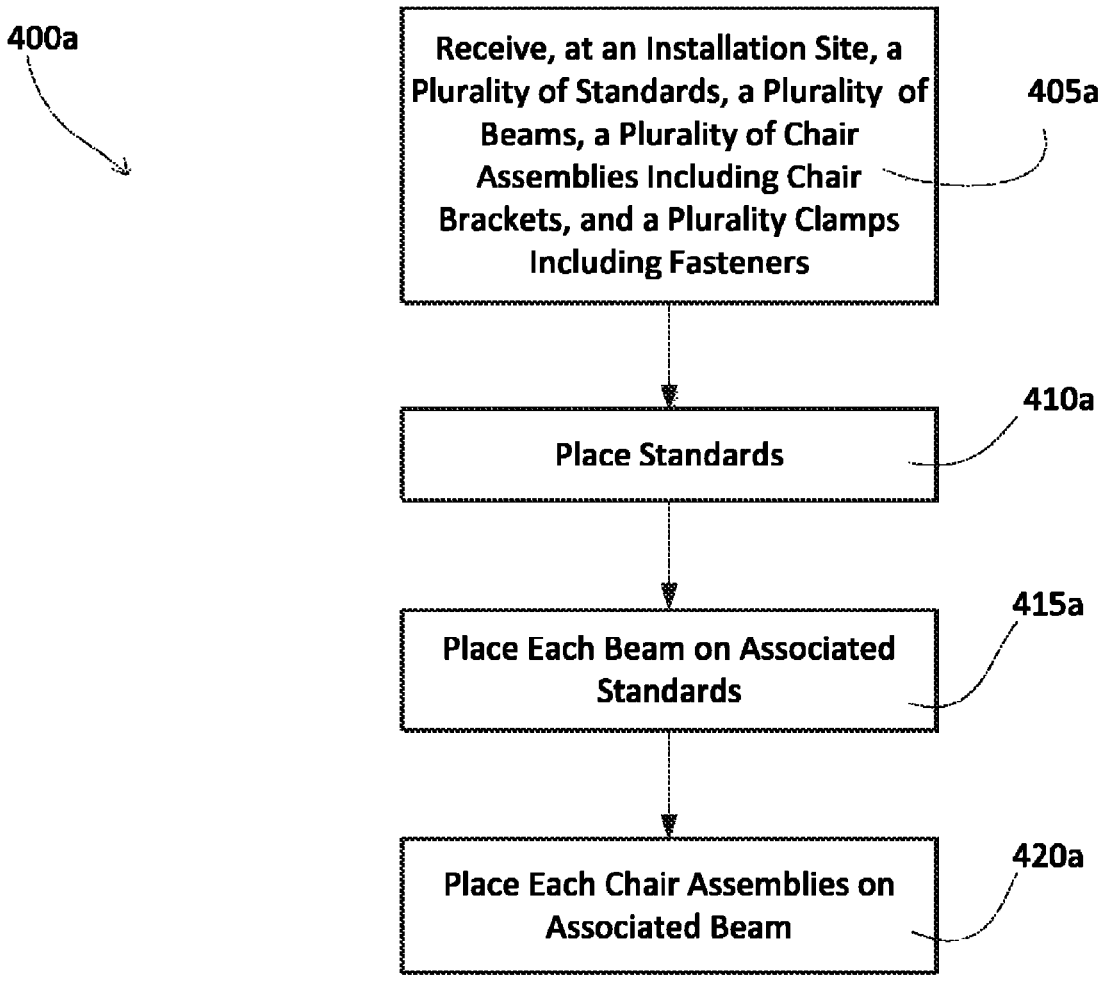
FIGS. 4A and 4B depict flow diagrams for example beam mounted chair assembly installation methods.

Turning to FIG. 4A, a flow diagram is depicted of an example beam mounted chair assembly installation method 400*a*. The method 400*a* may include receiving, at an installation site, a plurality of standards, a plurality of beams, a plurality of chair assemblies with chair brackets and a plurality of clamps with fasteners (block 405*a*). A plurality of reinforcement beams may also be received (block 405*a*). The method 400*a* may also include placing a plurality of standards (block 410*a*). The method 400*a* may also include placing reinforcement beams (block 410*a*). The method 400*a* may further include placing a plurality of beams on associated standards (block 415*a*). The method 400*a* may yet further include placing a plurality of chair assemblies on associated beams (block 420*a*). A beam mounted chair assembly may include chairs brackets that are held in place prior to tightening fasteners of associated clamps by using beam and/or chair features (e.g., hooks and tabs as described with regard to FIGS. 3A-3H and 3J-3N) that may cooperate with a moment provided by an associated chair's center of mass. It should be understood that the order of the steps of the method 400*a* may be altered. For example, beams may be shipped to the installation site with standards previously installed. In moveable base systems, it may be optimal for the chairs to remain attached to the beam and the beam/chair assembly attached to standards which may or may not be attached to floor link plates as disclosed, for example, in commonly assigned U.S. Patent Application Ser. No. 62/006,363, entitled Reconfigurable Seating Systems, Seat Assemblies for use within the Reconfigurable Seating Systems, Components for use within the Seat Assemblies and Parts for use within the Components, filed Jun. 2, 2014, the disclosure of which is incorporated herein in its entirety by reference.

Figure 4B:
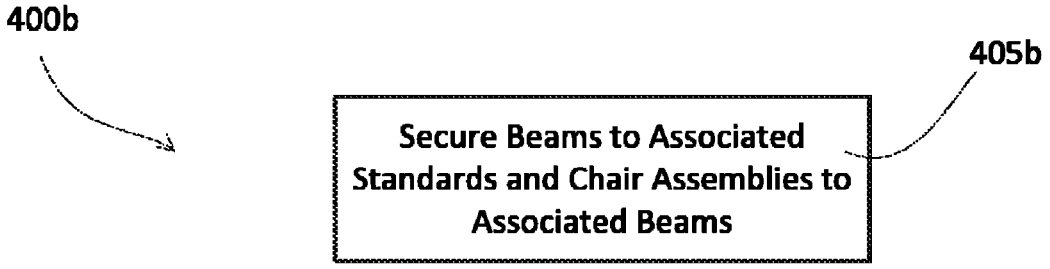

With reference to FIG. 4B, a flow diagram for an example method of securing a plurality of beams to a plurality of standards and securing a plurality of chair assemblies to a beam 400*b* is depicted. The method 400*b* may include tightening a plurality of fasteners of associated clamps.

Figure 5A:
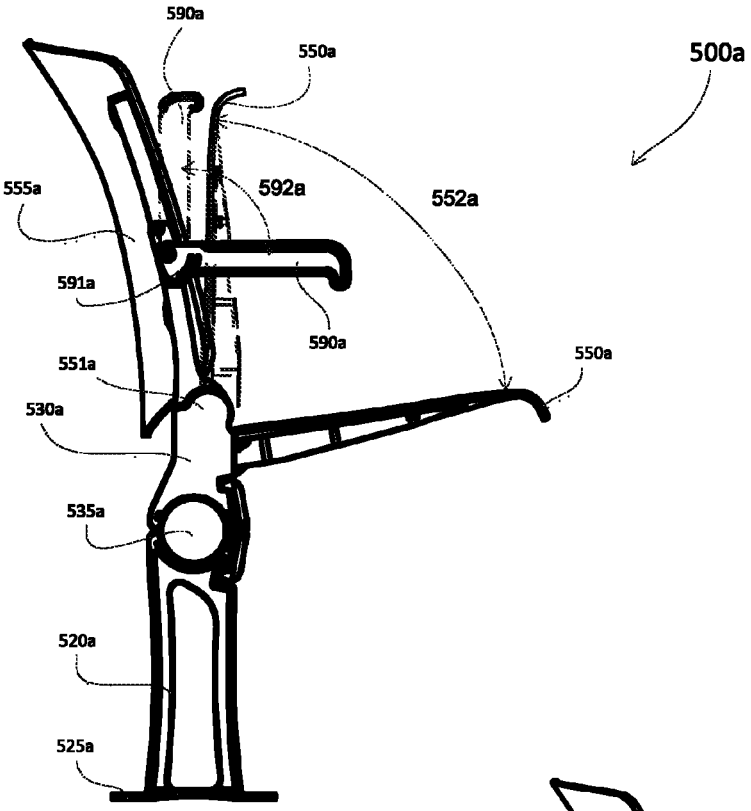
FIGS. 5A-5H depict various views of example beam mounted chair assemblies having un-upholstered chair seats and chair backs.
Figure 5B:
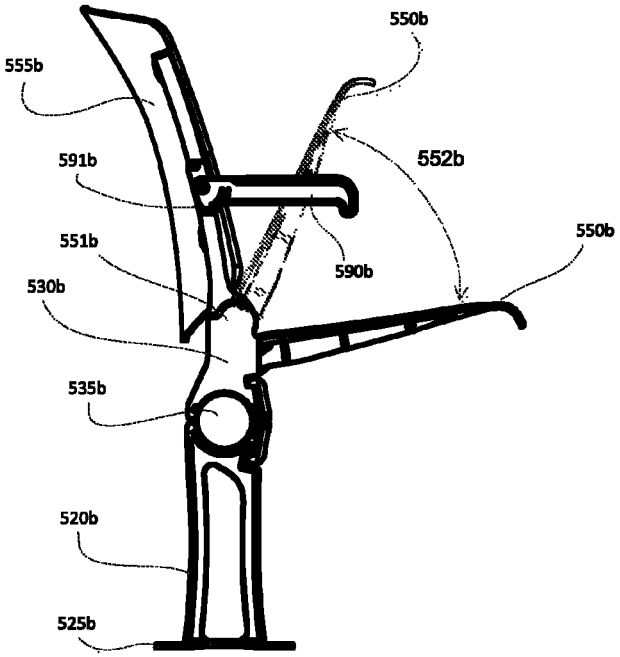
Figure 5C:
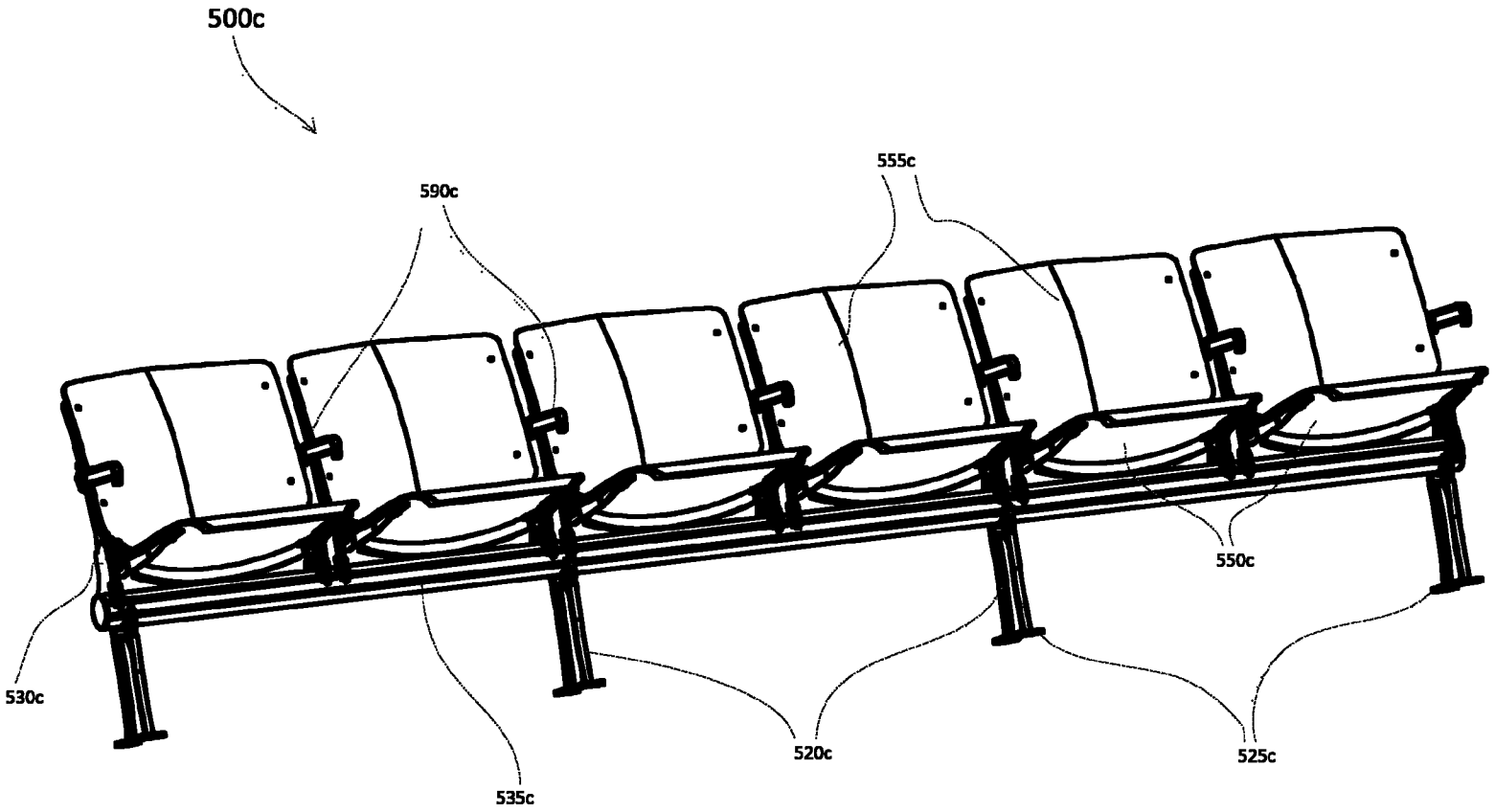
Figure 5D:
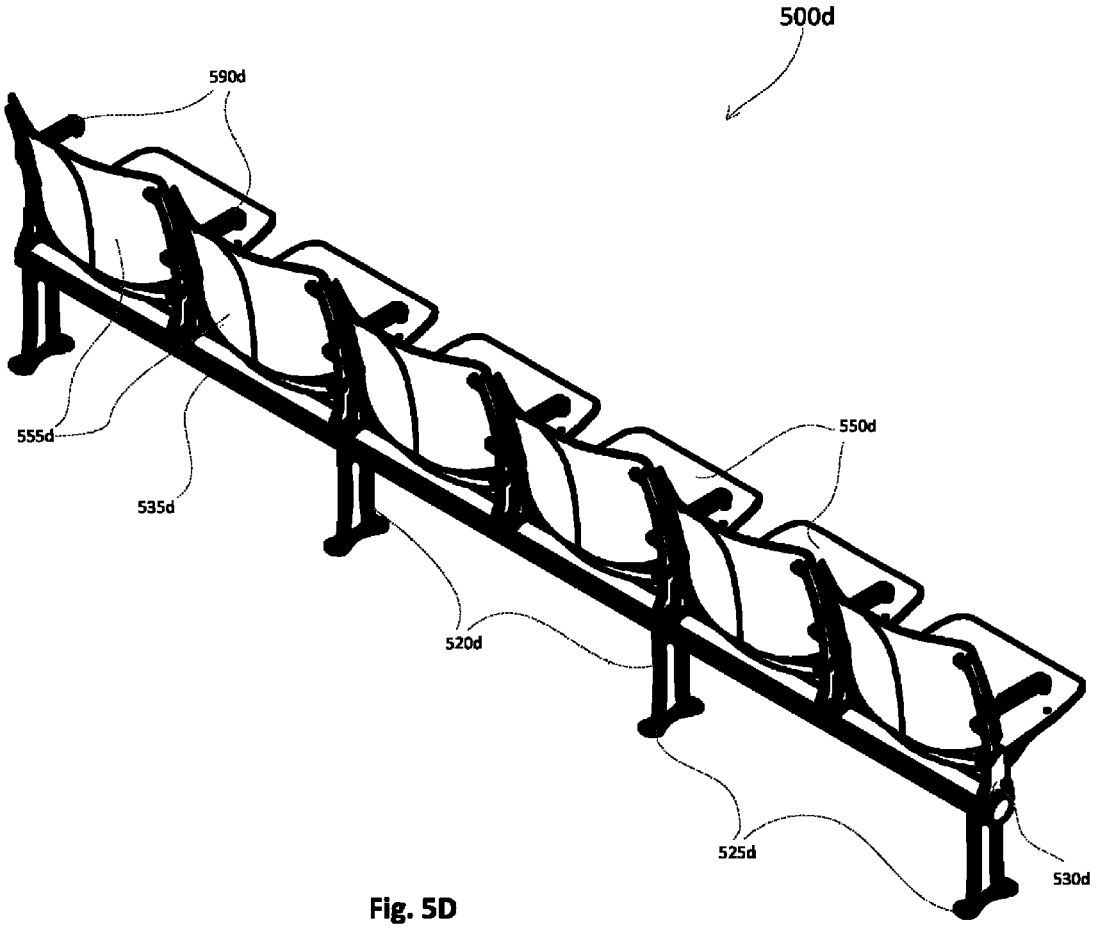
Figure 5E:
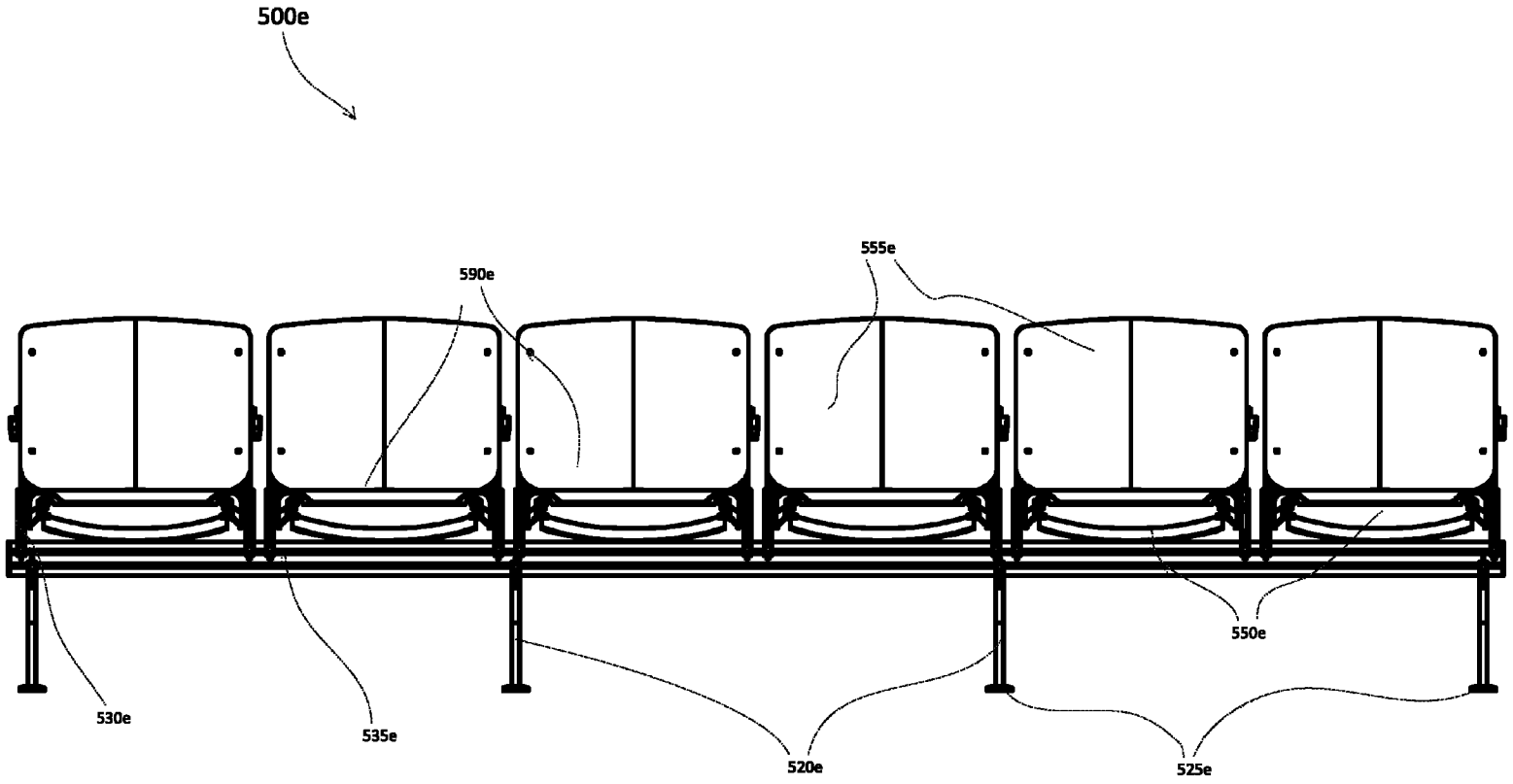
Figure 5F:
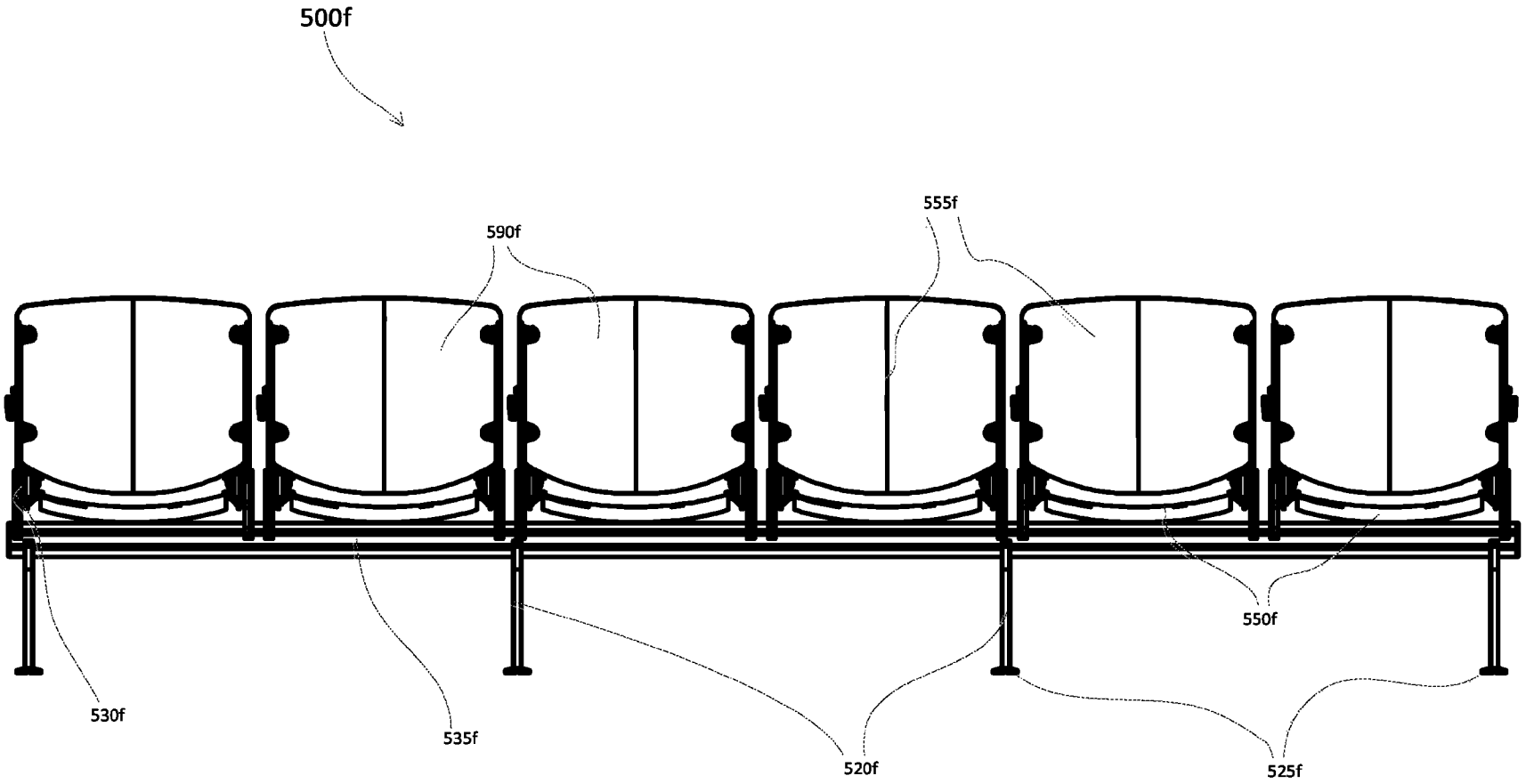
Figure 5G:
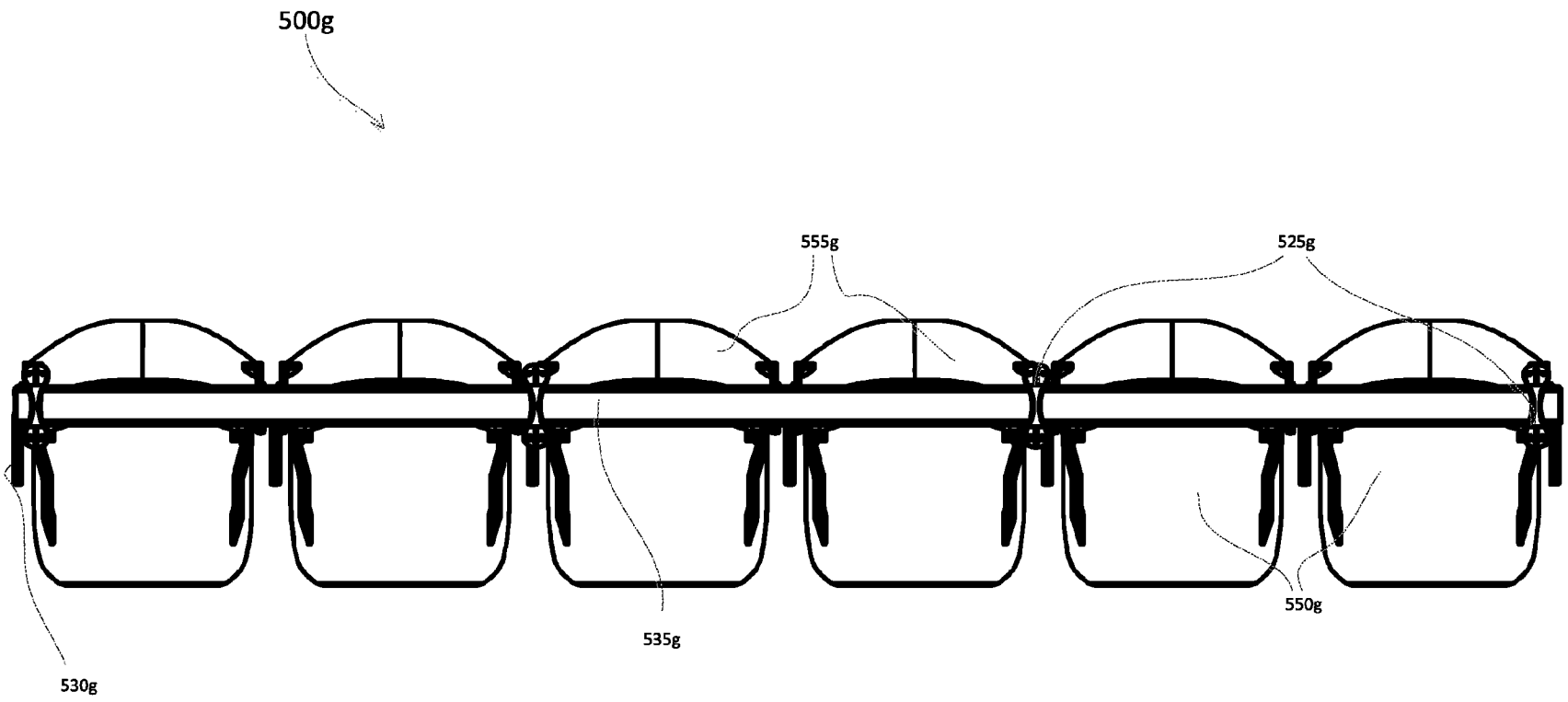
Figure 5H:
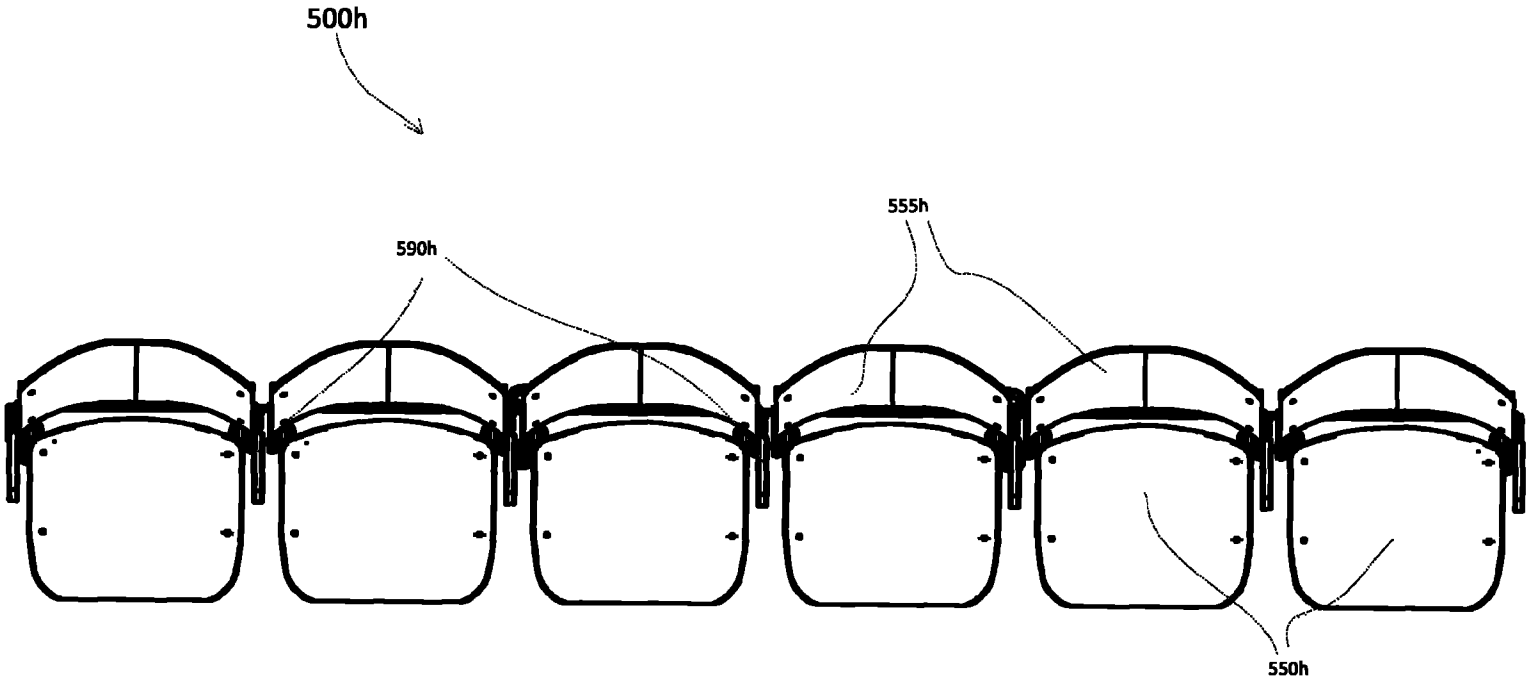

Turning to FIGS. 5A-5G, various views of example beam mounted chair assemblies 500*a*-500*g* having unupholstered chair seats 550*a*-550*g* and chair backs 555*a*-555*g* are depicted. A beam mounted chair assembly 500*a*-500*g* may include at least two standards 520*a*-520*g* having mounting feet 525*a*-525*g*, at least one beam 535*a*-535*g*, chair brackets 530*a*-530*g* and armrests 590*a*-590*g*. FIG. 5A depicts a left-side profile view of a beam mounted chair assembly 500*a* with a chair seat 550*a* and an armrest 590*a* pivotally attached to a chair bracket 530*a*. As can be seen in FIGS. 5A and 5B, the chair seat 550*a*, 550*b* may be configured to automatically pivot between an in use position (chair seat 550*a*, 550*b* shown in solid lines in FIGS. 5A and 5B, respectively) and a three-quarter up position (chair seat 550*b* shown in dashed lines in FIG. 5B) and manually push to full fold (chair seat 550*a* shown in dashed lines in FIG. 5A). Such an arrangement has the desirable advantage that when spectators leave, the seats are automatically returned to the standby position and thus do not reduce the width of the aisle between adjacent rows of seats and along which the spectators move. Optionally, the chair seat 550*a*, 550*b* may be configured to automatically pivot to a user selectable position anywhere between the in use position and a full fold position. The full fold position further increases isle width and minimizes packaging size during shipping. An armrest 590*a*, 590*b* may be configured to be manually pivotable between an in use position (armrest 590*a*, 590*b* shown in solid lines in FIGS. 5A and 5B, respectively) and a standby position (armrest 590*b* shown in dashed lines in FIG. 5A). With the chair seat 550*a* and armrest 590*a* in a full fold position against a chair back 555*a*, associated shipping space in minimized while facilitating pre-assembly of the associated chair prior to shipping.

Figure 6A:
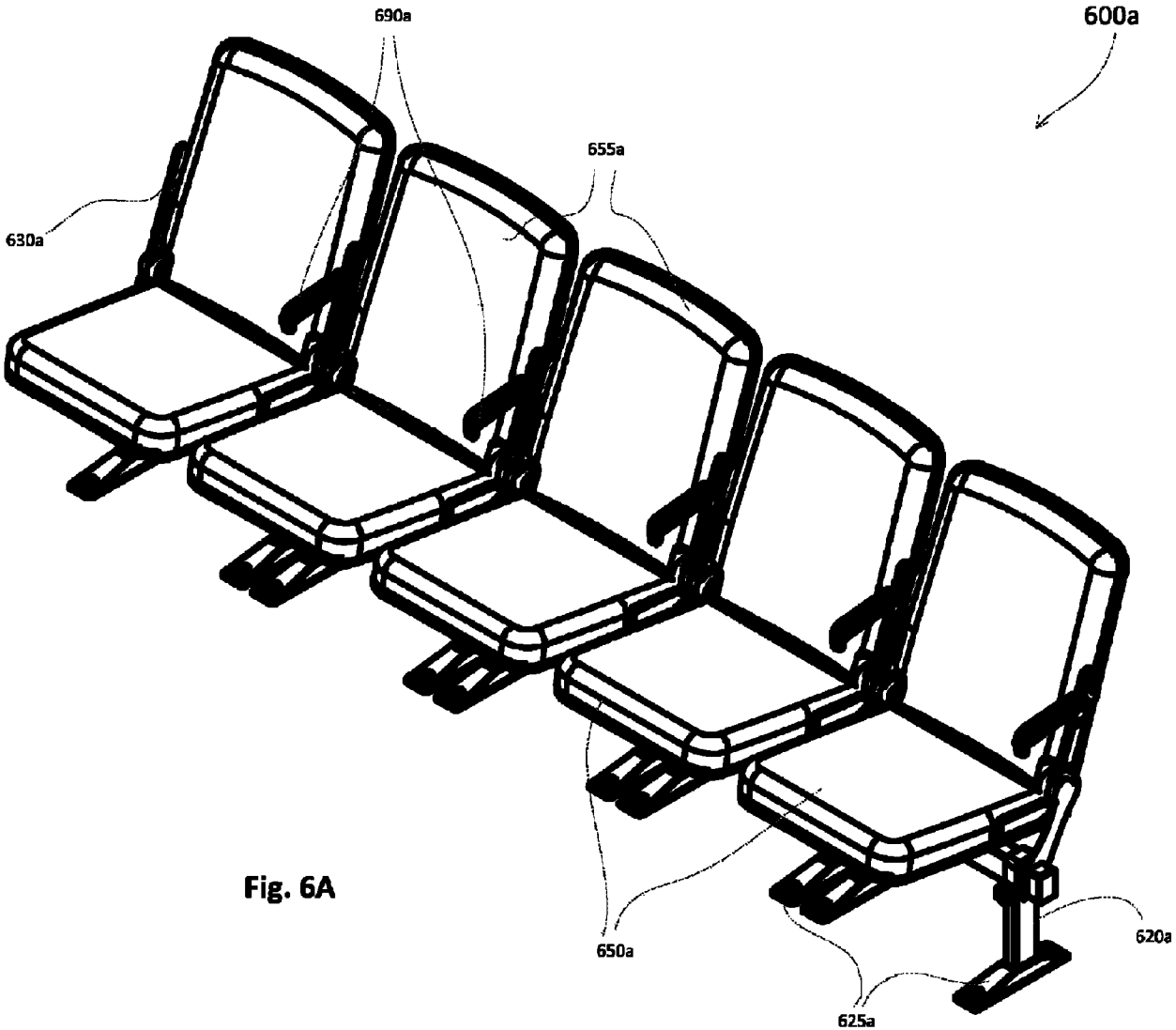
FIGS. 6A-6H and 6J-6L depict various views of example beam mounted chair assemblies having upholstered chair seats and chair backs
Figure 6B:
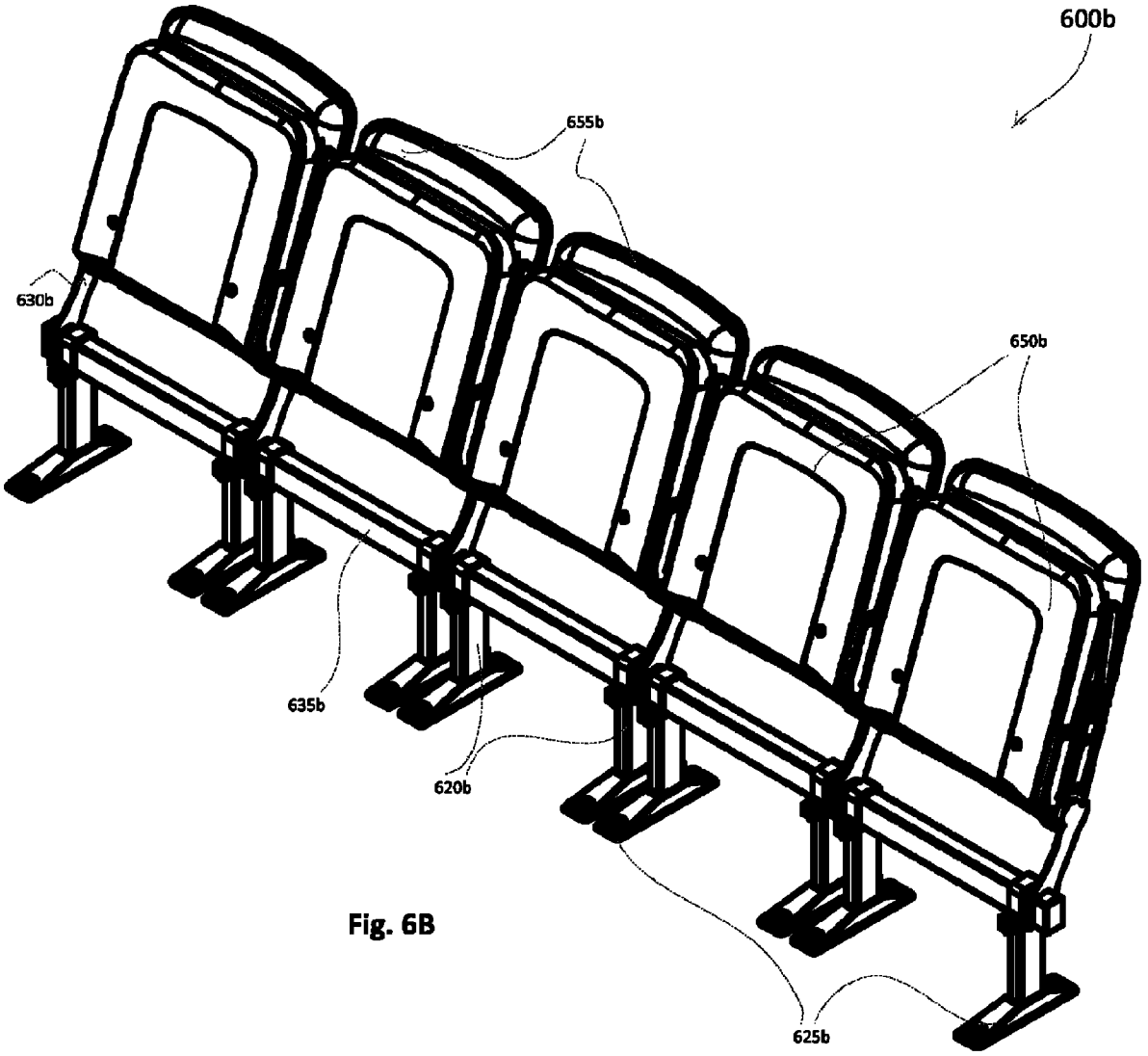
Figure 6C:
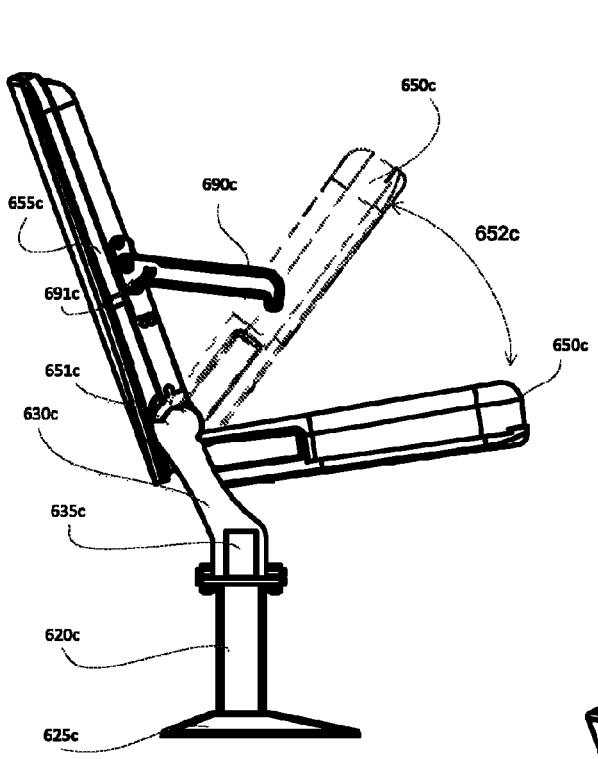
Figure 6D:
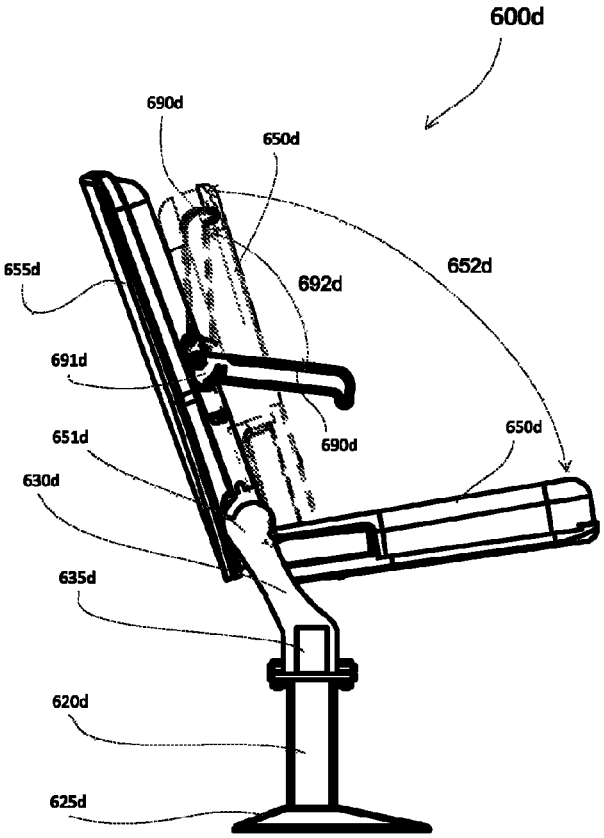
Figure 6E:
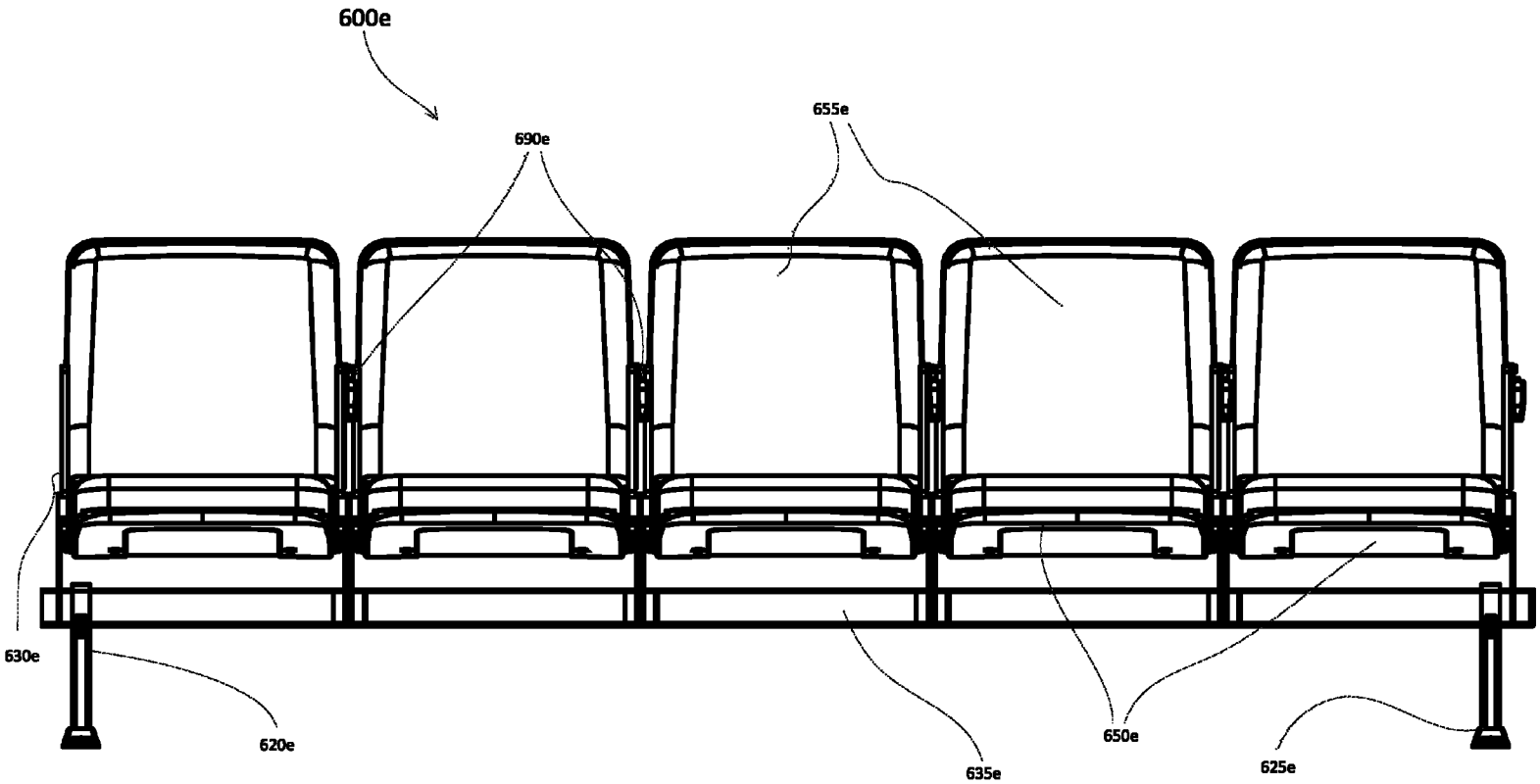
Figure 6F:
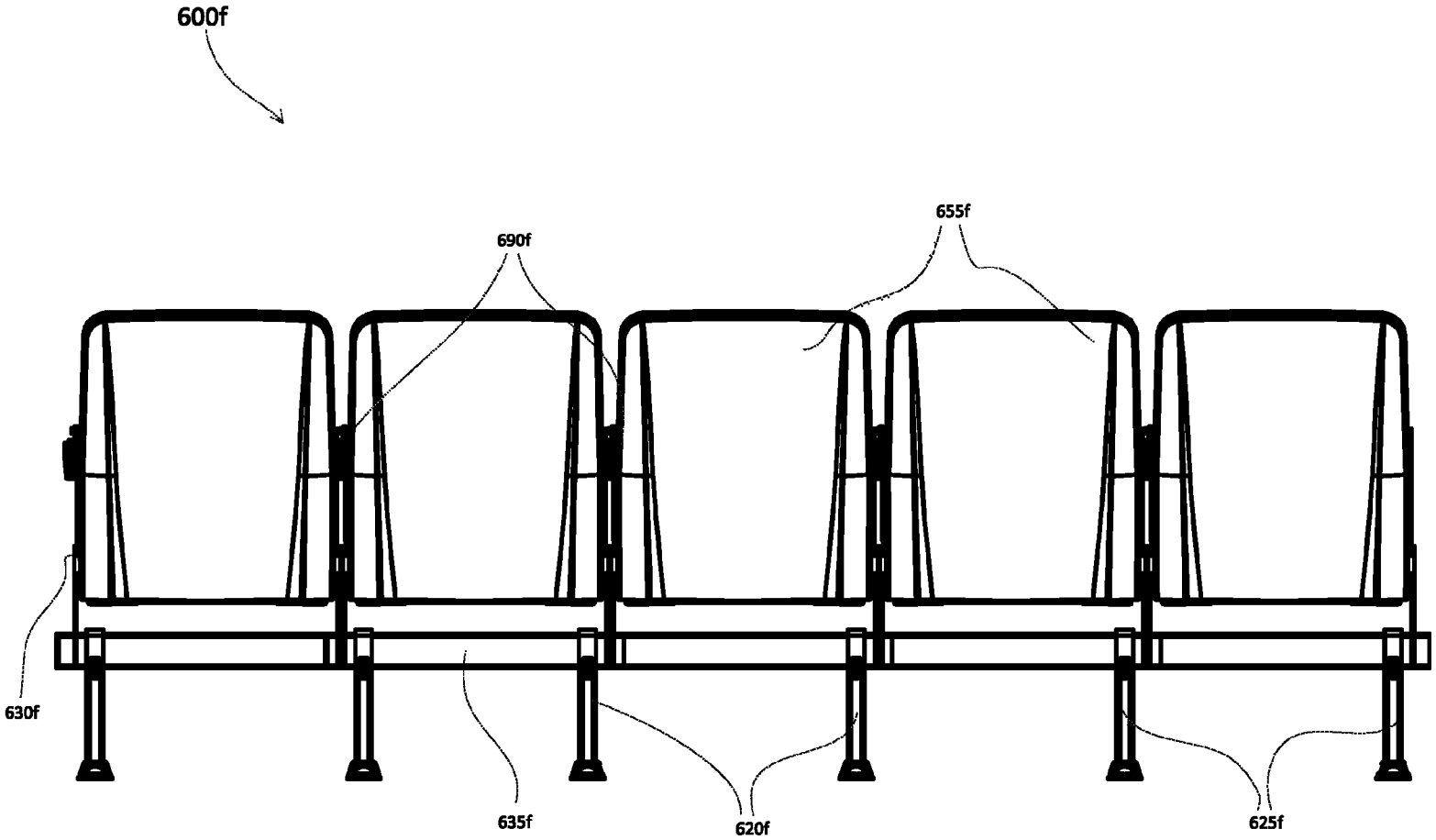
Figure 6G:
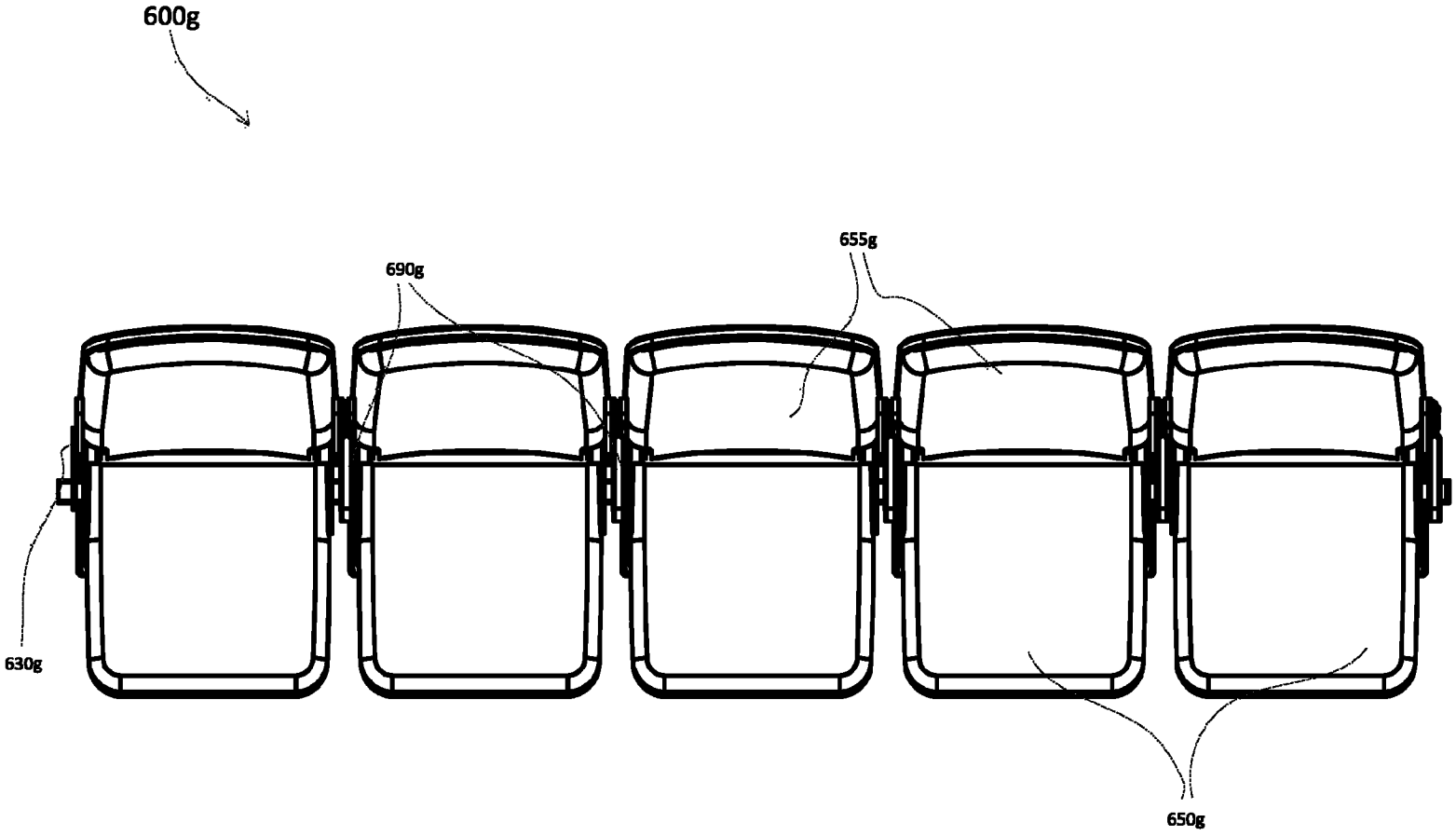
Figure 6H:
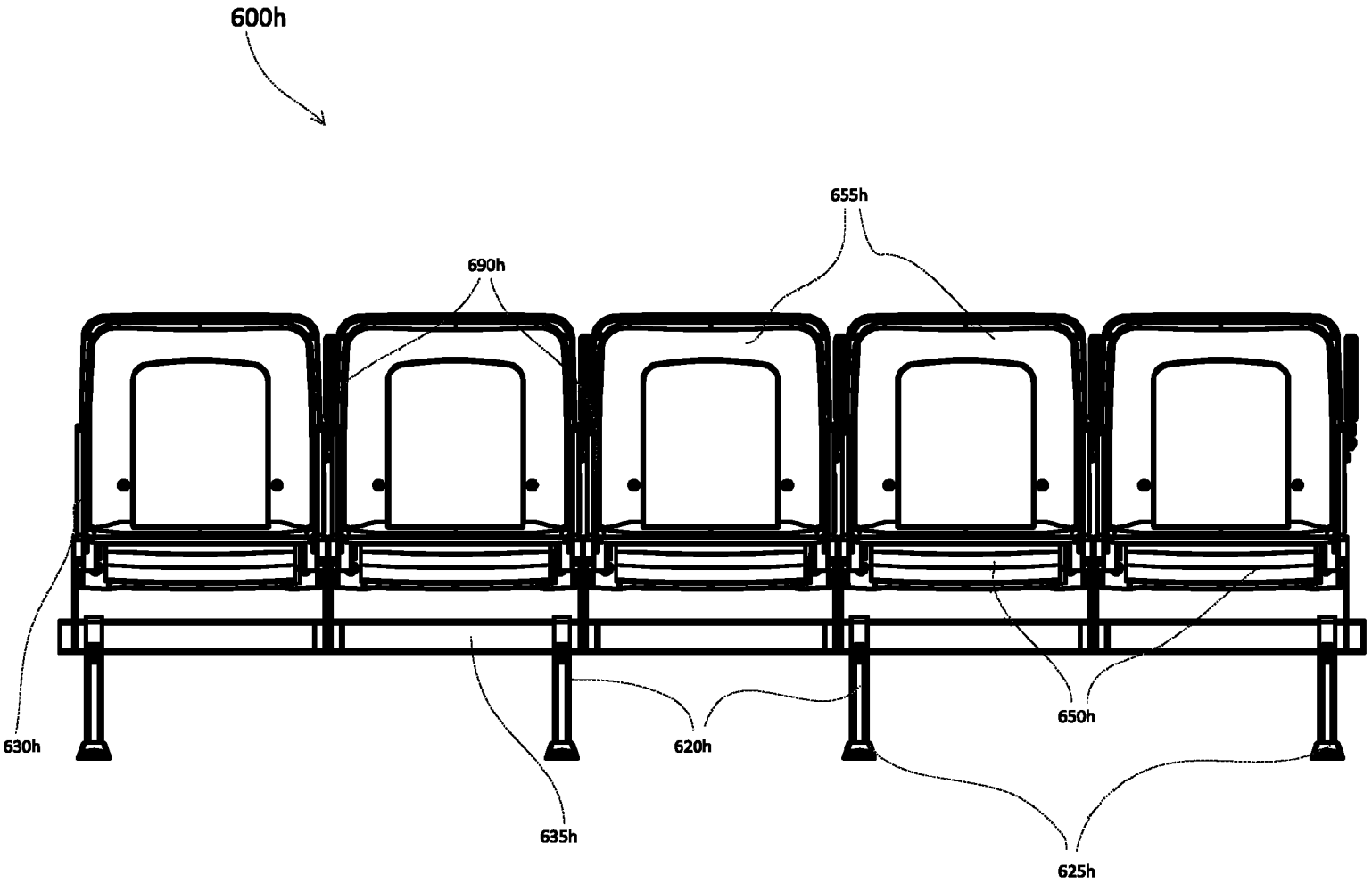
Figure 6J:
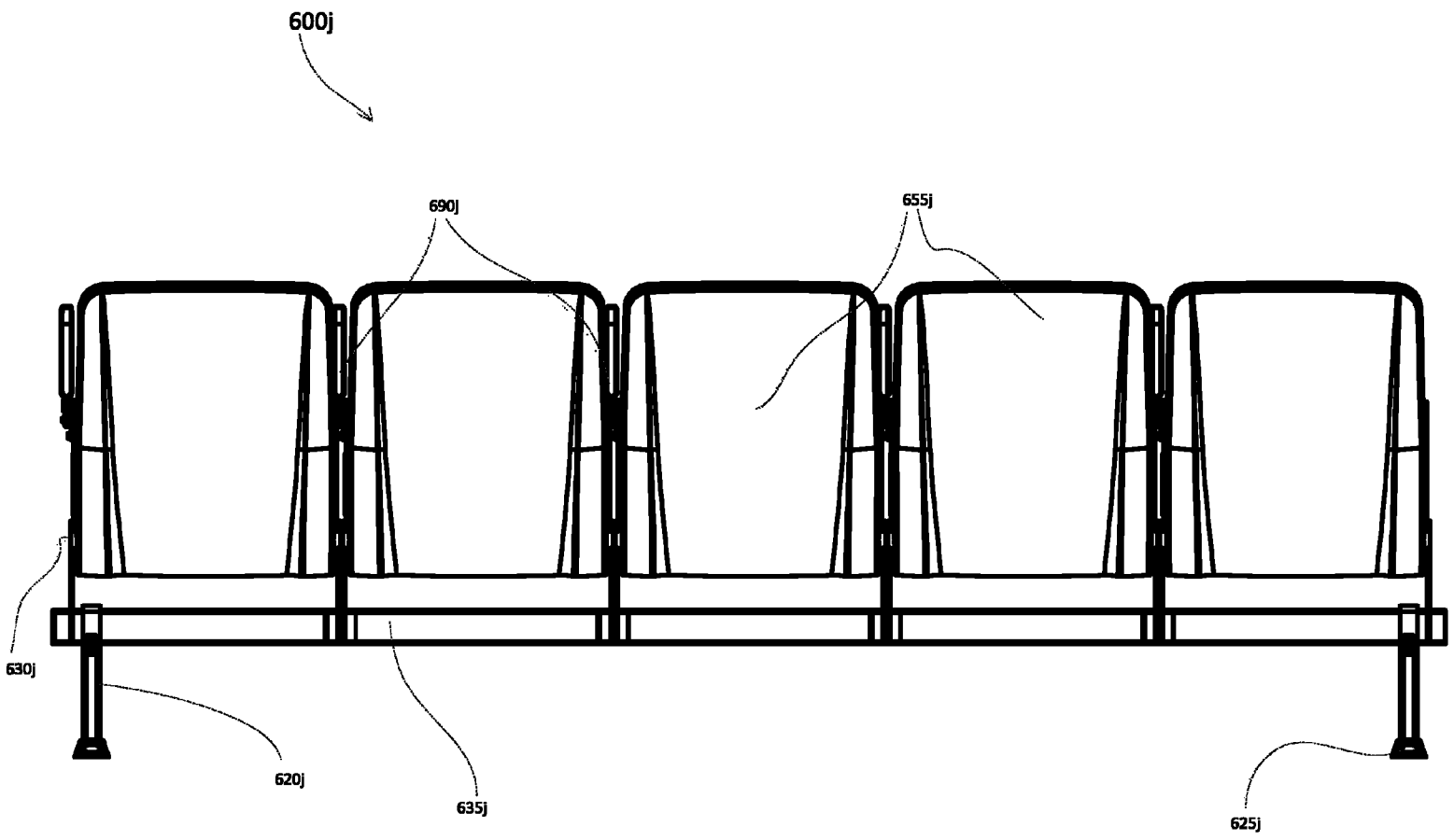
Figure 6K:
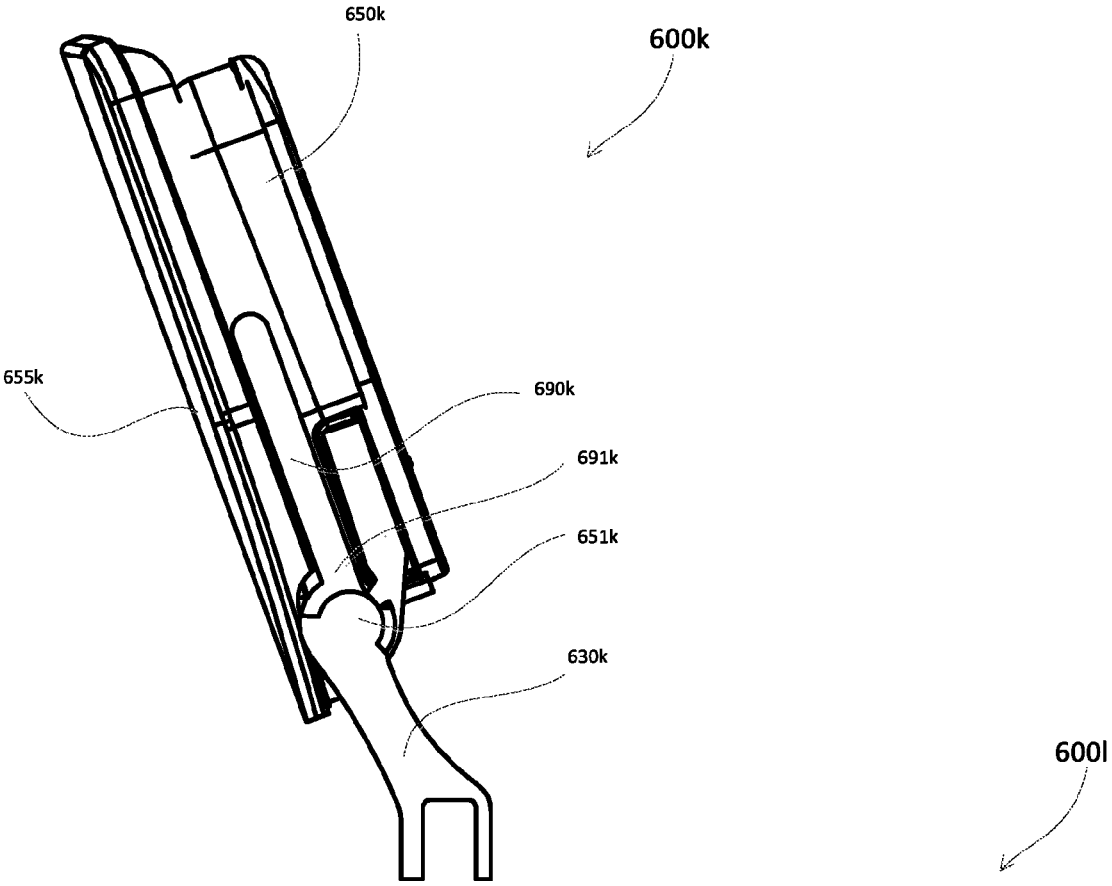
Figure 6L:
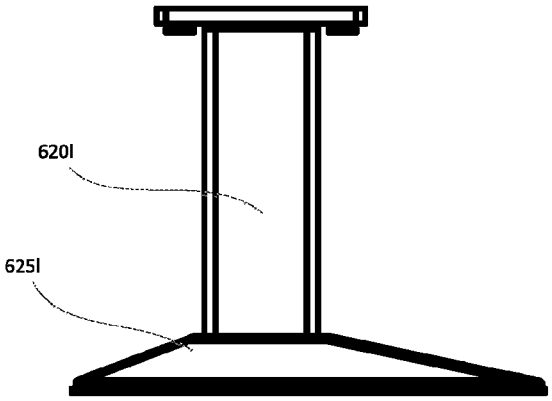

With reference to FIGS. 6A-6H and 6J-L, various views of example beam mounted chair assemblies 600*a*-600*h* and 600*j*-600*l* having upholstered chair seats 650*a*-650*h* and 650*j*-650*l* and chair backs 655*a*-655*h* and 655*j*-655*l* are depicted. A beam mounted chair assembly 600*a*-600*h* and 600*j*-600*l* may include at least two standards 620*a*-620*h* and 620*j*-620*l* having mounting feet 625*a*-625*h* and 625*j*-625*l*, at least one beam 635*a*-635*h* and 635*j*-635*l*, chair brackets 630*a*-630*h* and 630*j*-630*l* and armrests 690*a*-690*h* and 690*j*-690*l*. FIGS. 6C and 6D depict a left-side profile view of a beam mounted chair assembly 600*c*, 600*d* with a chair seat 650*c*, 650*d* and an armrest 690*c*, 690*d* pivotally attached to a chair bracket 630*c*, 630*d*. As can be seen in FIGS. 6C and 6D, the chair seat 650*c*, 650*d* may be configured to automatically pivot between an in use position (chair seat 650*c*, 650*d* shown in solid lines in FIGS. 6C and 6D, respectively) and a three-quarter up position (chair seat 650*c* shown in dashed lines in FIG. 6C) and manually push to full fold (chair seat 650*d* shown in dashed lines in FIG. 6D). Such an arrangement has the desirable advantage that when spectators leave, the seats are automatically returned to the standby position and thus do not reduce the width of the aisle between adjacent rows of seats and along which the spectators move. Optionally, the chair seat 650*c*, 650*d* may be configured to automatically pivot to a user selectable position anywhere between the in use position and a full fold position. The full fold position further increases isle width and minimizes packaging size during shipping. An armrest 690*c*, 690*d* may be configured to be manually pivotable between an in use position (armrest 690*c*, 690*d* shown in solid lines in FIGS. 6C and 6D, respectively) and a standby position (armrest 690*d* shown in dashed lines in FIG. 6D). With the chair seat 650*d* and armrest 690*d* in a full fold position against a chair back 655*d*, associated shipping space in minimized while facilitating pre-assembly of the associated chair prior to shipping.

Figure 7A:
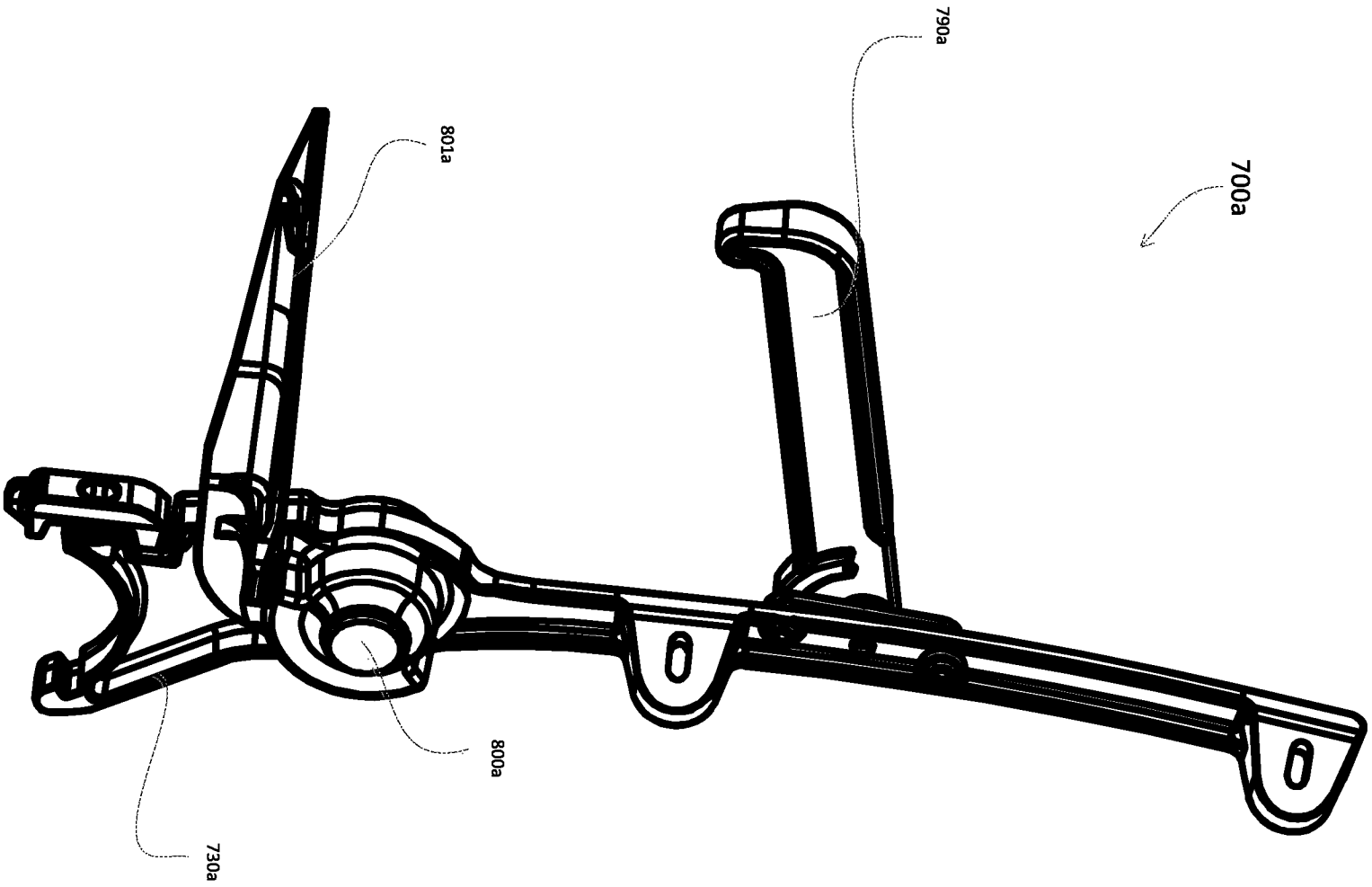
FIGS. 7A-7F depict various views of chair brackets having a pivotally attached armrest and a pivotally attached chair seat bracket.

Turning to FIGS. 7A-7F, various views of chair brackets 730*a*-730*f* having a pivotally attached armrest 790*a*-790*f* and a pivotally attached chair seat bracket 752*b* are depicted. In particular, FIG. 7A depicts a chair bracket assembly 700*a* is depicted including a chair bracket 730*a* having a chair seat bracket 801*a* pivotally attached via a chair seat pivot 800*a*. The chair seat pivot 800*a* may be configured to provide an automatic chair seat pivot from an "in use" position to a three-quarter folded up position and a manual push to full fold features. As depicted in FIG. 7A, a chair seat pivot 800*a* may be located above a top chair seat surface (e.g., top surface 817*a* of FIG. 8), thereby, a corresponding chair assembly may be folded into a smaller area compared to a chair assembly incorporating a chair seat as depicted in FIG. 8. The assembly 700*a* may include an armrest 790*a* pivotally secured to the chair bracket 730*a*. Alternatively, an armrest 790*a* may be pivotally secured to a beam, a standard, a chair back structure, or a chair seat structure independent of a chair bracket 730*a*. An armrest may be fixed or may be pivotable between a use position and a stored/shipping position. An armrest may be configured to pivot with an associated chair seat, a chair back or may be independent of each. Optionally, an armrest may be excluded.

Figure 7B:
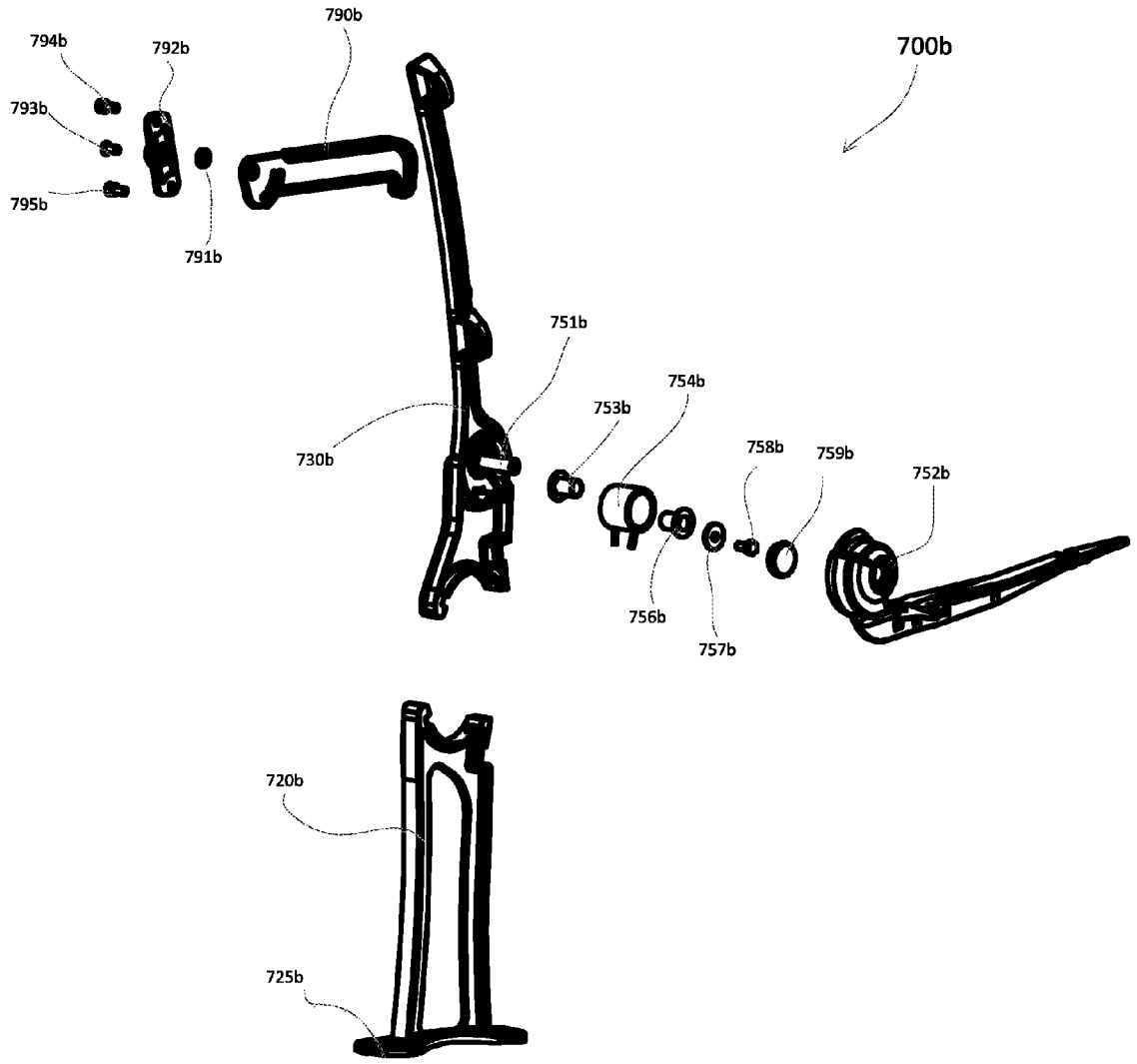
Figure 8:
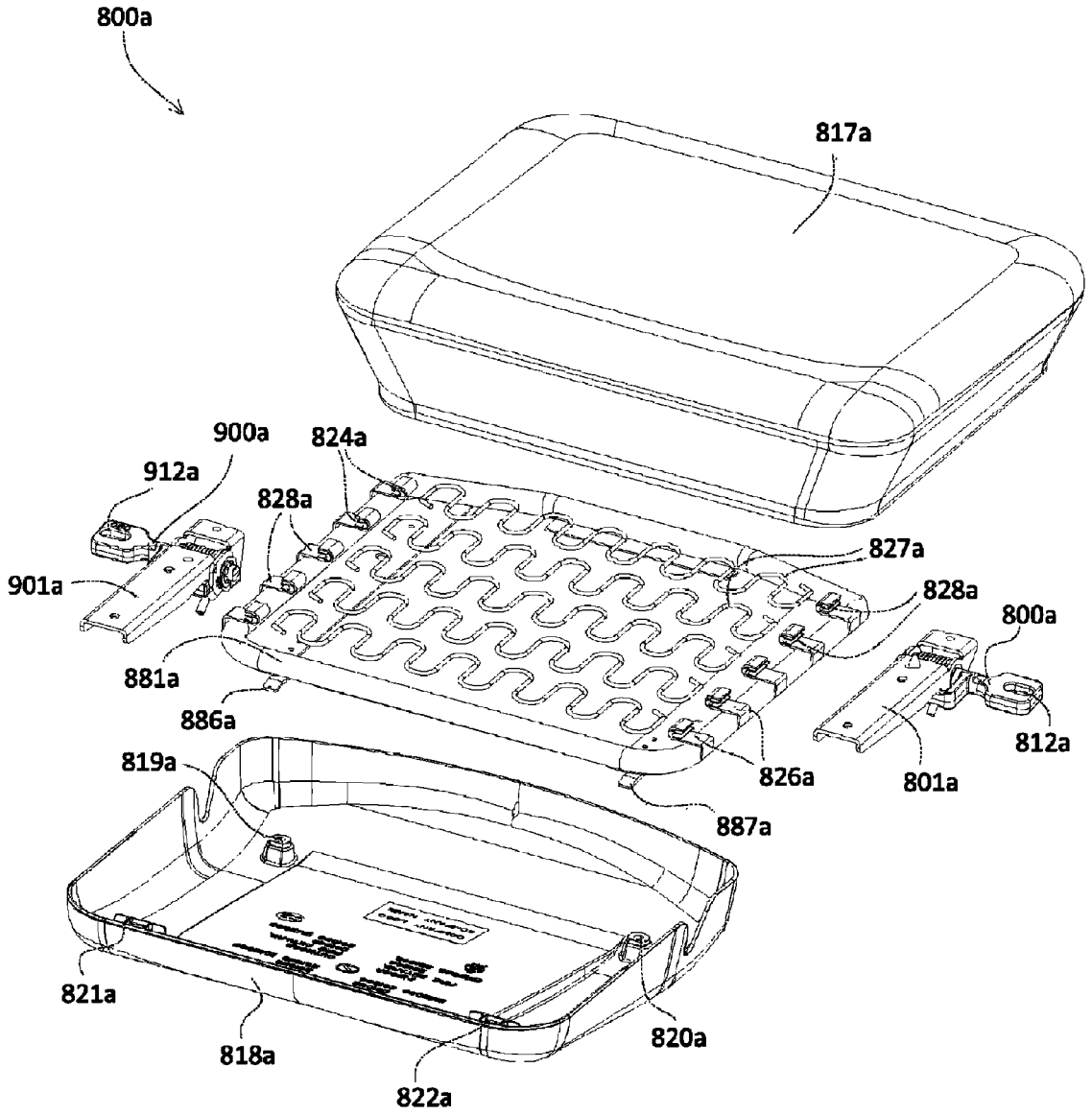
FIG. 8 depicts a top, front, exploded perspective view of an example chair seat assembly having pivot mechanisms incorporated.

Turning to FIG. 7B, a beam mounted chair assembly 700*b* is depicted including a standard 720*b* having a mounting foot 720*b* and a chair bracket 730*b* including a pivotally attached chair seat bracket 752*b* and armrest 790*b*. A chair seat bracket 752*b* may be pivotally attached to a chair bracket 730*b* via chair bracket pivot post 751*b*, first cam 753*b*, a biasing spring 754*b*, a second cam 756*b*, a washer 757*b*, a first fastener 758*b* and a second fastener 759*b*. The biasing spring 754*b* may be configured within the chair seat pivot 750*b* such that the biasing spring may be in a neutral state when an associated chair seat is in a standby position (e.g., three-quarter position as shown in FIGS. 5B and 6C, a nine-tenths position, a five-eighth position, full fold position, etc.) and may be in a charged state when a patron sets on the chair seat. The chair seat pivot 750*b* may be configured to automatically pivot between an in use position (chair seat 650*c*, 650*d* shown in solid lines in FIGS. 6C and 6D, respectively) and a three-quarter up position (chair seat 650*c* shown in dashed lines in FIG. 6C) and manually push to full fold (chair seat 650*d* shown in dashed lines in FIG. 6D).

Figure 7C:
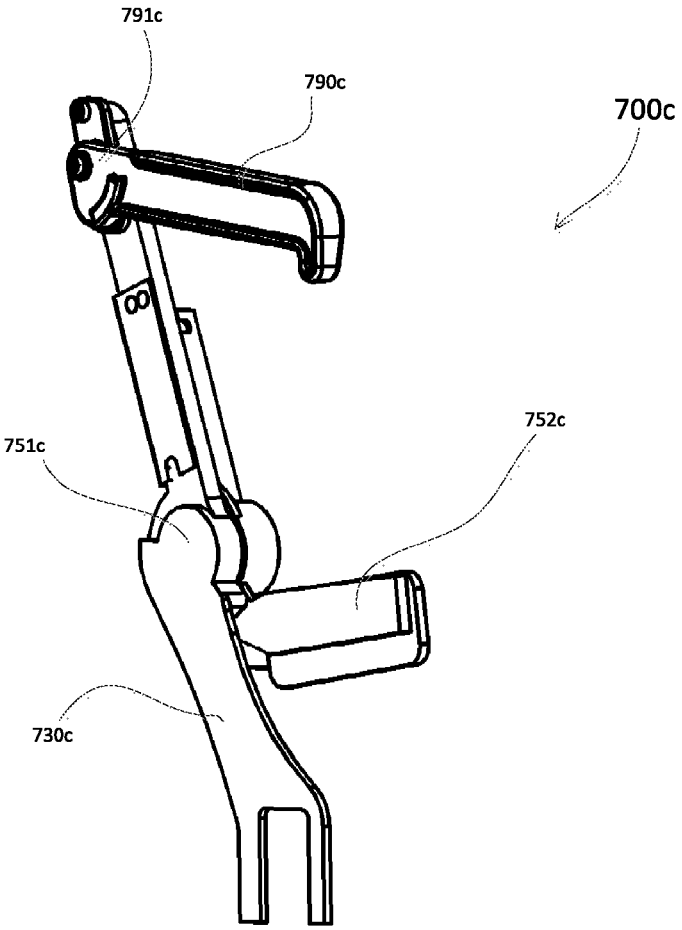
Figure 7D:
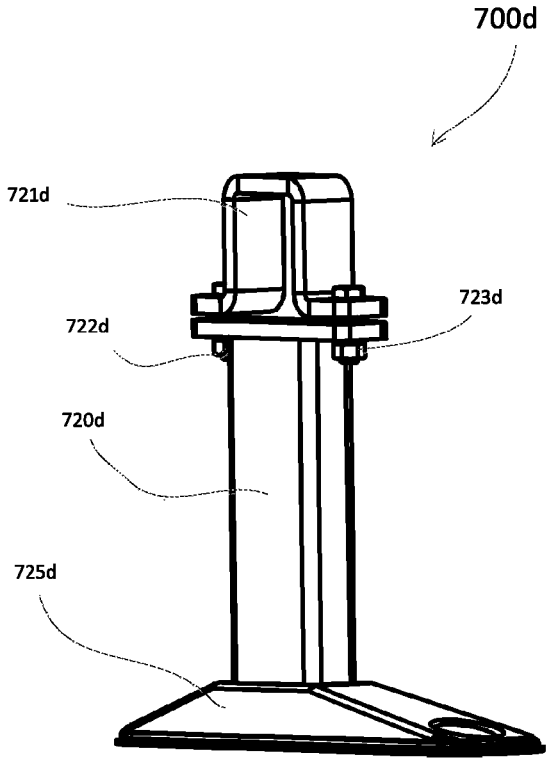

With reference to FIG. 7C, a beam mounted chair assembly 700*c* is depicted including a chair seat bracket 752*c* pivotally attached to a chair bracket 730*c* via a chair seat pivot mechanism 751*c* and an armrest 790*c* pivotally attached via an armrest pivot mechanism 791*c*. FIG. 7D depicts a standard 720*d* including a mounting foot 725*d* and a beam bracket 721*d* fastened to the standard 720*d* via bolts 722*d*, 723*d*.

Figure 7E:
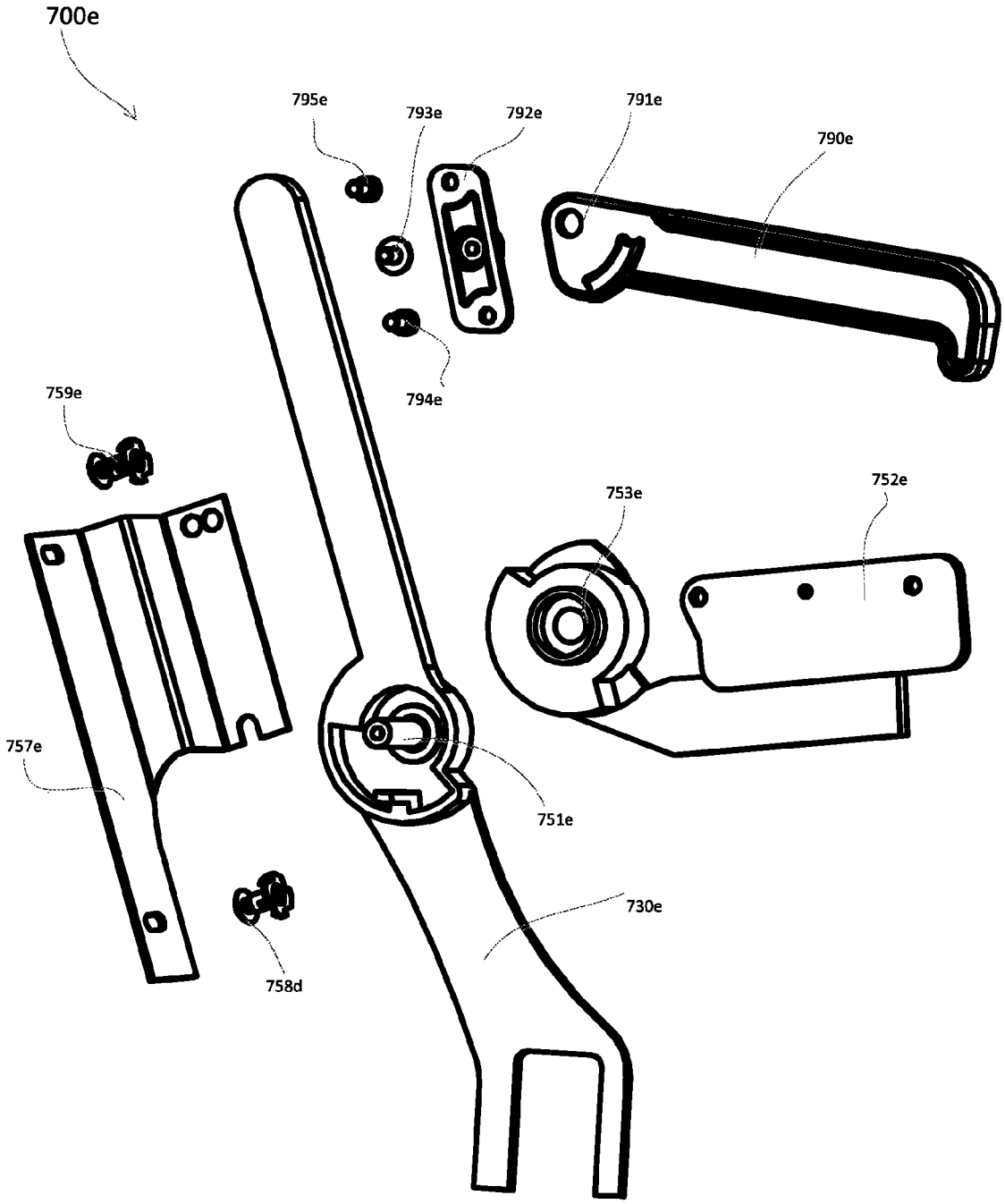
Figure 7F:
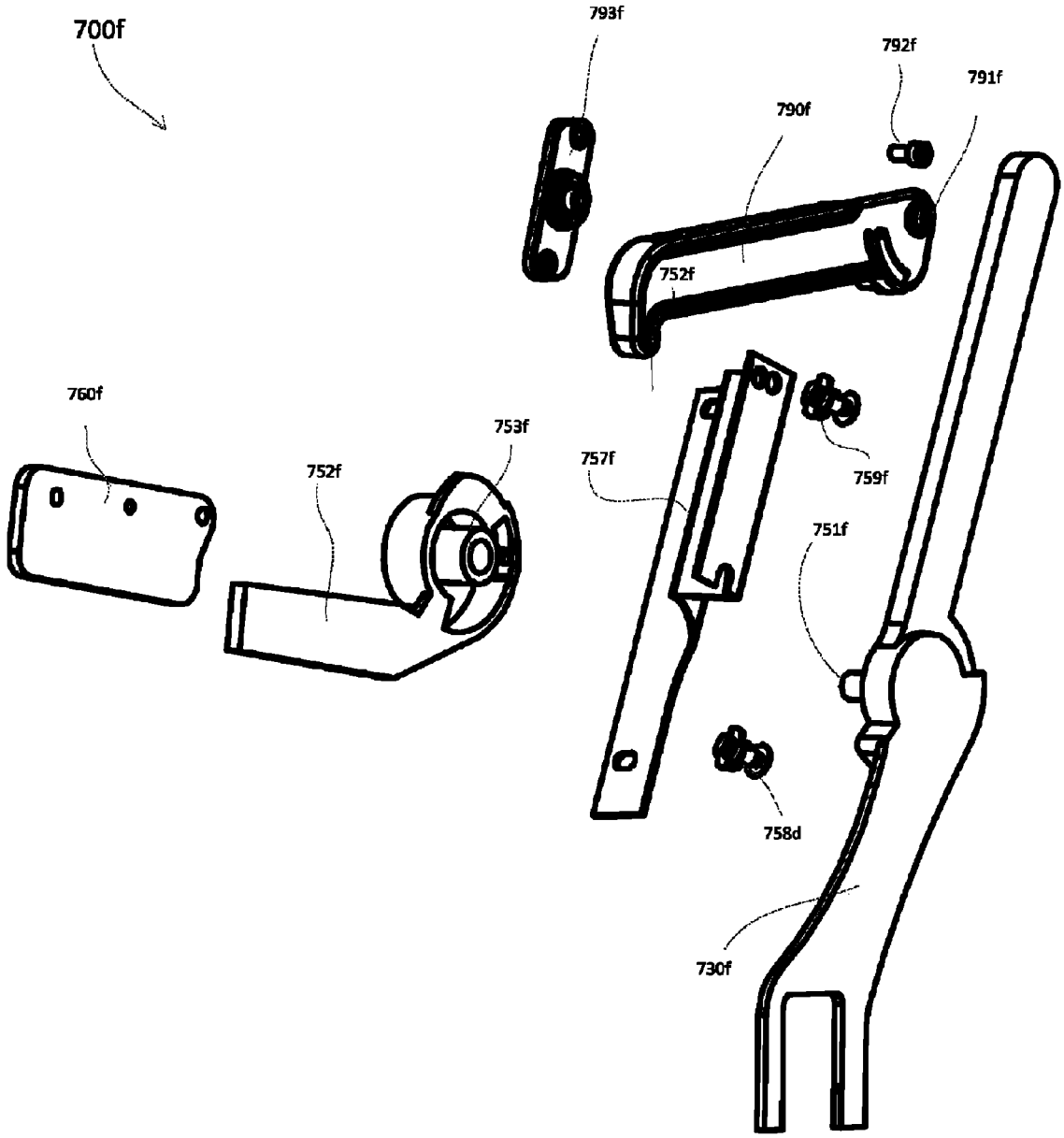

Turning to FIGS. 7E and 7F, beam mounted chair assemblies 700*e*, 700*f* are depicted including a chair seat bracket 752*e*, 752*f* pivotally attached to a chair bracket 730*e*, 730*f* via a chair seat pivot mechanism 751*e*, 751*f*, an armrest 790*e*, 790*f* pivotally attached via an armrest pivot mechanism 791*e*, 791*f*, a chair back bracket 757*e*, 757*f* and chair back fasteners 758*e*, 758*f*, 759*e*, 759*f*. An armrest pivot mechanism 791*e*, 791*f* may include an armrest mounting bracket 792*e*, 792*f* attached to the chair bracket 730*e*, 730*f* via fasteners 794*e*, 794*f*, 795*e*, 795*f* and an armrest pivot post 793*e*, 793*f*.

Turning to FIG. 8, a top, front, exploded perspective view of an example chair seat assembly 800*a* is depicted having a right-hand chair seat pivot assembly 900*a* and a left-hand chair seat pivot assembly 800*a*. As depicted in FIG. 8, the right-hand chair seat pivot assembly 900*a* and the left-hand chair seat pivot assembly 800*a* may be incorporated within the chair seat assembly below a top surface 817*a*. The chair assembly 800*a* may be, for example, as described in commonly assigned application Ser. No. 61/856,013, entitled Telescopic Seating Systems, and Foldable Chairs and Related Components for use within Telescopic Seating Systems, filed Jul. 18, 2013, the entire disclosure of which is incorporated in its entirety by reference herein. As disclosed in this patent application, pivot assemblies 800*a*, 900*a* may, for example, be spring loaded to provide an automatic chair seat pivot from an "in use" position to a three-quarter folded up position. The pivot assemblies 800*a*, 900*a* may be configured to provide a push-to-full-fold feature similar to, for example, the assemblies 500*a* of FIG. 5A and 600*d* of FIG. 6D.

This detailed description is to be construed as exemplary only and does not describe every possible embodiment, as describing every possible embodiment would be impractical, if not impossible. One could implement numerous alternate embodiments, using either current technology or technology developed after the filing date of this application.

What is claimed is:

1. A beam mounted chair assembly, comprising:

a first beam having an end, wherein the first beam is supported on a first standard and a second standard, and wherein the first beam extends horizontally from the first standard to the second standard;

a second beam having an end, wherein the second beam is supported on a third standard and a forth standard, and wherein the second beam extends horizontally from the third standard to the forth standard;

a beam coupler, wherein the beam coupler secures the end of the first beam in alignment with the end of the second beam; and at least one chair assembly having a first chair bracket and a second chair bracket, wherein at least a first portion of the first chair bracket is secured to the first beam and at least a first portion of the second chair bracket is secured to the second beam.

2. A beam mounted chair assembly as in claim 1, wherein a first portion of the beam coupler is inserted inside the end of the first beam and a second portion of the beam coupler is inserted inside the end of the second beam.

3. A beam mounted chair assembly as in claim 2, wherein the first chair bracket is secured to the first beam such that a second portion of the first chair bracket is secured to the second beam.

4. A beam mounted chair assembly as in claim 2, wherein a first portion of first beam is secured to a first portion of the first standard and a second portion of the second beam is secured to a second portion of the first standard.

5. A beam mounted chair assembly as in claim 1, wherein the first and second chair brackets having respective chair seat pivots that pivotally secure a chair seat in proximity to a chair back such that the chair seat is pivotable between an up orientation and a down orientation.

6. A beam mounted chair assembly as in claim 1, wherein at least one of the first standard, the second standard, the third standard, or the forth standard extends horizontally from an associated structure.

7. A beam mounted chair assembly as in claim 1, wherein at least one of the first beam or the second beam defines a curve in a horizontal plane.

8. A beam mounted chair assembly, comprising:

a first beam having an end, wherein the first beam includes a first surface that is supported on at least one first standard, wherein the first surface of the first beam includes a fulcrum for engagement with the first beam, and wherein the first beam extends horizontally from the at least one first standard to the at least one second standard;

a second beam having an end, wherein the second beam is supported on at least one second standard, wherein the first beam extends horizontally from the at least one first standard toward the at least one second standard, and wherein the second beam extends horizontally from the at least one second standard toward the at least one first standard;

a beam coupler, wherein the beam coupler secures the end of the first beam in alignment with the end of the second beam; and at least one chair assembly having a first chair bracket and a second chair bracket, wherein at least a first portion of the first chair bracket is secured to the first beam and at least a first portion of the second chair bracket is secured to the second beam.

9. A beam mounted chair assembly as in claim 8, wherein a first portion of the beam coupler is inserted inside the end of the first beam and a second portion of the beam coupler is inserted inside the end of the second beam.

10. A beam mounted chair assembly as in claim 9, wherein the second chair bracket is secured to the second beam such that a second portion of the second chair bracket is secured to the first beam.

11. A beam mounted chair assembly as in claim 9, wherein a first portion of first beam is secured to a first portion of the at least one first standard and a second portion of the second beam is secured to a second portion of the at least one first standard.

12. A beam mounted chair assembly as in claim 8, wherein the first and second chair brackets having respective chair seat pivots that pivotally secure a chair seat in proximity to a chair back such that the chair seat is pivotable between an up orientation and a down orientation.

13. A beam mounted chair assembly as in claim 8, wherein at least one of the first standard or the at least one second standard extends vertically from an associated structure.

14. A beam mounted chair assembly as in claim 8, wherein at least one of the first beam or the second beam defines a curve in a horizontal plane.

15. A beam mounted chair assembly, comprising:

a first beam having an end, wherein the first beam is supported on at least one first standard, wherein the first beam extends horizontally from the at least one first standard to the at least one second standard, wherein a first surface of the first beam is symmetrical with respect to a second surface of the first beam, wherein the first surface is oriented opposite with respect to the second surface, wherein a third surface of the first beam is non-symmetrical with respect to a fourth surface of the first beam, and wherein the third surface is oriented opposite the fourth surface;

a second beam having an end, wherein the second beam is supported on at least one second standard, wherein the first beam extends horizontally from the at least one first standard toward the at least one second standard, and wherein the second beam extends horizontally from the at least one second standard toward the at least one first standard;

a beam coupler, wherein the beam coupler secures the end of the first beam in alignment with the end of the second beam; and at least one chair assembly having a first chair bracket and a second chair bracket secured to at least one of: the first beam or the second beam.

16. A beam mounted chair assembly as in claim 15, wherein a first portion of the beam coupler is inserted inside the end of the first beam.

17. A beam mounted chair assembly as in claim 15, wherein a portion of the first chair bracket is secured to the first beam and a second portion of the first chair bracket is secured to the second beam.

18. A beam mounted chair assembly as in claim 15, wherein a first portion of first beam is secured to a first portion of the at least one first standard and a second portion of the second beam is secured to a second portion of the at least one first standard.

19. A beam mounted chair assembly as in claim 15, wherein the first and second chair brackets having respective chair seat pivots that pivotally secure a chair seat in proximity to a chair back such that the chair seat is pivotable between an up orientation and a down orientation.

20. A beam mounted chair assembly as in claim 15, wherein the at least one first standard extends vertically from an associated structure and the at least one second standard extends horizontally from the associated structure.

* * * * *